US007821477B2

(12) United States Patent
Jung et al.

(10) Patent No.: US 7,821,477 B2
(45) Date of Patent: Oct. 26, 2010

(54) PLASMA DISPLAY APPARATUS AND DRIVING METHOD THEREOF

(75) Inventors: Yun Kwon Jung, Gumi-si (KR); Gi Bum Lee, Changwon-si (KR); Muk Hee Kim, Daegu (KR)

(73) Assignee: LG Electronics Inc., Seoul (KR)

( * ) Notice: Subject to any disclaimer, the term of this patent is extended or adjusted under 35 U.S.C. 154(b) by 1219 days.

(21) Appl. No.: 11/187,928

(22) Filed: Jul. 25, 2005

(65) Prior Publication Data

US 2006/0114183 A1 Jun. 1, 2006

(30) Foreign Application Priority Data

Nov. 19, 2004 (KR) ..... 10-2004-0095451
Nov. 19, 2004 (KR) ..... 10-2004-0095455

(51) Int. Cl.
*G09G 3/28* (2006.01)

(52) U.S. Cl. ..... 345/67

(58) Field of Classification Search ..... 345/60–69
See application file for complete search history.

(56) References Cited

U.S. PATENT DOCUMENTS 5,317,334 A 5/1994 Sano
5,446,344 A 8/1995 Kanazawa
5,790,087 A 8/1998 Shiteta et al.
6,002,381 A * 12/1999 Tomio et al. ..... 345/60
6,262,699 B1 7/2001 Suzuki et al.
6,448,947 B1 * 9/2002 Nagai ..... 345/60
6,483,251 B2 * 11/2002 Setoguchi et al. ..... 315/169.4
6,489,939 B1 * 12/2002 Asao et al. ..... 345/65
6,677,714 B2 * 1/2004 Du et al. ..... 315/169.4
6,720,940 B2 * 4/2004 Awamoto et al. ..... 345/60
7,015,648 B2 * 3/2006 Son et al. ..... 315/169.4
7,068,243 B2 6/2006 Morimoto
7,271,782 B2 9/2007 Yoon et al.
7,358,931 B2 * 4/2008 Mizobata et al. ..... 345/60
7,417,604 B2 8/2008 Kim
7,508,359 B2 * 3/2009 Han ..... 345/60

(Continued)

FOREIGN PATENT DOCUMENTS

CN 1504982 6/2004

(Continued)

*Primary Examiner*—Richard Hjerpe
*Assistant Examiner*—Carolyn R Edwards
(74) *Attorney, Agent, or Firm*—McKenna Long & Aldridge LLP

(57) ABSTRACT

The present invention relates to a plasma display apparatus and a driving method thereof in which an erroneous discharge, a misdischarge and an abnormal discharge are prevented, a darkroom contrast is increased, an operation margin is widen, and an influence of a lower substrate wall charge is reduced in a sustain discharge. The plasma display apparatus and its driving method is characterized in that when the plasma display panel has a second temperature higher than a first temperature, a period between the last sustain pulse generated during a sustain period of $(n-1)^{th}$ sub-field ("n" is a positive integer) and an initialization signal generated during a reset period of $n^{th}$ sub-field is more lengthened than when it has the first temperature. The plasma display apparatus and its driving method is characterized in that a pre sustain pulse (PRESUSP) rising from a sustain bias voltage (Vzb) is applied to the second electrode in the sustain period.

9 Claims, 35 Drawing Sheets

U.S. PATENT DOCUMENTS

| | | | | |
|---|---|---|---|---|
| 2001/0017605 | A1 | 8/2001 | Hashimoto et al. | |
| 2002/0180665 | A1 | 12/2002 | Awamoto et al. | |
| 2002/0195963 | A1* | 12/2002 | Tokunaga et al. | 315/169.3 |
| 2003/0080927 | A1 | 5/2003 | Sim et al. | |
| 2003/0156082 | A1* | 8/2003 | Seo et al. | 345/60 |
| 2004/0001036 | A1 | 1/2004 | Takayama et al. | |
| 2004/0108975 | A1 | 6/2004 | Araki | |
| 2004/0164930 | A1 | 8/2004 | Hashimoto et al. | |
| 2005/0088375 | A1 | 4/2005 | Son | |
| 2005/0280607 | A1* | 12/2005 | Han | 345/63 |
| 2006/0103599 | A1 | 5/2006 | Cho et al. | |

FOREIGN PATENT DOCUMENTS

| | | | |
|---|---|---|---|
| EP | 0 945 844 | | 9/1999 |
| EP | 0961258 | A1 | 12/1999 |
| EP | 1 265 212 | A1 | 12/2002 |
| EP | 1 359 563 | | 11/2003 |
| EP | 1 388 841 | A2 | 2/2004 |
| EP | 1 418 563 | | 5/2004 |
| EP | 1424679 | A2 | 6/2004 |
| EP | 1 528 531 | A2 | 5/2005 |
| EP | 1 530 192 | A2 | 5/2005 |
| EP | 1 659 558 | | 5/2006 |
| JP | 08-305319 | | 11/1996 |
| JP | 09-006283 | | 1/1997 |
| JP | 10-105111 | | 4/1998 |
| JP | 10-207426 | | 8/1998 |
| JP | 10-207427 | | 8/1998 |
| JP | 2000-020024 | | 1/2000 |
| JP | 2000-075835 | | 3/2000 |
| JP | 2000-163001 | | 6/2000 |
| JP | 2001-051649 | | 2/2001 |
| JP | 2001-272948 | | 10/2001 |
| JP | 2001-318649 | | 11/2001 |
| JP | 2002-351394 | | 12/2002 |
| JP | 2003-280572 | | 10/2003 |
| KR | 10-2004-0072366 | | 8/2004 |
| KR | 1020040085741 | | 10/2004 |
| KR | 10-2005-0042372 | | 5/2005 |

* cited by examiner

PLASMA DISPLAY APPARATUS AND DRIVING METHOD THEREOF

This Nonprovisional application claims priority under 35 U.S.C. §119(a) based upon Patent Application No. 10-2004-0095451 filed in Korea on Nov. 19, 2004 and Patent Application No. 10-2004-0095455 filed in Korea on Nov. 19, 2004, the entire contents of which are hereby incorporated by reference for all purposes as if fully set forth herein.

BACKGROUND OF THE INVENTION

1. Field of the Invention

The present invention relates to a plasma display apparatus. More particularly, the present invention relates to a plasma display apparatus and a driving method thereof in which an erroneous discharge or abnormal discharge is prevented, a darkroom contrast is increased, an operation margin is widened, and an influence of a lower substrate wall charge is reduced in a sustain discharge.

2. Discussion of the Related Art

A plasma display apparatus displays a picture by exciting a phosphor using an ultraviolet ray, which is generated when an inert mixture gas such as He+Xe, Ne+Xe, or He+Ne+Xe is discharged. In the plasma display apparatus, thinning and large-scaling are not only facilitated, but also picture quality is improved due to a recent technology development.

In FIG. 1, in order to display a grayscale image, the plasma display apparatus is driven by dividing one frame into several sub-fields each having a different number of light emission times. Each of the sub-fields is divided to have a reset period for initializing a whole image, an address period for selecting a scan line and selecting a discharge cell at the selected scan line, and a sustain period for embodying a grayscale based on the number of discharge times. For example, when an image is displayed in 256 grayscales, a frame period (16.67 ms) corresponding to 1/60 second is divided into eight sub-fields (SF1 to SF8). As described above, each of the eight sub-fields (SF1 to SF8) is divided into the reset period, the address period and the sustain period. The reset period and the address period are identical at each sub-field, whereas the sustain period and the number of sustain pulses allocated are increased in a ratio of $2^n$ (where n=0,1,2,3,4,5,6,7) for each sub-field.

FIG. 2 is a schematic plan view illustrating an electrode arrangement of a related art three-electrode alternate current surface discharge type plasma display panel (Hereinafter, referred to as "PDP").

In FIG. 2, the alternate current surface discharge type PDP includes scan electrodes (Y1 to Yn) and sustain electrodes (Z) formed on an upper substrate; and address electrodes (X1 to Xm) formed on a lower substrate and right-angled with the scan electrodes (Y1 to Yn) and the sustain electrodes (Z).

Discharge cells 1 are arranged in matrix form at an intersection of the scan electrodes (Y1 to Yn), the sustain electrodes (Z) and the address electrodes (X1 to Xm) to express any one of red, green and blue.

A dielectric layer and an MgO protective layer are layered on the upper substrate having the scan electrodes (Y1 to Yn) and the sustain electrodes (Z).

A barrier rib is formed on the lower substrate having the address electrodes (X1 to Xm) to prevent optic and electric confusion between adjacent discharge cells 1. Phosphor is formed on the lower substrate and the barrier rib and excited by an ultraviolet ray, thereby emitting a visible ray.

An inert mixture gas such as He+Xe, Ne+Xe and He+Xe+Ne is injected into a discharge space provided between the upper substrate and the lower substrate in the PDP.

FIG. 3 illustrates a driving wave form applied to the PDP of FIG. 2. The driving wave form of FIG. 3 is described with reference to wall charge distributions of FIGS. 4A to 4E.

In FIG. 3, each of sub-fields (SFn−1, SFn) includes a reset period (RP) for initializing the discharge cells 1 of a whole image, an address period (AP) for selecting the discharge cell, a sustain period (SP) for sustaining the discharge of the selected discharge cell 1, and an erasure period (EP) for erasing wall charges in the discharge cell 1.

In the erasure period (EP) of the $(n-1)^{th}$ sub-field (SFn−1), an erasure ramp wave form (ERR) is applied to sustain electrodes (Z). During the erasure period (EP), Ovolts is applied to the scan electrodes (Y) and the address electrodes (X). The erasure ramp wave form (ERR) is a positive ramp wave form gradually rising from Ovolts to a positive ramp wave form (Vs). By the erasure ramp wave form (ERR), an erasure discharge is generated between the scan electrode (Y) and the sustain electrode (Z) in on-cells where a sustain discharge is generated. As a result, each of the discharge cells 1 has the wall charge distribution of FIG. 4A soon after the erasure period (EP).

In a set-up period (SU) of the reset period (RP) at which the $n^{th}$ sub-field (SFn) begins, a positive ramp wave form (PR) is applied to all the scan electrodes (Y), and 0V is applied to the sustain electrodes (Z) and the address electrodes (X). By the positive ramp wave form (PR) of the set-up period (SU), a voltage of the scan electrode (Y) gradually rises from the positive sustain voltage (Vs) to a reset voltage (Vr) higher than the positive sustain voltage (Vs). By the positive ramp wave form (PR), a dark discharge not almost generating light is generated between the scan electrodes (Y) and the address electrodes (X) and is concurrently generated between the scan electrodes (Y) and the sustain electrodes (Z) in the discharge cells of the whole image. As a result of the dark discharge, soon after the set-up period (SU), as shown in FIG. 4B, positive wall charges remain on the address electrodes (X) and the sustain electrodes (Z), and negative wall charges remain on the scan electrodes (Y). While the dark discharge is generated at the set-up period (SU), gap voltages (Vg) between the scan electrodes (Y) and the sustain electrodes (Z) and between the scan electrodes (Y) and the address electrodes (X) are initialized closely to a firing voltage (Vf) causing the discharge.

In a set-down period (SD) of the reset period (RP) subsequent to the set-up period (SU), a negative ramp wave form (NR) is applied to the scan electrodes (Y). At the same time, a positive sustain voltage (Vs) is applied to the sustain electrodes (Z), and 0V is applied to the address electrodes (X). By the negative ramp wave form (NR), the voltage of the scan electrode (Y) drops from the positive sustain voltage (Vs) to a negative erasure voltage (Ve). By the negative ramp wave form (NR), the dark discharge is generated between the scan electrodes (Y) and the address electrodes (X) and is concurrently generated between the scan electrodes (Y) and the sustain electrodes (Z) in the whole discharge cells of the whole image. As a result of the dark discharge of the set-down period (SD), the wall charge distribution of each of the discharge cells 1 is changed to be in an optimal address condition as shown in FIG. 4C. In this time, excessive wall charges that are unnecessary for an address discharge are erased from the scan electrodes (Y) and the address electrodes (X), and a predetermined amount of wall charges remain in each of the discharge cells 1. As the negative wall charges are shifted from the scan electrodes (Y) and accumulated on the sustain electrodes (Z), the polarity of positive wall charges of the sustain electrodes (Z) are negatively inverted. While the dark discharge is generated in the set-down period (SD) of the reset period (RP), gap voltages between the scan electrodes (Y) and the sustain electrodes (Z) and between the scan electrodes (Y) and the address electrodes (X) are close to the firing voltage (Vf).

In the address period (AP), a negative scan pulse (−SCNP) is sequentially applied to the scan electrodes (Y) and at the same time, a positive data pulse (DP) is applied to the address electrodes (X) in synchronization with the negative scan pulse (−SCNP). A voltage of the scan pulse (−SCNP) is a scan voltage (Vsc) falling from 0V or a negative scan bias voltage (Vyb) close thereto to a negative scan voltage (−Vy). A voltage of the data pulse (DP) is a positive data voltage (Va). During the address period (AP), a positive Z bias voltage (Vzb) lower than the positive sustain voltage (Vs) is supplied to the sustain electrodes (Z). While the gap voltage between the scan electrodes (Y) and the address electrodes (X) exceeds the firing voltage (Vf) in a state where the gap voltage is adjusted closely to the firing voltage (Vf) soon after the reset period (RP), the address discharge is generated between the electrodes (Y, X) in the on-cells having the scan voltage (Vsc) and the data voltage (Va) applied thereto. A primary address discharge, which is generated between the scan electrodes (Y) and the address electrodes (X), generates charged particles in the discharge cell to induce a secondary discharge between the scan electrodes (Y) and the sustain electrodes (Z) as shown in FIG. 4D. FIG. 4E illustrates the wall charge distribution in the on-cells where the address discharge is generated.

The wall charge distribution of off-cells where the address discharge is not generated is substantially sustained to a state of FIG. 4C.

In the sustain period (SP), sustain pulses (SUSP) of the positive sustain voltage (Vs) is alternately applied to the scan electrodes (Y) and the sustain electrodes (Z). By doing so, the on-cells selected by the address discharge generates the sustain discharge between the scan electrodes (Y) and the sustain electrodes (Z) at each of the sustain pulses (SUSP) owing to the wall charge distribution of FIG. 4E. In contrast, the off-cells do not generate the discharge during the sustain period. This is because the wall charge distribution of the off-cells is sustained in a state of FIG. 4C and therefore, when the positive sustain voltage (Vs) is applied to the scan electrodes (Y), the gap voltage between the scan electrodes (Y) and the sustain electrodes (Z) cannot exceed the firing voltage (Vf).

However, the related art plasma display apparatus has a drawback in that during the erasure period (EP) of the $(n-1)^{th}$ sub-field (SFn−1) and the reset period (RP) of the $n^{th}$ sub-field (SFn), the discharge cells 1 are initialized and a number of discharge times is performed for controlling the wall charge, thereby reducing a darkroom contrast value and accordingly reducing a contrast ratio. In Table 1, arranged are discharge types and the number of discharge times performed in the erasure period (EP) and the reset period (RP) of the previous sub-field (SFn−1) in the related art plasma display apparatus.

TABLE 1

| | | Oper. period Cell state | | |
|---|---|---|---|---|
| | | | RP of SFn | |
| | | EP of SFn-1 | SU | SD |
| On-cell turned on at SFn-1 | Opposite discharge (Y-X) | X | ○ | ○ |
| | Surface discharge (Y-Z) | ○ | ○ | ○ |
| Off-cell turned off at SFn-1 | Opposite discharge (Y-X) | X | ○ | ○ |
| | Surface discharge (Y-Z) | X | ○ | ○ |

As shown in Table 1, when the on-cells are turned on at the $(n-1)^{th}$ sub-field (SFn−1), during the erasure period (EP) and the reset period (RP), three times of surface discharge are performed between the scan electrodes (Y) and the sustain electrodes (Z) and two times of opposite discharge are generated between the scan electrodes (Y) and the address electrodes (X). When the off-cells are turned off in the previous sub-field (SFn), during the erasure period (EP) and the reset period (RP), two times of surface discharge are performed between the scan electrodes (Y) and the sustain electrodes (Z), and two times of opposite discharge are generated between the scan electrodes (Y) and the address electrodes (X).

The number of discharge times performed in the erasure period and the reset period causes an increase in an amount of light emission in the erasure period and the reset period, thereby reducing the darkroom contrast value. In consideration of a contrast characteristic, the amount of light emission should be minimized if possible. Specifically, since the surface discharge generates a great amount of light emission in comparison to the opposite discharge, the surface discharge has a great bad influence upon darkroom contrast in comparison to the opposite discharge.

In the related art plasma display apparatus, the negative wall charges are excessively accumulated on the scan electrodes (Y) since the wall charges are not well erased in the erasure period (EP) of the (n−1)th sub-field (SFn−1). Therefore, the dark discharge is not generated in the setup period (SU) of the $n^{th}$ sub-field (SFn). If the dark discharge is not normally performed in the setup period (SU), the discharge cells are not initialized. Accordingly, the reset voltage (Vr) should be increased in order to generate the discharge in the setup period. If the dark discharge is not performed in the setup period (SU), the discharge cell is not in an optimal address condition soon after the reset period. Therefore, an abnormal discharge or an erroneous discharge is caused. In a case where the positive wall charges are excessively accumulated on the scan electrodes (Y) soon after the erasure period (EP) of the $(n-1)^{th}$ sub-field (SFn−1), a strong discharge is generated, thereby not uniformly initializing the whole discharge cells when the positive sustain voltage (Vs) being an initiation voltage of a positive ramp wave form (PR) is applied to the scan electrodes (Y) in the setup period (SU) of the $n^{th}$ sub-field (SFn). The above drawbacks will be in detail described with reference to FIG. 5.

FIG. 5 illustrates an external voltage (Vyz) applied between the scan electrodes (Y) and the sustain electrodes (Z) and the gap voltage (Vg) in the discharge cell in the setup period (SU). Here, the external applied voltage (Vyz) is illustrated using a solid line in FIG. 5, and is applied to each of the scan electrodes (Y) and the sustain electrodes (Z). Since 0V is applied to the sustain electrodes (Z), the external applied voltage (Vyz) is substantially identical with the positive ramp wave form (PR). In FIG. 5, dotted lines ①, ② and ③ indicate the gap voltages (Vg) formed in the discharge gas by the wall charges of the discharge cell. The gap voltages (Vg) are different as shown in the dotted lines ①, ② and ③ because the wall charges are different in amount in the discharge cell depending on whether or not the discharge is generated in the previous sub-field. The external voltage (Vyz) is applied between the scan electrodes (Y) and the sustain electrodes (Z). The gap voltage (Vg) is formed in the discharge gas of the discharge cell.

A relation of the external voltage (Vyz) and the gap voltage (Vg) is expressed in the following Equation 1:

$$Vyz=Vg+Vw \quad \text{[Equation 1]}$$

In FIG. 5, "①" denotes the gap voltage (Vg) where the wall charges are sufficiently erased and minimized in the discharge cell. If the gap voltage (Vg) is increased in proportion to the external applied voltage (Vyz) and reaches the firing voltage (Vf), the dark discharge is generated. By the dark discharge, the gap voltage is initialized to the firing voltage (Vf) in the discharge cells.

In FIG. 5, "②" denotes the gap voltage (Vg) where the strong discharge is generated during the erasure period (EP) of the $(n-1)^{th}$ sub-field (SFn−1) to invert polarities of the wall charges in the wall charge distribution of the discharge cells. Soon after the erasure period (EP), the negative wall charges accumulated on the scan electrodes (Y) are positively inverted in polarity due to the strong discharge. This is caused by the discharge cell having a low uniformity or by the erasure ramp wave form (ERR) varied in slope depending on a temperature variation in a large-scaled plasma display panel. In this time, the initial gap voltage (Vg) is excessively increased as shown in FIG. 5, and therefore, the positive sustain voltage (Vs) is applied to the scan electrodes (Y) in the setup period (SU) and at the same time, the gap voltage (Vg) exceeds the firing voltage (Vf), thereby generating the strong discharge. By the strong discharge, the discharge cells are not initialized to have the wall charge distribution of the optimal address condition, that is, to have the wall charge distribution of FIG. 4C in the setup period (SU) and the setdown period (SD) and therefore, the address discharge can be generated in the off-cells that should be turned off. In other words, when the erasure discharge is strongly generated in the erasure period prior to the reset period, the erroneous discharge can be generated.

In FIG. 5, "③" denotes the gap voltage (Vg) where during the erasure period (EP) of the $(n-1)^{th}$ sub-field (SFn−1), the erasure discharge is not generated or is very weakly generated to maintain without variation the wall charge distribution in the discharge cells. The wall charge distribution is formed as a result of the sustain discharge performed just before the erasure discharge.

In a detailed description, as shown in FIG. 3, the last sustain discharge is generated when the sustain pulse (SUSP) is applied to the scan electrodes (Y). As a result of the last sustain discharge, the negative wall charges remain on the scan electrodes (Y) and the positive wall charges remain on the sustain electrodes (Z). The wall charges should be erased for a normal initialization at a next sub-field, but if the erasure discharge is not performed or is very weakly performed, their polarities are sustained without change. The erasure discharge is not performed or is very weakly performed because the discharge cell has a low uniformity or the erasure ramp wave form (ERR) is varied in slope due to the temperature variance in the PDP. Since the initial gap voltage (Vg) is a very low negative voltage as shown in FIG. 5, the reference ③, the gap voltage (Vg) of the discharge cells does not reach the firing voltage (Vf) even though the positive ramp wave form (RP) rises to the reset voltage (Vr) in the setup period. Therefore, the dark discharge is not generated in the setup period (SU) and the setdown period (SD). As a result, when the erasure discharge is not generated or is very weakly generated in the erasure period before the reset period, an erroneous discharge or an abnormal discharge is caused due to the abnormal initialization.

In FIG. 5 reference ③, a relation of the gap voltage (Vg) and the firing voltage (Vf) is expressed in the following Equation 2, and in FIG. 5 reference ③, a relation of the gap voltage (Vg) and the firing voltage (Vf) is expressed in the following Equation 3:

$$Vgini+Vs>Vf \quad \text{[Equation 2]}$$

$$Vgini+Vr<Vf \quad \text{[Equation 3]}$$

where Vgini: initial gap voltage just before the setup period (SU) begins, as shown in FIG. 5.

A gap voltage condition (or a wall charge condition) for allowing the normal initialization in the erasure period (EP) and the reset period (RP) in consideration of the above drawback is expressed in the following Equation 4 satisfying all the Equations 2 and 3:

$$Vf-Vr<Vgini<Vf-Vs \quad \text{[Equation 4]}$$

As a result, if the initial gap voltage (Vgini) does not satisfy Equation 4 before the setup period (SU), the related art plasma display apparatus can cause an erroneous discharge, a misdischarge or an abnormal discharge, and a narrow operation margin. In other words, in the related art plasma display apparatus, an erasure operation should be normally performed in order to secure an operation reliability and margin, but it may be abnormally performed depending on a discharge cell uniformity or a use temperature in the PDP.

The related art plasma display apparatus has a drawback in that the wall charge distribution gets unstable due to excessive spatial charges and their active momentum in a high-temperature environment, thereby causing the erroneous discharge, the misdischarge or the abnormal discharge and accordingly, the narrow operation margin. This will be described in detail with reference to FIGS. 6A to 6C.

In the high-temperature environment, an amount and a momentum of the spatial charges 61 are generated in the discharge in comparison to a room-temperature environment or a low-temperature environment. Accordingly, the spatial charges 61 are generated in the sustain discharge of the $(n-1)^{th}$ sub-field (SFn−1), and are in active motion in the discharge space even after the setup period (SU) of the $n^{th}$ sub-field (SFn) as shown in FIG. 6A.

In a state where the spatial charges 61 having large momentums exist in the discharge space as shown in FIG. 6A, a data voltage (Va) is applied to the address electrode (X) and a scan voltage (−Vy) is applied to the scan electrode (SU) during the address period. If so, as a result of the setup discharge of the setup period (SU), the positive spatial charges 61 are recombined with the negative wall charges accumulated on the scan electrode (Y) and the negative spatial charges 61 are recombined with the positive wall charges accumulated on the address electrode (Y), as shown in FIG. 6B.

As a result, the negative wall charges formed by the setup discharge are erased from the scan electrode (Y) and the positive wall charges formed by the setup discharge are erased from the address electrode (X) as shown in FIG. 6C.

Accordingly, even though the data voltage (Va) and the scan voltage (−Vy) are applied to the address electrode (X) and the scan electrode (Y), the gap voltage (Vg) does not reach the firing voltage (Vf). Therefore, the address discharge is not generated. Accordingly, there is a drawback in that on-cells are often miswritten if the driving wave form of FIG. 3 is applied to the PDP in the high-temperature environment.

In the related art plasma display apparatus, if a nonuniformity of a lower substrate structure (for example, a shape nonuniformity of a barrier rib or a thickness nonuniformity of phosphor) is caused by a process error, the wall charges accumulated on the lower substrate between adjacent discharge cells can be greatly different in amount. In a data modulation using a data pattern where any one of adjacent discharge cells functions as the on-cell and the other functions as the off-cell to generate the discharge only at one-side on-cell, or using a dither mask having the same effect, the wall charges accumulated on the lower substrate between the adjacent discharge cells can be greatly different in amount. If the wall charges accumulated on the lower substrate of the adjacent discharge cells are different in amount and the wall charges are excessively accumulated on the lower substrate of an undesired off-cell among them, the off-cell is erroneously discharged during the sustain period and displayed as a spot. This erroneous spot discharge is caused by a great influence of the wall charges of the lower substrate upon the sustain discharge, and is generally caused in the plasma display apparatus having a great nonuniformity at an edge of the lower substrate due to the process error.

FIG. 7 is an enlarged view illustrating a driving wave form, which is applied to each of the electrodes (X, Y and Z) between the address period (AP) and the sustain period (SP). FIG. 8 is a view illustrating a first sustain discharge mechanism generated by a first sustain pulse (FSTSUSP).

Referring to FIGS. 7 and 8, if 0V is applied to the address electrode (X) and the sustain electrode (Z) and a voltage of the scan electrode (Y) is varied from 0V to the sustain voltage (Vs) by the first sustain pulse (FSTSUSP), the first sustain discharge is generated in a corresponding discharge cell. However, if the negative wall charges are much accumulated on the lower substrate of the discharge cell, the discharge is generated between the scan electrode (Y) and the sustain electrode (Z) and at the same time, the discharge is strongly generated between the scan electrode (Y) and the address electrode (X). As mentioned above, the sustain discharge is influenced by the wall charges accumulated on the lower substrate and therefore, a green-colored or magenta-colored spot is generated with a low grayscale near a corner of the PDP.

SUMMARY OF THE INVENTION

Accordingly, the present invention is directed to a plasma display apparatus and a driving method thereof that substantially obviates one or more of the problems due to limitations and disadvantages of the related art.

An advantage of the present invention is to provide a plasma display apparatus and a driving method thereof in which discharge is stabilized in a high-temperature environment.

Another advantage of the present invention is that a plasma display apparatus and a driving method thereof are provided in which an influence of a lower substrate wall charges is reduced in a sustain discharge.

A further advantage of the present invention is that a plasma display apparatus and a driving method thereof in which an erroneous discharge, a misdischarge and an abnormal discharge are prevented, a darkroom contrast is increased, and an operation margin is widen.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF ILLUSTRATED EMBODIMENTS

Reference will now be made in detail to an embodiment of the present invention, example of which is illustrated in the accompanying drawings.

A plasma display apparatus and its driving method will be described for stabilizing discharge in a high-temperature environment according to the present invention. After that, the plasma display apparatus and its driving method will be in detail described for another advantage of reducing an influence of lower substrate wall charges in a sustain discharge according to the present invention.

Figure 9:
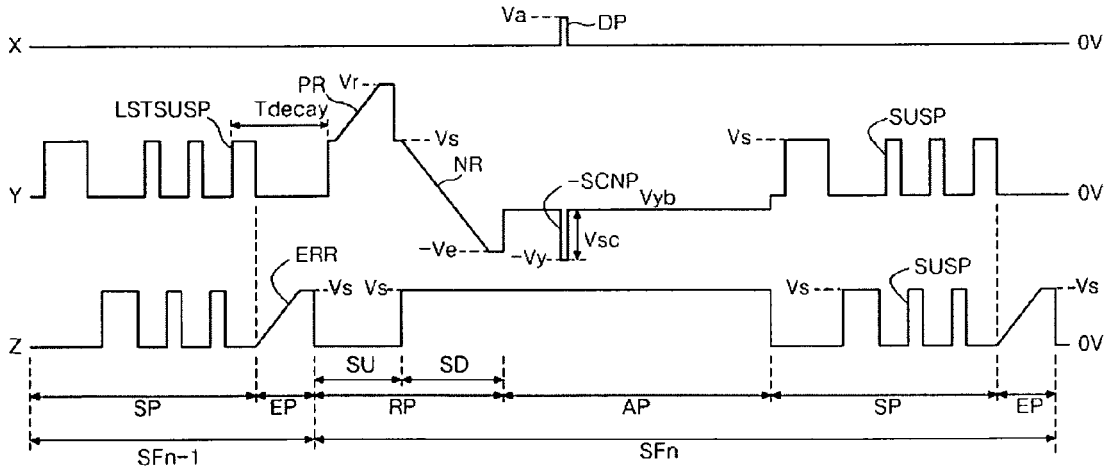
FIG. 9 is a wave form view illustrating a driving method for a plasma display apparatus according to a first embodiment of the present invention.

FIG. 9 is a wave form view illustrating a driving method for a plasma display apparatus according to a first embodiment of the present invention. The driving wave form of FIG. 9 is applied to a three-electrode alternate current surface discharge type plasma display panel (PDP) similar to FIG. 2. In FIG. 9, each of sub-fields (SFn−1, SFn) includes a reset period (RP) for initializing discharge cells of a whole image, an address period (AP) for selecting the discharge cell, a sustain period (SP) for sustaining the discharge of the selected discharge cells, and an erasure period (EP) for erasing wall charges in the discharge cell 1.

Figure 3:
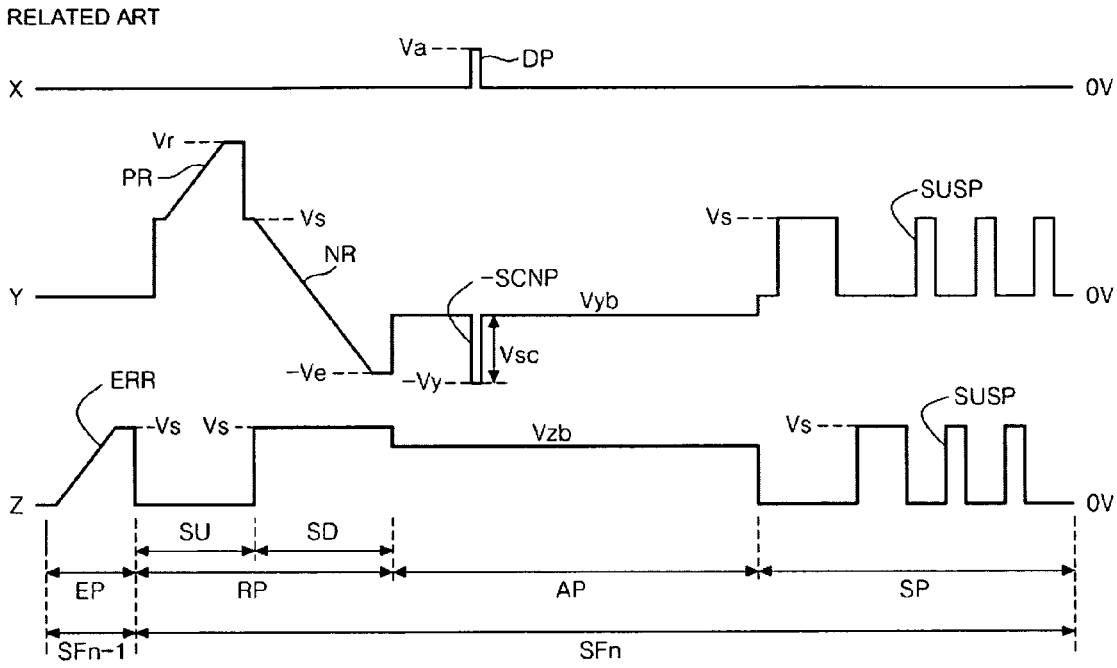
Fig. 3 Related Art
FIG. 3 is a view illustrating a driving wave form of a general plasma display panel.

The reset period (RP), the address period (AP) and the sustain period (SP) are the same as those of a driving wave form of FIG. 3 and accordingly, a detailed description thereof is omitted.

In the driving method for the plasma display apparatus according to the first embodiment of the present invention, it is assumed that the plasma display panel has a first temperature and a second temperature. When the plasma display panel has the second temperature higher than the first temperature, a period between the last sustain pulse and an initialization signal is more lengthened than when it has the first temperature. The last sustain pulse is generated during the sustain period of (n−1)th sub-field ("n" is a positive integer). The initialization signal is generated during the reset period of $n^{th}$ sub-field. Here, it is desirable that the second temperature higher than the first temperature is a high temperature of 40° C. or more.

In other words, when the plasma display panel is in a high-temperature environment of 40° C. or more, a spatial charge decay period (Tdecay) is set to induce a decay of spatial charges between a rising point of the last sustain pulse (LSTSUSP) of the $(n-1)_{th}$ sub-field (SFn−1) and a rising point of a positive ramp wave form (PR) at which the reset period (RP) of the $n_{th}$ sub-field (SFn) begins.

Figure 4A:
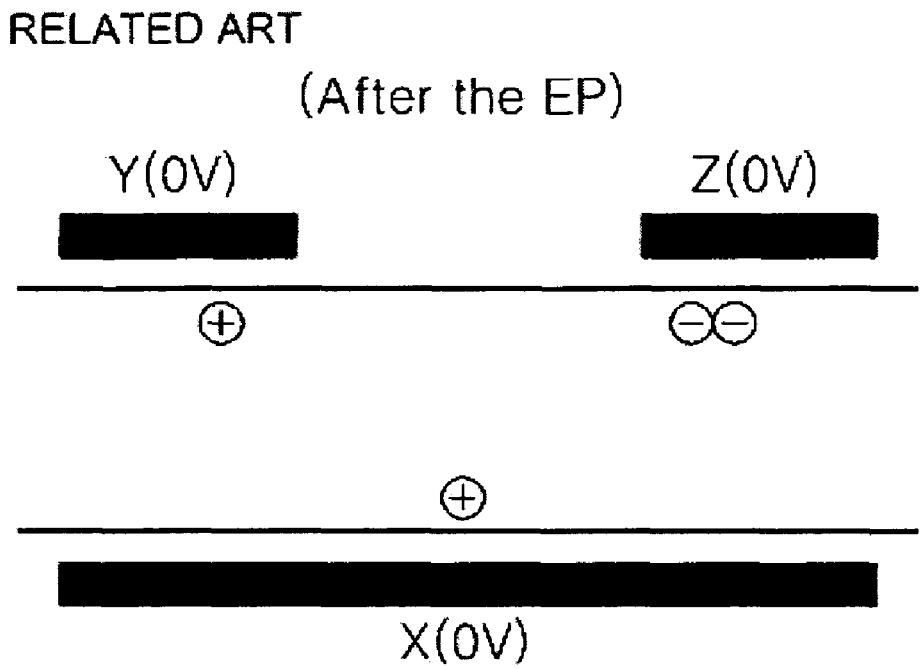
Fig. 4a Related Art
FIGS. 4A to 4E are stepwise views illustrating a wall charge distribution varied by a driving wave form of FIG. 3 in a discharge cell.
Figure 4B:
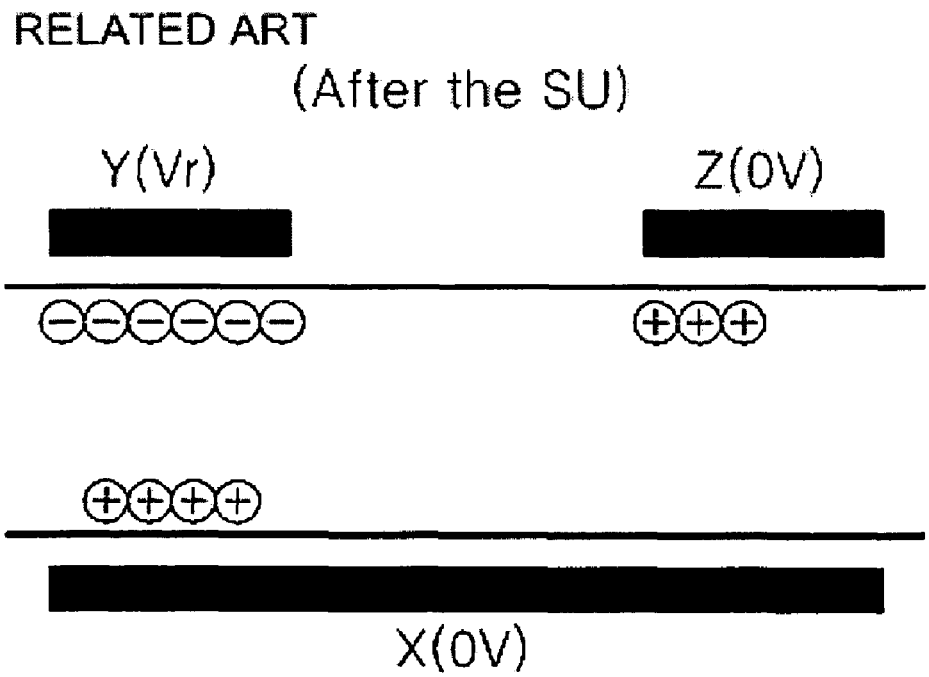
Fig. 4b Related Art
Figure 4C:
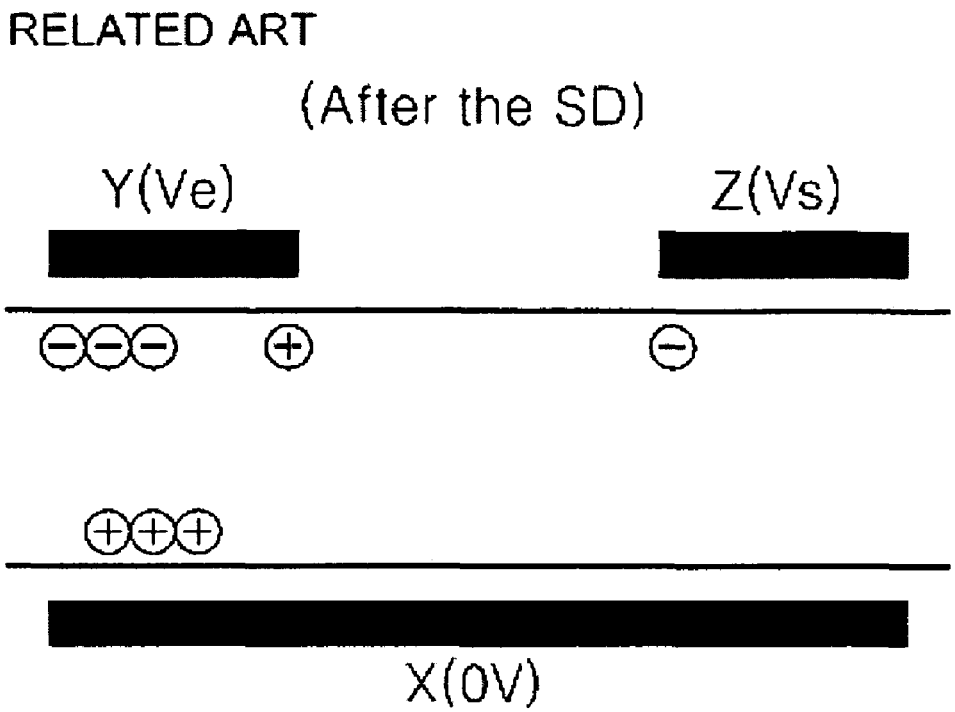
Fig. 4c Related Art
Figure 4D:
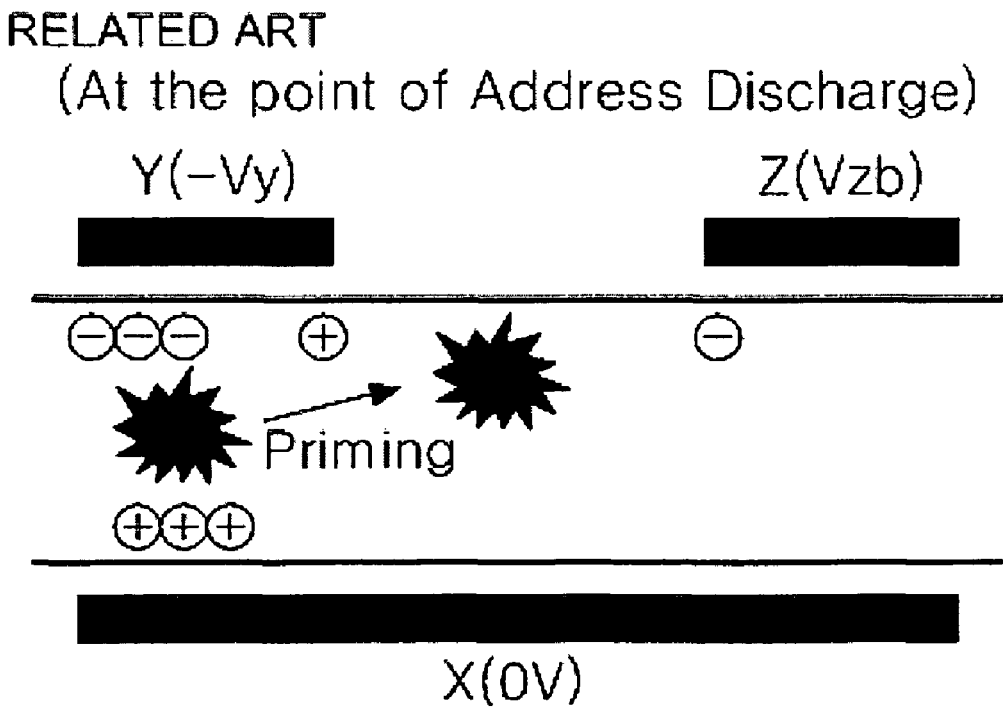
Fig. 4d Related Art
Figure 4E:
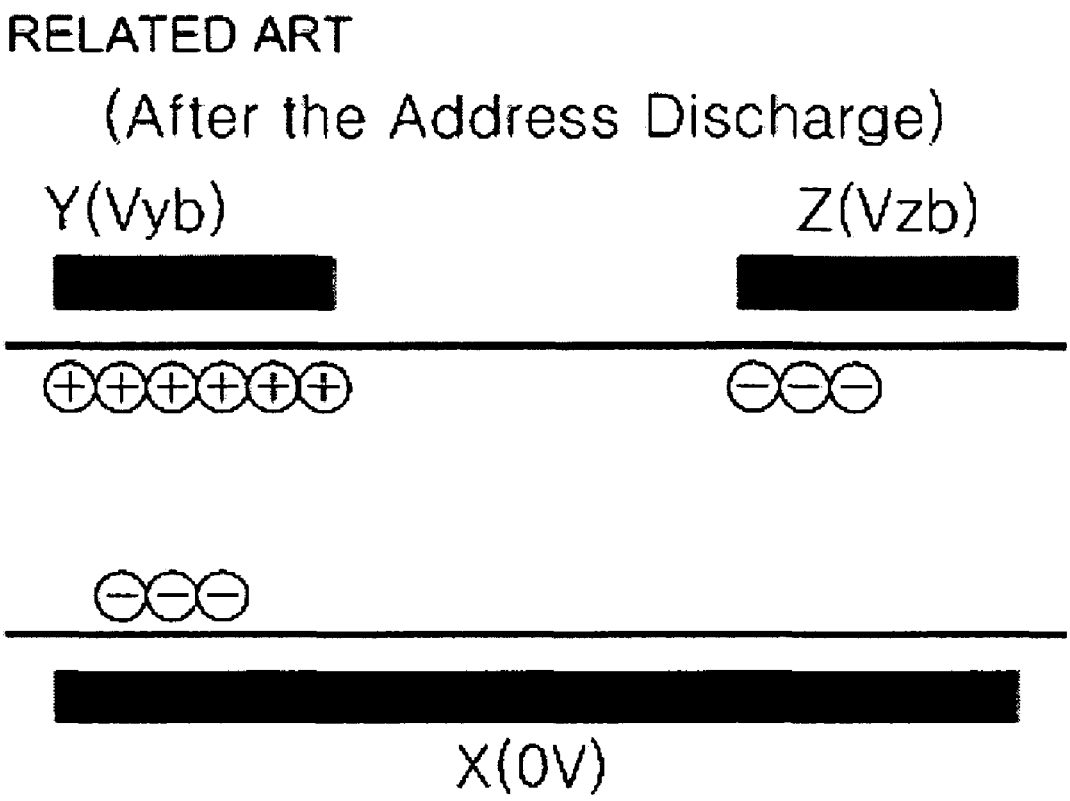
Fig. 4e Related Art
Figure 5:
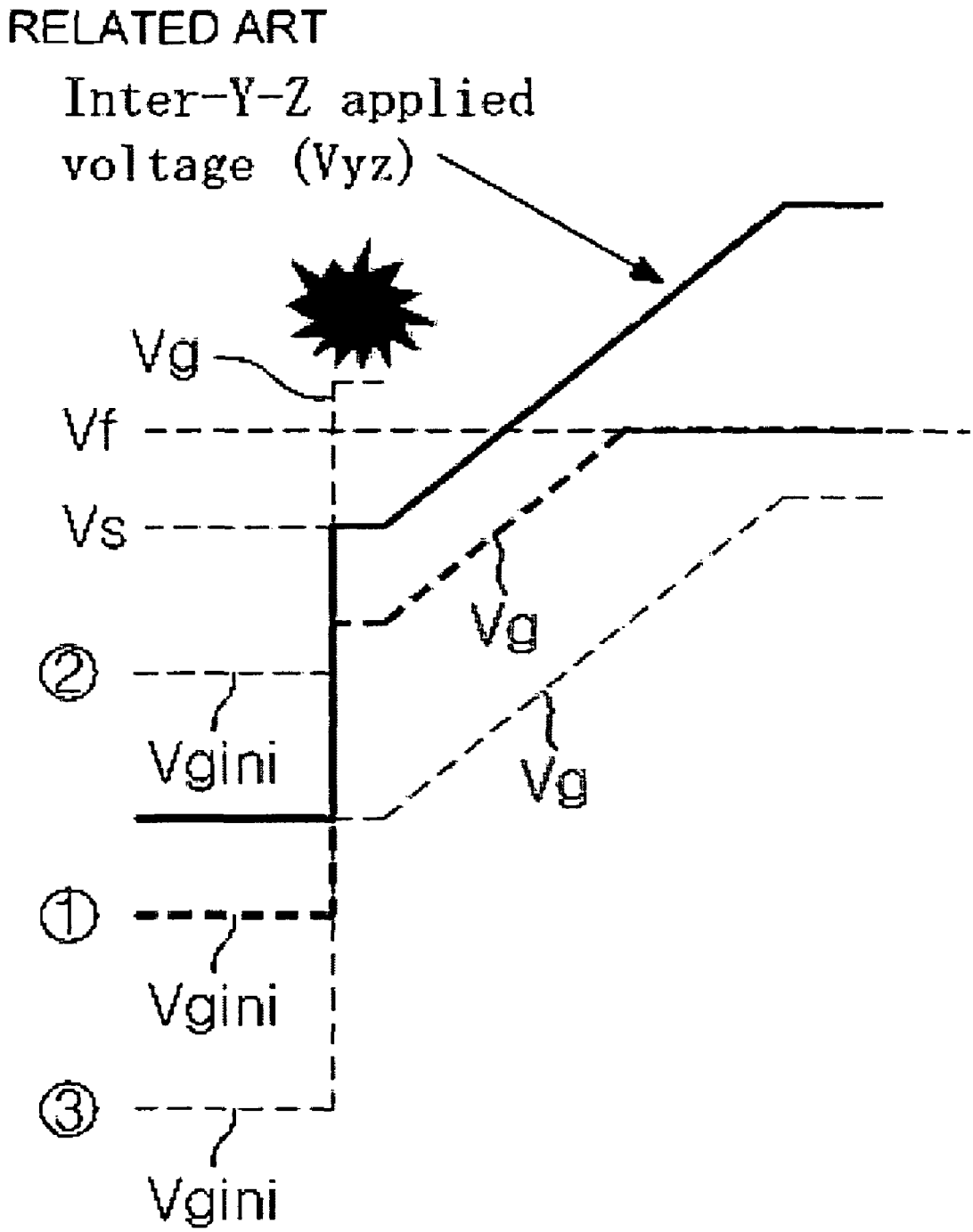
Fig. 5 Related Art
FIG. 5 is a view illustrating variations of an external voltage applied between a scan electrode and a sustain electrode and a gap voltage of a discharge cell at a set-up period when a plasma display panel is driven by a driving wave form of FIG. 3.
Figure 6A:
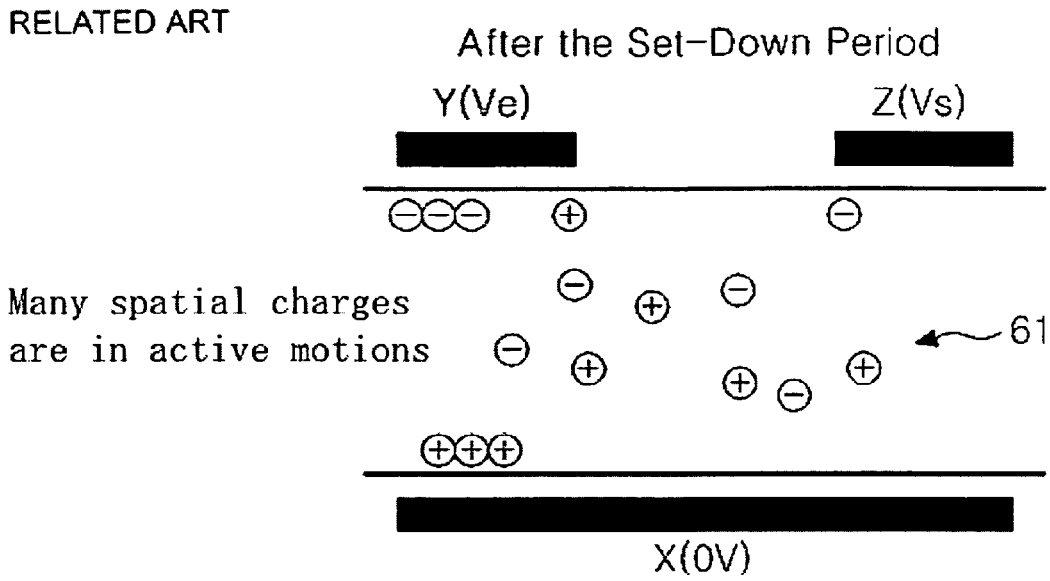
Fig. 6a Related Art
FIGS. 6A to 6C are views illustrating spatial charges and their motions when a plasma display panel is driven by a driving wave form of FIG. 3 in a high-temperature environment.
Figure 6B:
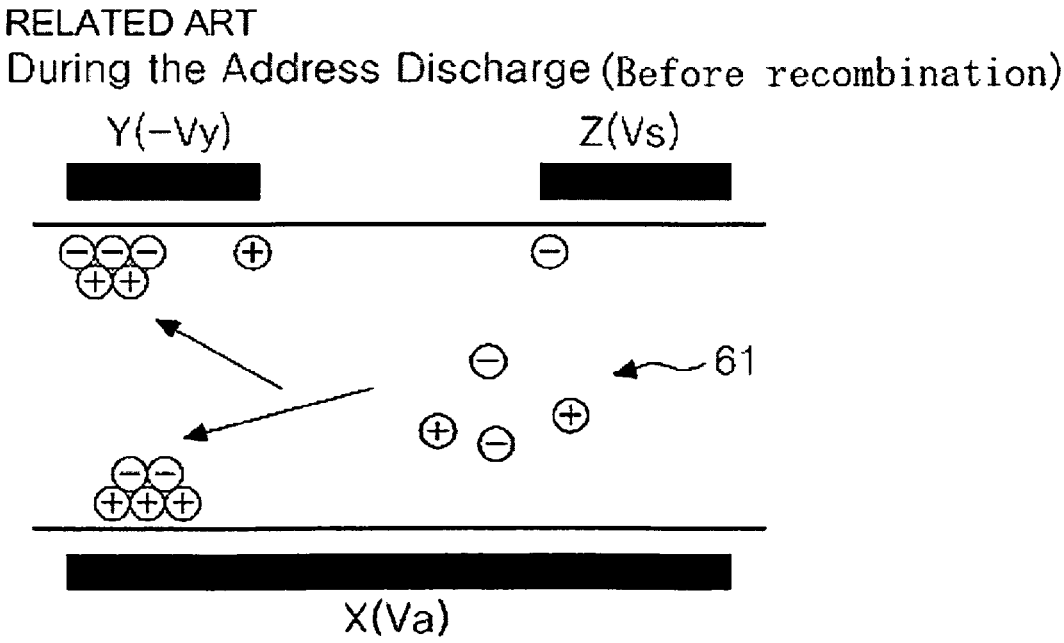
Fig. 6b Related Art
Figure 6C:
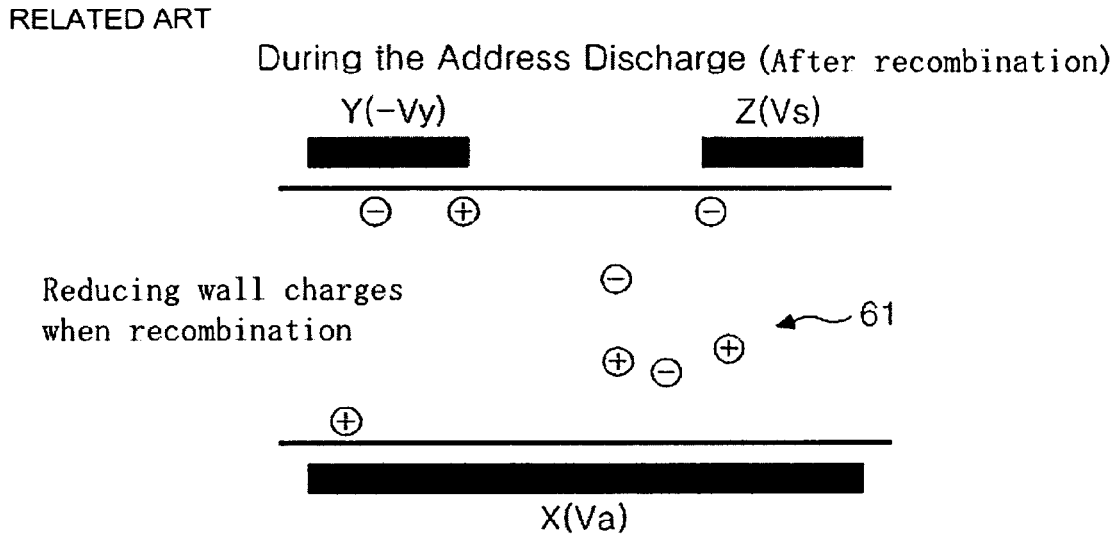
Fig. 6c Related Art
Figure 7:
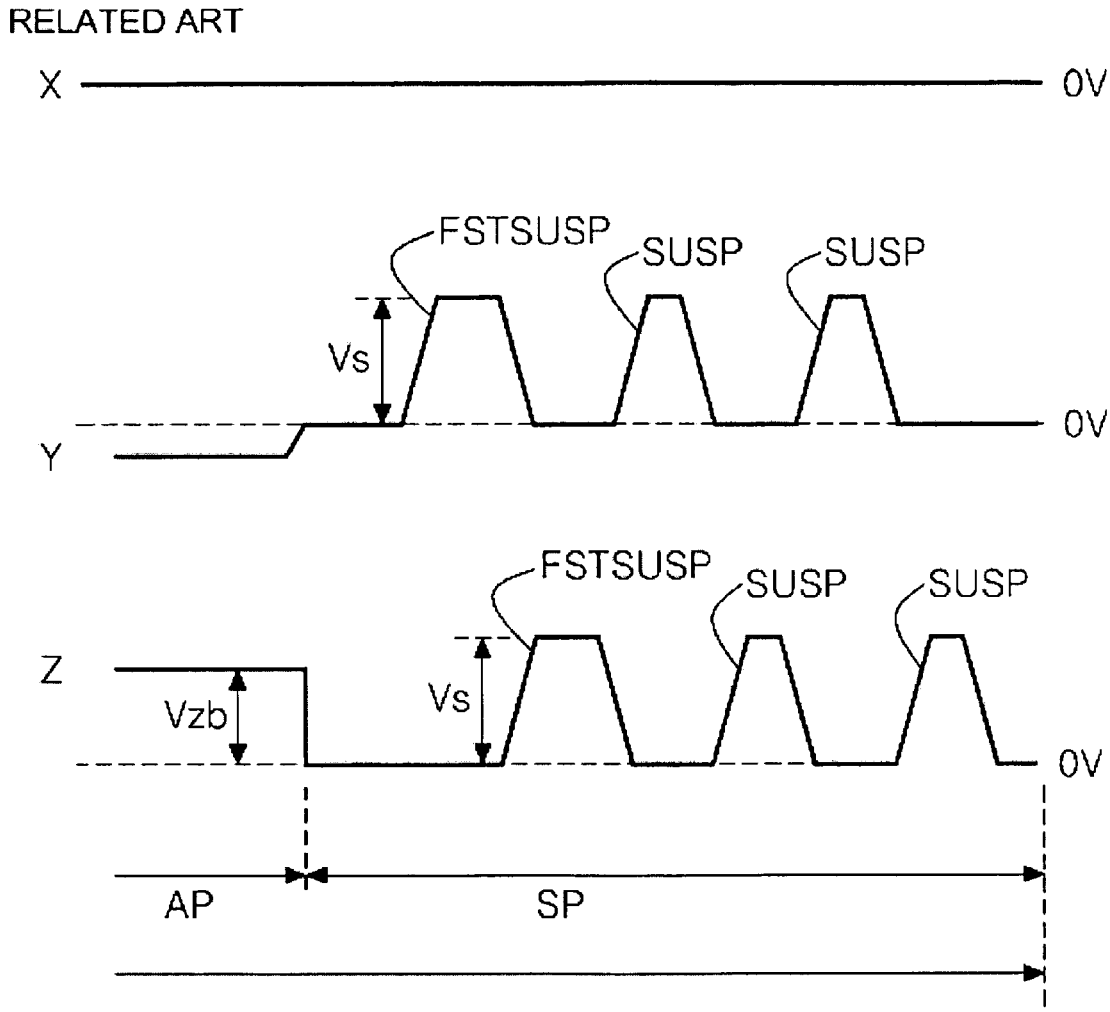
Fig. 7 Related Art
FIG. 7 is an enlarged view illustrating a driving wave form of FIG. 3, which is applied to each of electrodes during a boundary period between an address period and a sustain period.
Figure 8:
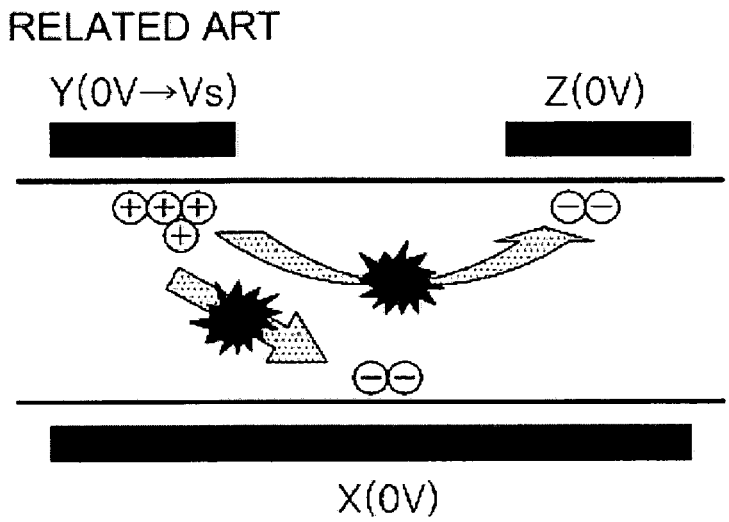
Fig. 8 Related Art
FIG. 8 is a view illustrating a discharge mechanism generated by a first sustain pulse of FIG. 7 in a sustain discharge.

The spatial charge decay period (Tdecay) is set to be longer in the high-temperature environment of 40° C. or more than in a room-temperature environment. The spatial charge decay period is in a range of approximately 200 μs to 500 μs. During the spatial charge decay period (Tdecay), the spatial charges generated in the sustain discharge of the $(n-1)^{th}$ sub-field (SFn−1) are decayed due to recombination with one another and recombination with the wall charges. After the decay of the spatial charge, a set-up discharge and a set-down discharge are continuously performed during the reset period (RP) of the $n^{th}$ sub-field (SFn). As a result, soon after the reset period (RP) of the $n^{th}$ sub-field (SFn), as shown in FIG. 4C, each of the discharge cells is initialized in an optimal wall charge distribution condition of the address discharge almost without the spatial charges.

During the erasure period (EP) of the spatial charge decay period (Tdecay), an erasure ramp wave form (ERR) is applied to sustain electrodes (Z) to induce an erasure discharge. The erasure ramp wave form (ERR) is a positive ramp wave form, which gradually rises from 0V to a positive sustain voltage (Vs). The erasure discharge is performed between the scan electrode (Y) and the sustain electrode (Z) in on-cells where the sustain discharge is performed by the erasure ramp wave form (ERR).

Figure 10:
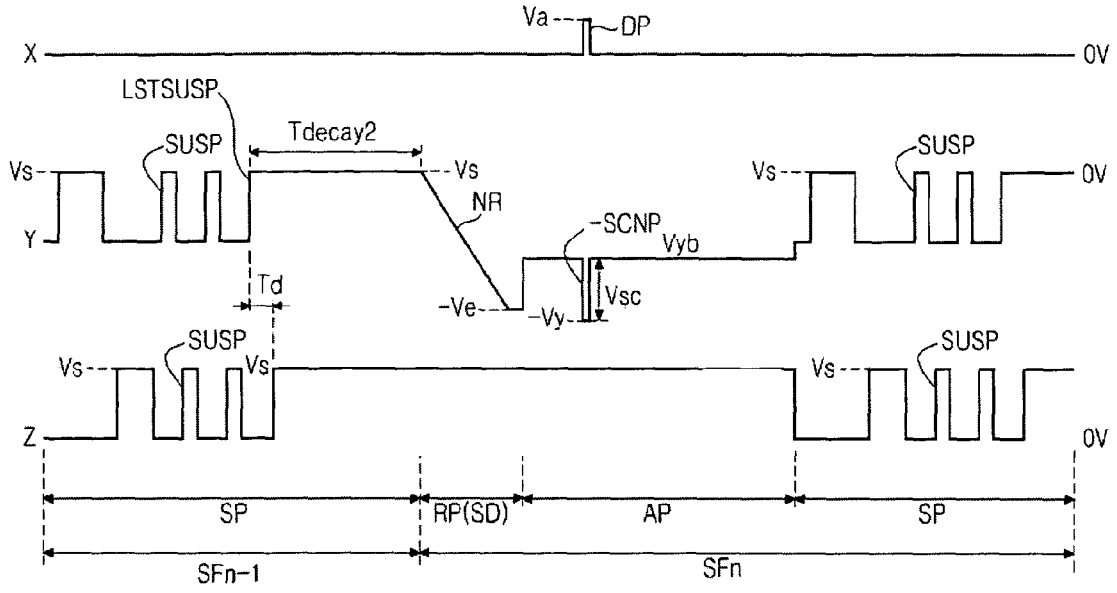
FIG. 10 is a view illustrating a driving wave form of a first sub-field period in a driving method for a plasma display apparatus according to a second embodiment of the present invention.

FIG. 10 is a wave form view illustrating a driving method for a plasma display apparatus according to a second embodiment of the present invention.

The driving wave form of FIG. 10 is applicable to the PDP where the discharge cell can be initialized using only the last sustain discharge of a previous sub-field without a set-up discharge and its subsequent set-down discharge of a next sub-field, that is, to the PDP having a high uniformity and a wide driving margin of the discharge cells.

Referring to FIG. 10, the $(n-1)^{th}$ sub-field (SFn−1) includes a reset period (RP), an address period (AP), and a sustain period (SP). The $n^{th}$ sub-field(SFn) includes a reset period (RP) having only a set-down period without a set-up period, an address period (AP), a sustain period (SP), and an erasure period (EP).

The address period (AP) and the sustain period (SP) are the same as those of the driving wave form of FIG. 3 and the embodiment of FIG. 9 and accordingly, a detailed description thereof is omitted.

In the driving method for the plasma display apparatus according to the second embodiment of the present invention, a spatial charge decay period (Tdecay2) is set in a high-temperature environment to induce a decay of spatial charges between a rising point of the last sustain pulse (LSTSUSP) of the $(n-1)_{th}$ sub-field (SFn−1) and a falling point of a negative ramp wave form (PR) at which the reset period (RP) of the $n_{th}$ sub-field (SFn) begins.

The spatial charge decay period (Tdecay2) is identical with a pulse width of the last sustain pulse, and is set to be longer in the high-temperature environment of 40° C. or more than in a room-temperature environment. The spatial charge decay period (Tdecay2) is in a range of approximately 200 μs to 500 μs in the high-temperature environment. During the spatial charge decay period (Tdecay2), the last sustain pulse (LSTSUSP) of the sustain voltage (Vs) is applied to scan electrodes (Y) and the sustain voltage (Vs) is sustained. After a predetermined time (Td) lapses from the time point at which the last sustain pulse (LSTSUSP) is applied to the scan electrodes (Y), the sustain voltage (Vs) is applied to the sustain electrodes (Z). By such a voltage, negative spatial charges are accumulated on the scan electrodes (Y) and positive spatial charges are accumulated on address electrodes (X) during the spatial charge decay period (Tdecay2). Accordingly, soon after the spatial charge decay period (Tdecay2), each of the discharge cells is initialized with a wall charge distribution similar to a related art set-up discharge result, that is, with a wall charge distribution similar to that of FIG. 4B in which the spatial charges are mostly dissipated at each of the discharge cells.

Next to the spatial charge decay period (Tdecay2), a negative ramp wave form (NR) is applied to the scan electrodes (Y) in the reset period (RP (SD)) of the $n^{th}$ sub-field (SFn). During the reset period (RP(SD)), a positive sustain voltage (Vs) is applied to the sustain electrodes (Z) and 0V is applied to the address electrodes (X). By the negative ramp wave form (NR), the voltage of the scan electrodes (Y) gradually drops from the positive sustain voltage (Vs) to the negative erasure voltage (Ve). By the negative ramp wave form (NR), a dark discharge is generated between the scan electrodes (Y) and the address electrodes (X) within the discharge cells of a whole image and at the same time, a dark discharge is generated between the scan electrodes (Y) and the sustain electrodes (Z). As a result of the dark discharge of the set-down period (SD), the wall charge distribution of each of the discharge cells 1 is changed to have an optimal address condition as in FIG. 4C.

Figure 11:
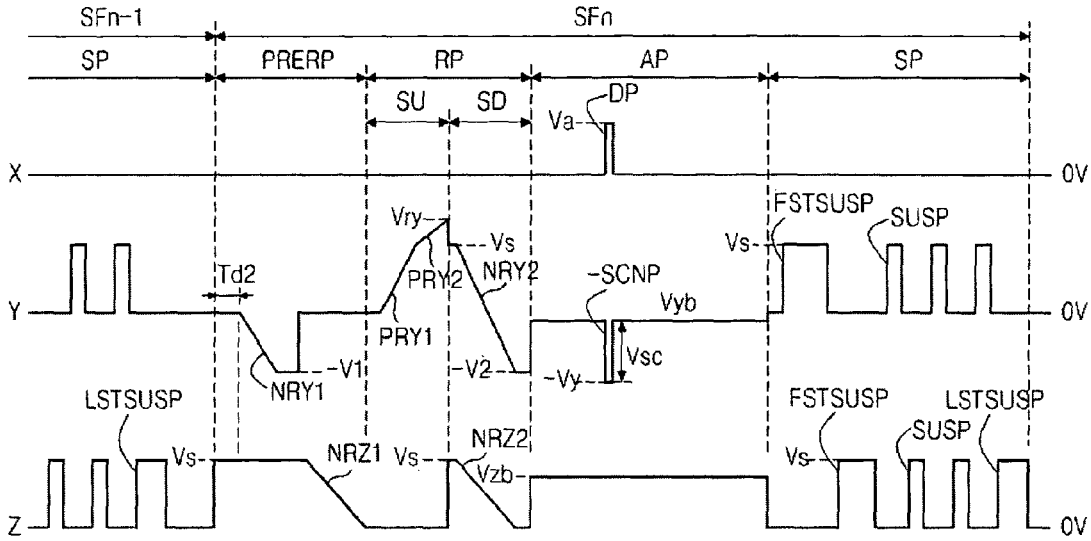
FIG. 11 is a view illustrating a driving wave form of a first sub-field period in a driving method for a plasma display apparatus according to a third embodiment of the present invention.

FIG. 11 is a wave form view illustrating a driving method for a plasma display apparatus according to a third embodiment of the present invention. The driving wave form of FIG. 11 is described with reference to the wall charge distribution of FIGS. 12A to 12E.

In FIG. 11, the plasma display apparatus is driven by dividing at least one sub-field, for example, a first sub-field into a pre-reset period (PRERP), a reset period (RP), an address period (AP), and a sustain period (SP). During the pre-reset period (PRERP), positive wall charges are formed on scan electrodes (Y) and negative wall charges are formed on sustain electrodes (Z). During the reset period (RP), discharge cells of a whole image are initialized using a wall charge distribution, which is formed during the pre-reset period (PRERP). During the sustain period (SP), a discharge of the selected discharge cells is sustained. An erasure period can be included between the sustain period (SP) and the reset period of its next sub-field.

At the pre-reset period (PRERP), a positive sustain voltage (Vs) is applied to all the sustain electrodes (Z). After that, a first Y negative ramp wave form (NRY1), which drops from 0V or a ground voltage to a negative voltage (−V1), is applied to all scan electrodes (Y) when a predetermined time (Td2) lapses. Here, the predetermined time (Td2) can be different depending on a panel characteristic. While a voltage of the sustain electrodes (Z) is sustained, a voltage of the scan electrodes (Y) drops and then a voltage (−V1) is sustained for a predetermined time. During the pre-reset period (PRERP), 0V is applied to the address electrodes (X).

Figure 12A:
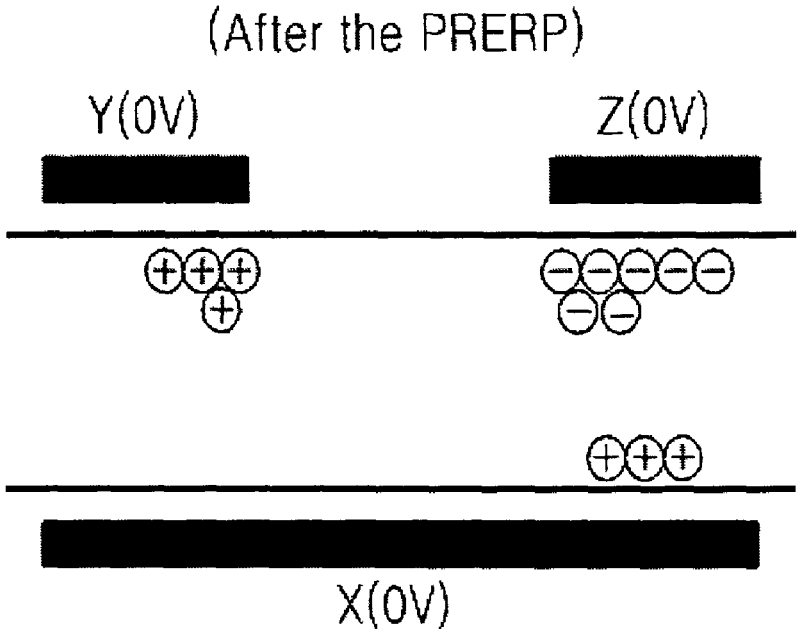
FIGS. 12A to 12E are stepwise views illustrating a wall charge distribution varied by a driving wave form of FIG. 11 in a discharge cell.

During the initial predetermined time (Td2) of the pre-reset period (PRERP), negative spatial charges of the discharge cell are accumulated on the scan electrodes (Y) and changed to the wall charges by a difference between a sustain voltage (Vs) applied to the sustain electrodes (Z) and 0V applied to the scan electrodes (Y). The positive spatial charges of the discharge cell are accumulated on the sustain electrodes (Z) and changed to the wall charges. After the spatial charges are erased, the sustain voltage (Vs) applied to the sustain electrodes (Z) and the first Y negative ramp wave form (NRY1) applied to the scan electrodes (Y) generates a dark discharge between the scan electrodes (Y) and the sustain electrodes (Z)

and between the sustain electrodes (Z) and the address electrodes (X) at the whole discharge cells. As a result of the discharge, soon after the pre-reset period (PRERP), as shown in FIG. 12A, the positive wall charges are accumulated on the scan electrodes (Y) and the negative wall charges are accumulated on the sustain electrodes (Z) in the whole discharge cells. By the wall charge distribution of FIG. 12A, a positive gap voltage is sufficiently large formed between the scan electrodes (Y) and the sustain electrodes (Z) in the whole discharge cells, and an electric field is formed in a direction of from the scan electrode (Y) to the sustain electrode (Z) in each of the discharge cells.

Figure 12B:
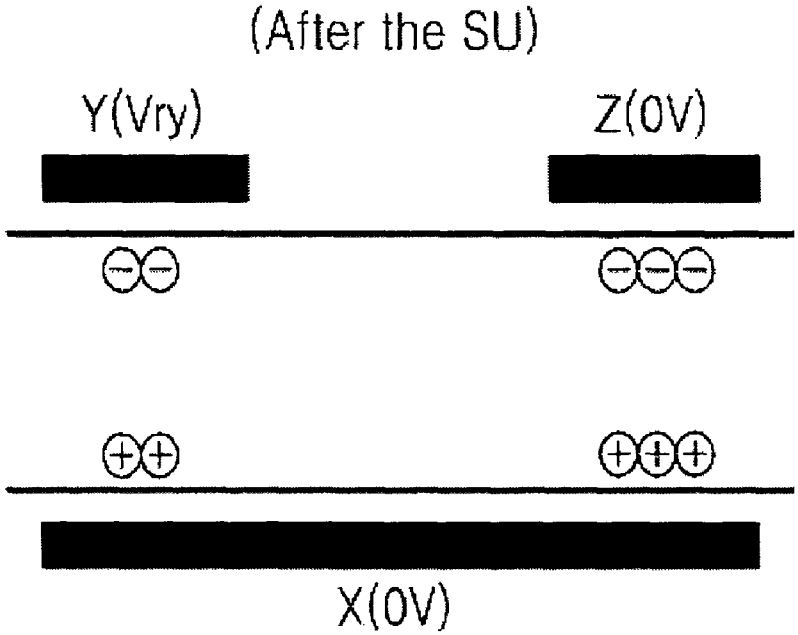

At a set-up period (SU) of the reset period (RP), a first Y positive ramp wave form (PRY1) and a second Y positive ramp wave form (PRY2) are continuously applied to all of the scan electrodes (Y), and 0V is applied to the sustain electrodes (Z) and the address electrodes (X). The first Y positive ramp wave form (PRY1) rises from 0V to the positive sustain voltage (Vs). The second Y positive ramp wave form (PRY2) rises from the positive sustain voltage (Vs) to a positive Y reset voltage (Vry) higher than the positive sustain voltage (Vs). The second Y positive ramp wave form (PRY2) has a smaller slope than the first Y positive ramp wave form (PRY1). Meantime, the first Y positive ramp wave form (PRY1) and the second Y positive ramp wave form can be also set to have the same slope depending on the panel characteristic. While the first Y positive ramp wave form (PRY1) is summed with a voltage of the electric field formed between the scan electrodes (Y) and the sustain electrodes (Z) in the discharge cell, the dark discharge is generated between the scan electrodes (Y) and the sustain electrodes (Z) and between the scan electrodes (Y) and the address electrodes (X) in the whole discharge cells. As a result of the discharge, while the negative wall charges are accumulated on the scan electrodes (Y) in the whole discharge cells soon after the set-up period (SU) as shown in FIG. 12B, the scan electrodes (Y) are negatively inverted in polarity. The positive wall charges are more accumulated on the address electrodes (X). While the negative wall charges are shifted from the sustain electrodes (Z) toward the scan electrodes (Y), they are a little reduced in amount, but the scan electrodes (Y) are negatively sustained.

Meanwhile, before the dark discharge is generated at the set-down period (SU) by the wall charge distribution soon after the pre-reset period (PRERP), the positive gap voltage is sufficiently large in the whole discharge cells. Therefore, a reset voltage (Vr) is lower than a related art reset voltage (Vr) of FIG. 3. Further, during the reset period (PRERP) and the set-up period (SU), the positive wall charges are sufficiently accumulated on the address electrodes (X). Therefore, an absolute value of an external applied voltage necessary for the address discharge, that is, absolute values of a data voltage (Va) and a scan voltage (−Vy) can be reduced.

At the set-down period (SD) of the reset period (RP) following the set-up period (SU), a second Y negative ramp wave form (NRY2) is applied to the scan electrodes (Y) and at the same time, a second Z negative ramp wave form (NRZ2) is applied to the sustain electrodes (Z). The second Y negative ramp wave form (NRY2) drops from the positive sustain voltage (Vs) to a positive voltage (−V2). The second Z negative ramp wave form (NRZ2) drops from the positive sustain voltage (Vs) to 0V or the ground voltage. The voltage (−V2) can be set to be the same as or different from the voltage (−V1) of the pre-reset period (PRERP). During the set-down period (SD), the voltages of the scan electrodes (Y) and the sustain electrodes (Z) concurrently drop. Therefore, the discharge is not generated between the scan electrodes (Y) and the sustain electrodes (Z) whereas the dark discharge is generated between the scan electrodes (Y) and the address electrodes (X). By the dark discharge, excessive negative wall charges are erased from the scan electrodes (Y), and excessive positive wall charges are erased from the address electrodes (X). As a result, the whole discharge cells have a uniform wall charge distribution of FIG. 12C. In the wall charge distribution of FIG. 12C, the negative wall charges are sufficiently accumulated on the scan electrodes and the positive wall charges are sufficiently accumulated on the address electrodes (X). Therefore, the gap voltage between the scan electrodes (Y) and the address electrodes (X) rises closely to a firing voltage (Vf). Accordingly, the wall charge distribution of the whole discharge cells is adjusted to have an optimal address condition soon after the set-down period (SD).

Figure 12C:
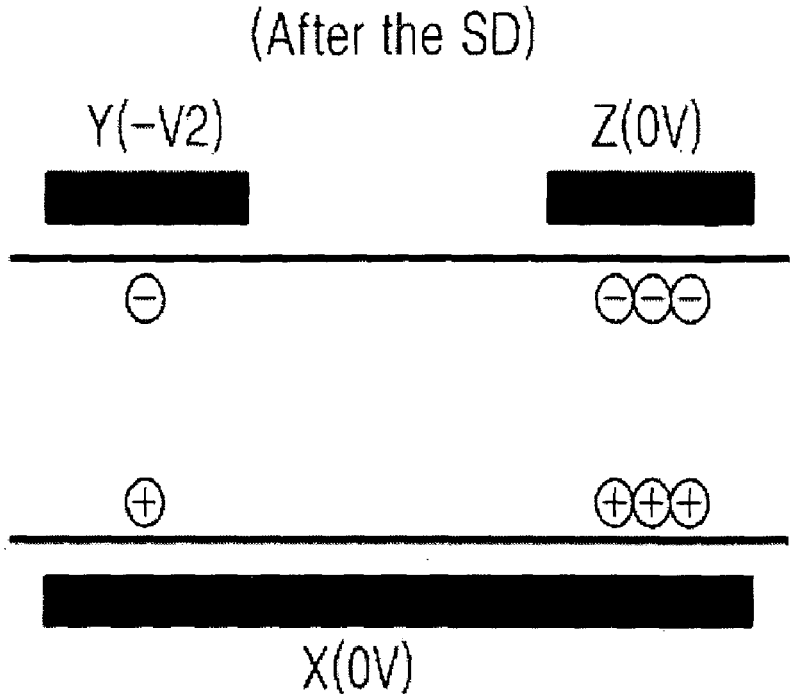
Figure 12D:
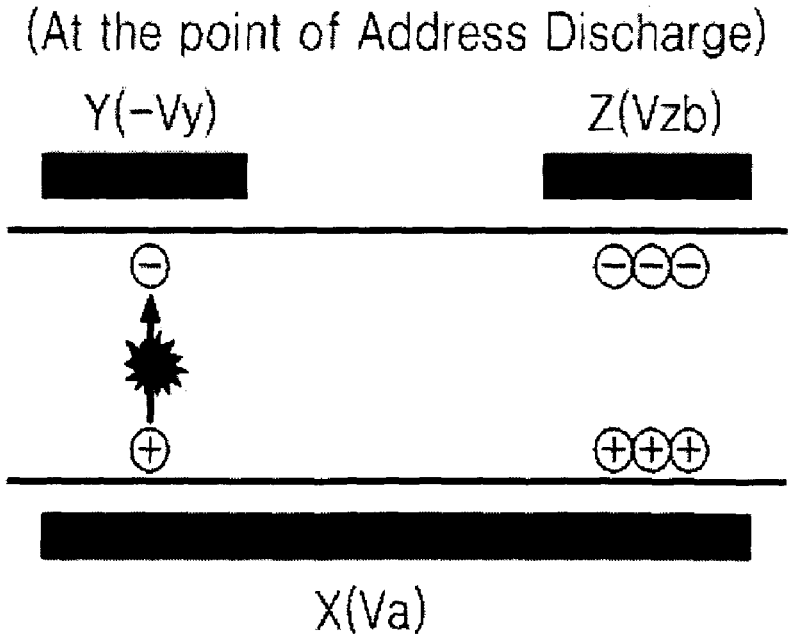
Figure 12E:
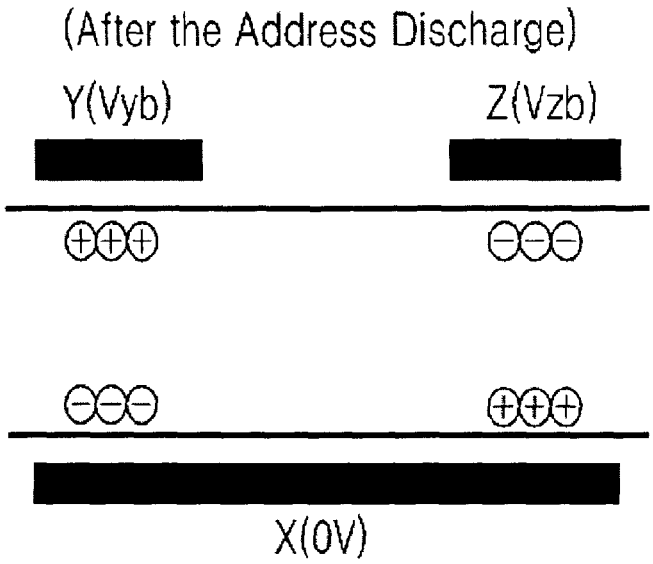

In the address period (AP), a negative scan pulse (−SCNP) is sequentially applied to the scan electrodes (Y) and at the same time, a positive data pulse (DP) is applied to the address electrodes (X) in synchronization with the scan pulse (−SCNP). A voltage of the scan pulse (SCNP) is a scan voltage (Vsc), which drops from 0V or a negative scan bias voltage (Vyb) close thereto to a negative scan voltage (−Vy). During the address period (AP), a positive Z bias voltage (Vzb) lower than the positive sustain voltage (Vs) is applied to the sustain electrodes (Z). In a state where the whole discharge cells have the gap voltage adjusted to the optimal address condition soon after the reset period (RP), the gap voltage between the scan electrodes (Y) and the address electrodes (X) exceeds the firing voltage (Vf) in the on-cells having a scan voltage (Vsc) and a data voltage (Va) applied thereto. If so, the address discharge is generated only between the electrodes (Y and X). The wall charge distribution of the on-cells where the address discharge is generated is shown in FIG. 12D. Soon after the address discharge is generated, the wall charge distribution of the on-cells is changed as shown in FIG. 12E as the positive wall charges are accumulated on the scan electrodes (Y) and the negative wall charges are accumulated on the address electrodes (X) by the address discharge.

Meanwhile, in off-cells where 0V or the ground voltage is applied to the address electrodes (X) or where 0V or the scan bias voltage (Vyb) is applied to the scan electrodes (Y), a gap voltage is less than the firing voltage. Accordingly, in the off-cells where the address discharge is not generated, the wall charge distribution is substantially sustained as shown in FIG. 12C.

In the sustain period (SP), the sustain pulses (FIRSTSUSP, SUSP and LSTSUSP) of the positive sustain voltage (Vs) are alternately applied to the scan electrodes (Y) and the sustain electrodes (Z). During the sustain period (SP), 0V or the ground voltage is applied to the address electrodes (X). The sustain pulse (FSTSUSP) firstly applied to each of the scan electrodes (Y) and the sustain electrodes (Z) is set to have a larger pulse width than a normal sustain pulse (SUSP), thereby stabilizing a sustain discharge initiation. Further, the last sustain pulse (LSTSUSP) is applied to the sustain electrodes (Z). At an initial state of the set-up period (SU), the last sustain pulse (LSTSUSP) is set to have a larger pulse width than the normal sustain pulse (SUSP) to sufficiently accumulate the negative wall charges on the sustain electrodes (Z). During the sustain period, the on-cells selected by the address discharge generate the sustain discharge owing to the wall charge distribution of FIG. 12E, between the scan electrodes (Y) and the sustain electrodes (Z) at each of the sustain pulses (SUSP). To the contrary, in the off-cells, an initial wall charge distribution of the sustain period (SP) is the same as that of FIG. 12C. Therefore, even though the sustain pulses (FIRST- SUSP, SUSP and LSTSUSP) are applied to the off-cells, the gap voltage is sustained to be less than the firing voltage (Vf), thereby not generating the discharge.

In order to reduce an amount of the spatial charges generated in the sustain discharge, each of the sustain pulses (FIRSTSUSP, SUSP and LSTSUSP) is set longer to have a rising period and a falling period of about 340 ns±20 ns.

The driving wave form of FIG. 11 is not limited only to the first sub-field, but is applicable to several initial sub-fields including a first sub-field, and is also applicable to whole sub-fields included in one frame period.

Figure 1:
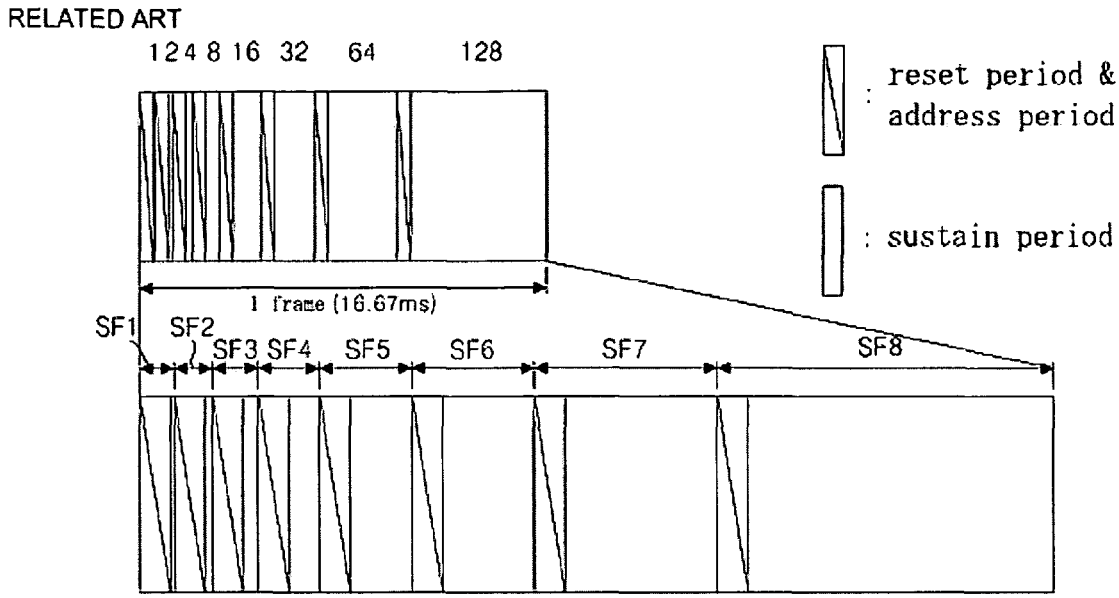
Fig. 1 Related Art
FIG. 1 illustrates a sub-field pattern of an 8-bit default code for embodying 256-grayscale in a plasma display apparatus.
Figure 2:
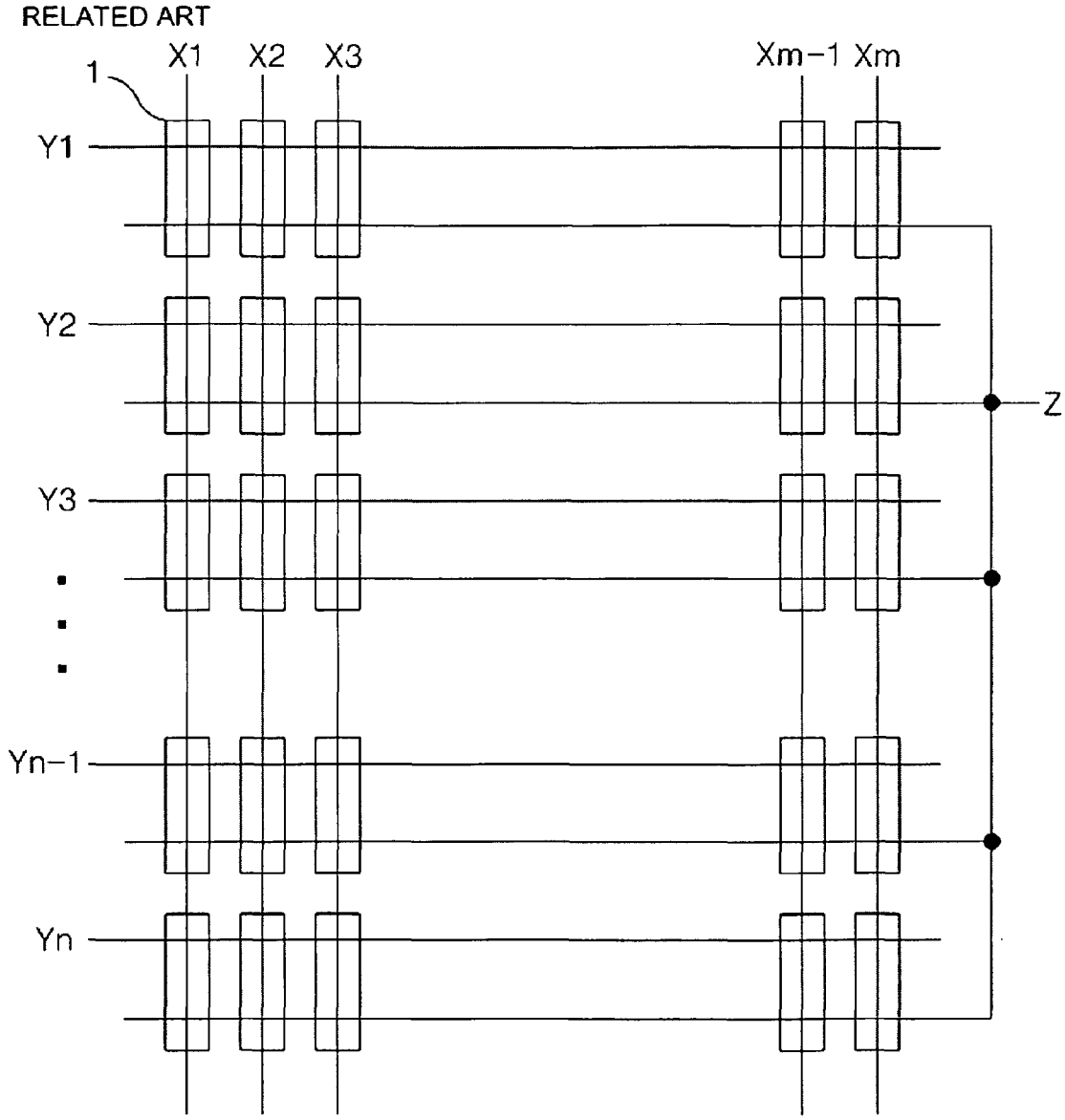
Fig. 2 Related Art
FIG. 2 is a schematic plan view illustrating an electrode arrangement of a three-electrode alternate current surface discharge type plasma display panel.
Figure 13:
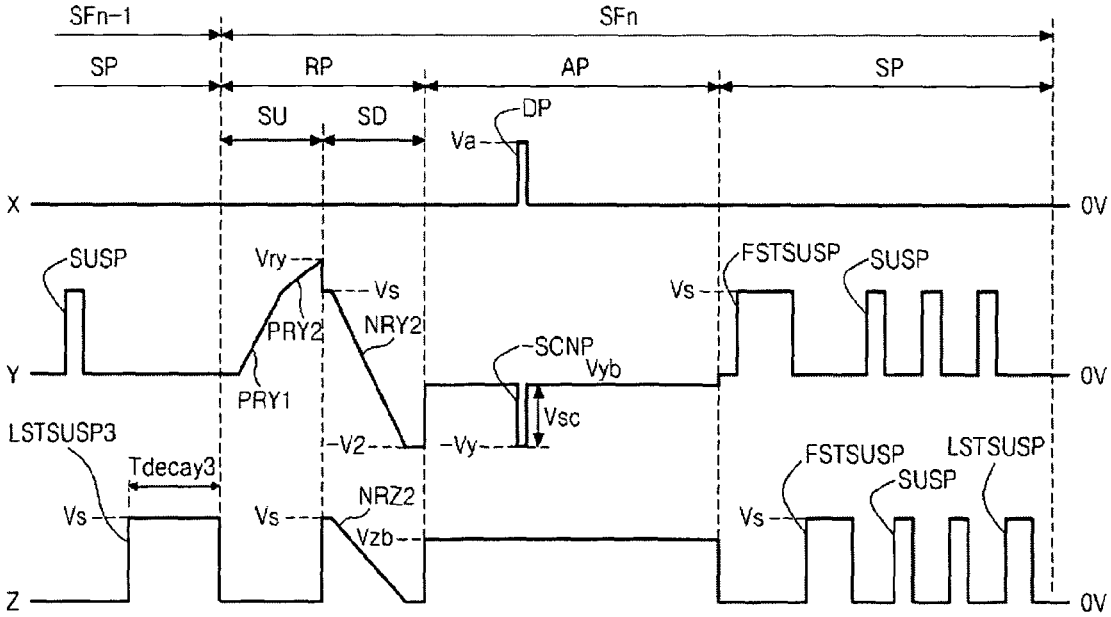
FIG. 13 is a view illustrating a driving wave form of sub-field periods other than a first sub-field period in a driving method for a plasma display apparatus according to a third embodiment of the present invention.

FIG. 13 illustrates a driving wave form, which may be applied to a plasma display panel (PDP) similar to FIG. 2 during a sustain period (SP) of $(n-1)^{th}$ sub-field (SFn−1) and $n^{th}$ sub-field (SFn) in a driving method for a plasma display apparatus according to a third embodiment of the present invention. Here, "n" denotes a positive integer of 2 or more. The driving wave form of FIG. 13 is described with reference to the wall charge distribution of the FIGS. 14 and 15.

In FIG. 13, at the $n^{th}$ sub-field (SFn), whole cells of the PDP are initialized by using the wall charge distribution formed soon after the sustain period at the $(n-1)^{th}$ sub-field (SFn−1), for example, at the first sub-field.

Each of the $(n-1)^{th}$ sub-field (SFn−1) and the $n^{th}$ sub-field (SFn) includes a reset period (RP) for initializing the whole cells owing to the wall charge distribution where negative wall charges are sufficiently accumulated on the sustain electrodes (Z), an address period (AP) for selecting the cell, and a sustain period (SP) for sustaining the discharge of the selected cells.

In the sustain period of the $(n-1)^{th}$ sub-field (SFn−1), the last sustain pulse (LSTSUSP3) is applied to the sustain electrodes (Z). At this time, 0V or a ground voltage is applied to the scan electrodes (Y) and the address electrodes (X). A spatial charge decay period (Tdecay3) corresponding to a pulse width of the last sustain pulse (LSTSUSP3) is set to have enough time for changing spatial charges into wall charges, thereby inducing a sustain discharge in on-cells and also erasing the spatial charges from the discharge cells before the reset period (RP) of the $n^{th}$ sub-field (SFn). For this, the spatial charge decay period (Tdecay3) is set to have about 200 μs to 500 μs, at which the last sustain pulse (LSTSUSP3) is sustained to have a sustain voltage (Vs).

Figure 14:
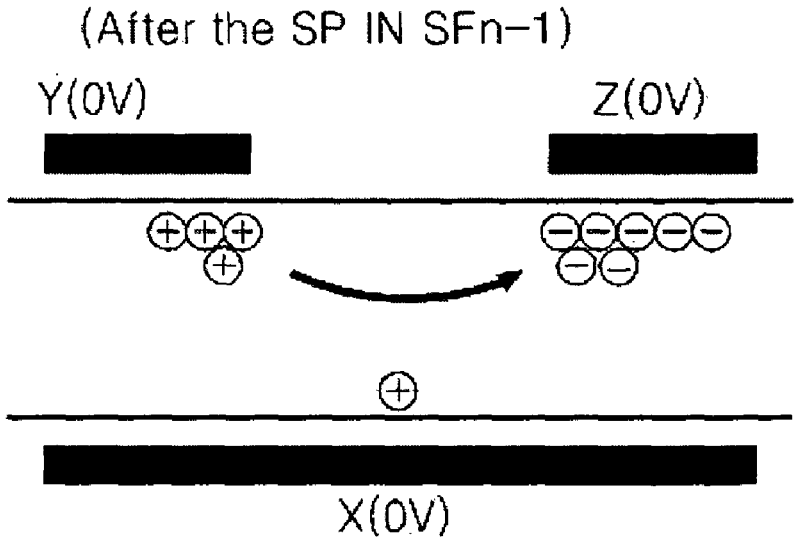
FIG. 14 is a view illustrating a wall charge distribution formed by a driving wave form of FIG. 13 in a discharge cell soon after a sustain period.

By the discharge generated by the last sustain pulse (LSTSUSP3) between the scan electrodes (Y) and the sustain electrodes (Z), positive wall charges are sufficiently accumulated on the scan electrodes (Y) and negative wall charges are accumulated on the sustain electrodes (Z) almost without the spatial charges as shown in FIG. 14.

At a set-up period (SU) of the $n^{th}$ sub-field (SFn), the wall charge distribution of FIG. 14 is used to generate a dark discharge in the whole cells, thereby initializing the whole cells to the wall charge distribution as shown in FIG. 12B. A set-up period (SU) operation, and its subsequent set-down initialization, address and sustain operations are substantially the same as those of the driving wave form of FIG. 11.

In the plasma display apparatus and its driving method according to the third embodiment of the present invention, the spatial charges are changed into the wall charges in a high-temperature environment to stably initialize the wall charge distribution. A set-up period of a next sub-field just follows the last sustain discharge of a previous sub-field, without an erasure period for erasing the wall charges between a sustain period of the previous sub-field and a reset period of the next sub-field. Since the sustain discharge is a strong glow discharge, it can sufficiently accumulate many wall charges on the scan electrodes (Y) and the sustain electrodes (Z), and can stably sustain polarities of the positive wall charges on the scan electrodes (Y) and the negative wall charges on the sustain electrodes (Z).

Figure 15:
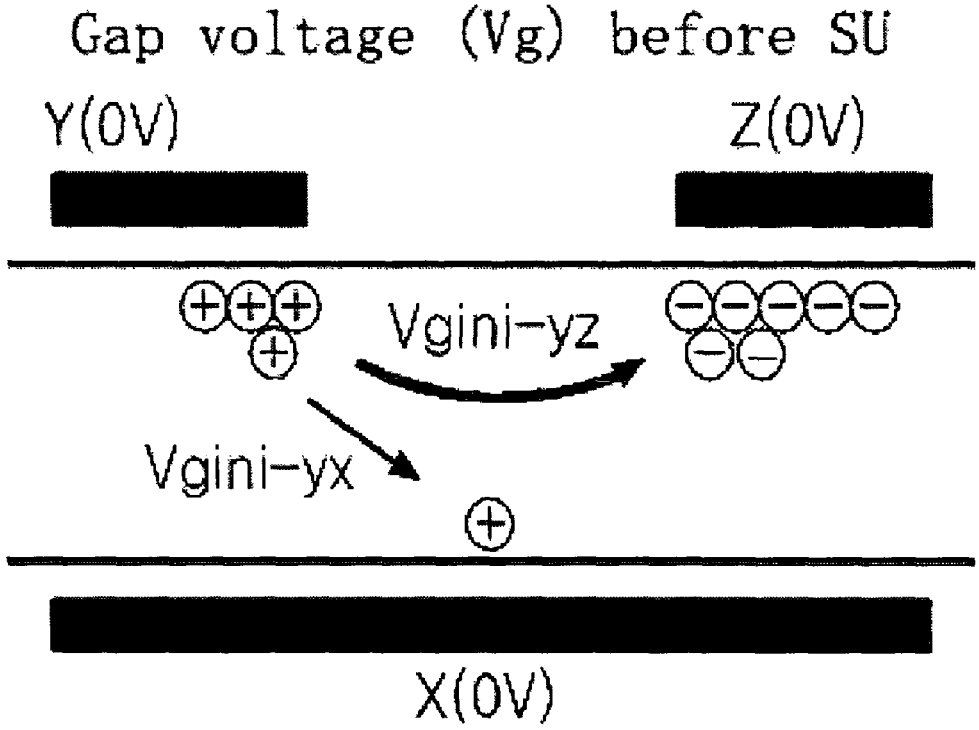
FIG. 15 is a view illustrating a wall charge distribution and a gap voltage in a discharge cell, which are formed by driving wave forms of FIGS. 11 and 13 before a set-up period.

FIG. 15 illustrates a cell gap voltage state, which is formed by the last sustain discharge or the discharge of the pre-reset period (PRERP).

In FIG. 15, a discharge is generated between the scan electrode (Y) and the sustain electrode (Z) by wave forms (NRY1, PRZ and NRZ1) of the last sustain pulse (LSTSUSP) or the pre-reset period (PRERP). Accordingly, just before the set-up period (SU), in the cell, an inter-Y-Z initial gap voltage (Vgini-yz) is formed by an electric field directing from the scan electrode (Y) to the sustain electrode (Z), and an inter-Y-X initial gap voltage (Vgini-yx) is formed by an electric field directing from the scan electrode (Y) to the address electrode (X).

The inter-Y-Z initial gap voltage (Vgini-yz) is already formed in the cell by the wall charge distribution of FIG. 15 before the set-up period (SU). Therefore, if an external voltage is applied by a difference between the firing voltage (Vf) and the inter-Y-Z initial gap voltage (Vgini-yz), the dark discharge is generated in the discharge cells during the set-up period (SU). This is expressed as in the following Equation 5:

$$Vyz = Vf - (Vgini\text{-}yz) \quad \text{[Equation 5]}$$

where Vyz: external voltage (Hereinafter, referred to as "inter-Y-Z external voltage) applied to the scan electrodes (Y) and the sustain electrodes (Z) during the set-up period (SU). "Vyz" denotes a voltage of positive ramp wave form (PRY1, PRY2) applied to the scan electrodes, and 0V applied to sustain electrodes (Z) in the driving wave forms of FIGS. 11 and 13.

Figure 16:
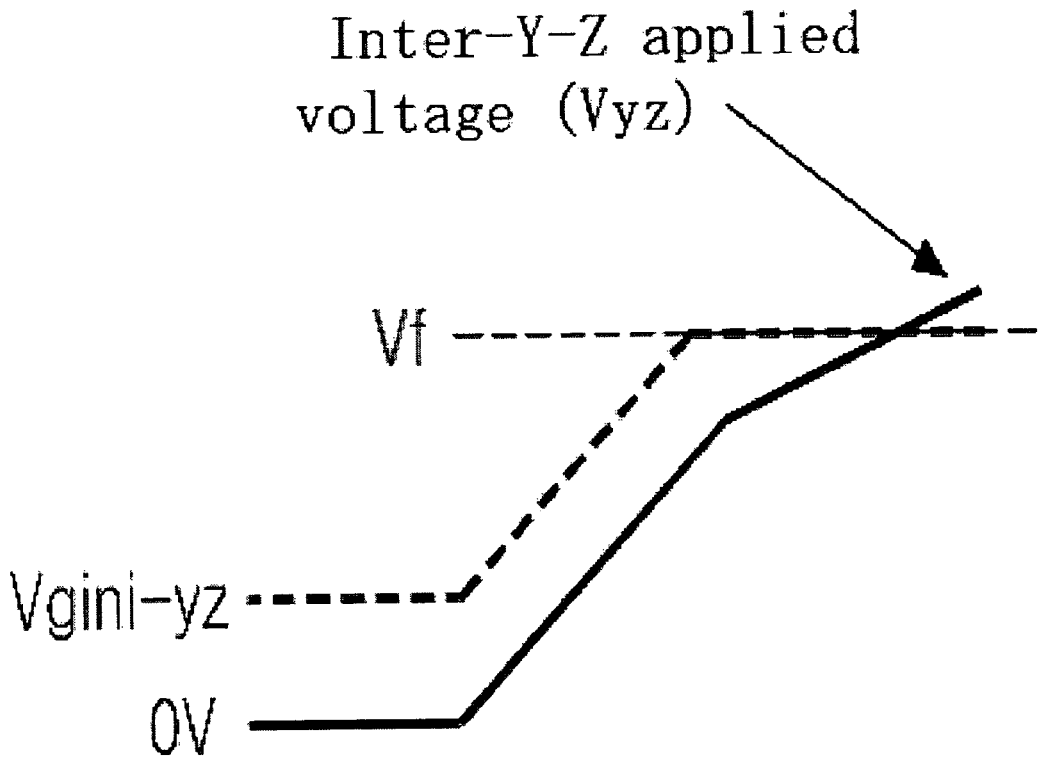
FIG. 16 is a view illustrating variations of an external voltage applied between a scan electrode and a sustain electrode and a gap voltage of a discharge cell at a set-up period when a plasma display apparatus is driven by driving wave forms of FIGS. 11 and 13.

As known in Equation 5 and FIG. 16, if the inter-Y-Z external voltage (Vyz) is sufficiently increased during the set-up period (SU) to be more than the difference between the firing voltage (Vf) and the inter-Y-Z initial gap voltage (Vgini-yz), the dark discharge can be stably generated in the discharge cells due to a wide driving margin.

In the plasma display apparatus according to the third embodiment of the present invention, an amount of light emission generated during the reset period at each of the sub-fields is very small in comparison to the related art. This is because the number of discharge times, specifically, the number of surface discharge times, which is performed in the cell during the reset period of each of the sub-fields, is less than those of the related art.

In Table 2, arranged are a discharge type and the number of discharge times, which are performed at the pre-reset period (PRERP) and the reset period (RP) of the first sub-field described in the driving wave form view of FIG. 11. In Table 3, arranged are a discharge type and the number of discharge times, which are performed in the reset period (RP) of each of remaining sub-fields not having the pre-reset period (PRERP) described in the driving wave form view of FIG. 13.

TABLE 2

| | Oper. period | | |
|---|---|---|---|
| | | RP | |
| Cell state | PRERP | SU | SD |
| Opposite discharge (Y-X) | ○ | ○ | ○ |
| Surface discharge (Y-Z or Z-X) | ○ | ○ | X |

TABLE 3

| Cell state | | Oper. period RP of SFn | |
|---|---|---|---|
| | | SU | SD |
| On-cell turned on at SFn-1 | Opposite discharge (Y-X) | ○ | X |
| | Surface discharge (Y-Z) | ○ | ○ |
| Off-cell turned off at SFn-1 | Opposite discharge (Y-X) | X | ○ |
| | Surface discharge (Y-Z) | X | X |

As shown in the Table 2, in the driving wave form of the first sub-field of FIG. 11, three times of opposite discharge and two times of surface discharge are performed to the maximum during the pre-reset period (PRERP) and the reset period (RP). At its subsequent sub-fields, as shown in the Table 3, one time of opposite discharge and two times of surface discharge to the maximum are performed during the reset period (RP), and only one time of opposite discharge is performed in the off-cell turned off at the previous sub-field. In the plasma display apparatus according to the third embodiment of the present invention, when one frame period is divided into twelve sub-fields, a black image luminance is decreased to one third or less due to the differences of the numbers of discharge times and the discharge types, in comparison to a related art plasma display apparatus. Accordingly, the inventive plasma display apparatus can display the black image having a lower darkroom contrast value than the related art and therefore, can display an image with more definition.

Figure 17:
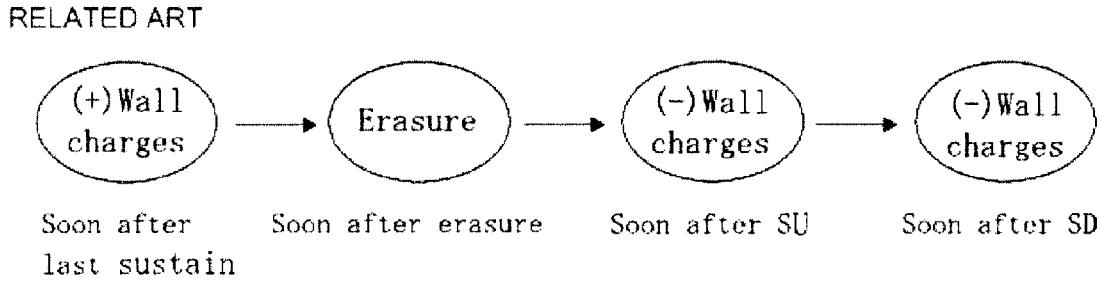
Fig. 17 Related Art
FIG. 17 is a view illustrating a wall charge polarity variation, which is caused by a conventional driving wave form of FIG. 3 on a sustain electrode during an erasure period and a reset period.
Figure 18:
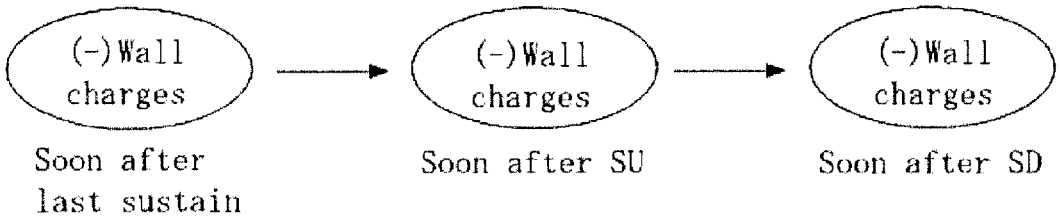
FIG. 18 is a view illustrating a wall charge polarity variation, which is caused by driving wave forms of FIGS. 11 and 13 on a sustain electrode during a reset period.

In a case in which the number of discharge times is less in the reset period (RP), it is meant that the wall charge variance or the polarity variance is less in the discharge cell. For example, as shown in FIG. 17, in the related art plasma display apparatus, the wall charges of the sustain electrodes (Z) are changed in polarity from soon after the last sustain discharge of the $(n-1)^{th}$ sub-field (SFn−1) to soon after the dark discharge of the set-down period (SD) of the $n^{th}$ sub-field (SFn), in a sequence of positive polarity, erasure & negative polarity (FIG. 4A), positive polarity (FIG. 4B) and negative polarity (FIG. 4C). Compared to this, as shown in FIG. 18, in the inventive plasma display apparatus, the wall charges of the sustain electrodes (Z) are sustained to have a negative polarity from soon after the last sustain discharge of the $(n-1)^{th}$ sub-field (SFn−1) to soon after the dark discharge of the set-down period (SD) of the $n^{th}$ sub-field (SFn). In other words, as shown in FIGS. 12A, 12B and 14, in the inventive plasma display apparatus, while the wall charges of the sustain electrodes (X) are constantly sustained to have the negative polarity in an initialization process, the address period (AP) begins.

Figure 19:
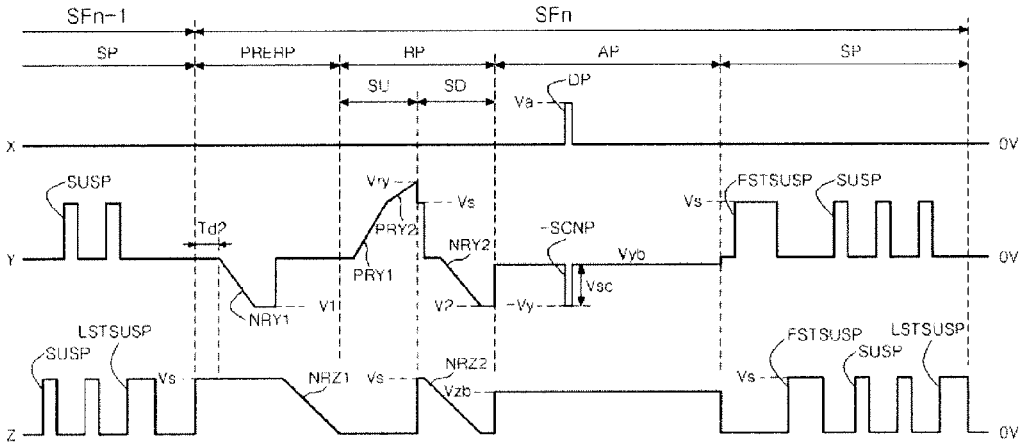
FIG. 19 is a view illustrating a driving wave form of a first sub-field period in a driving method for a plasma display apparatus according to a fourth embodiment of the present invention.
Figure 20:
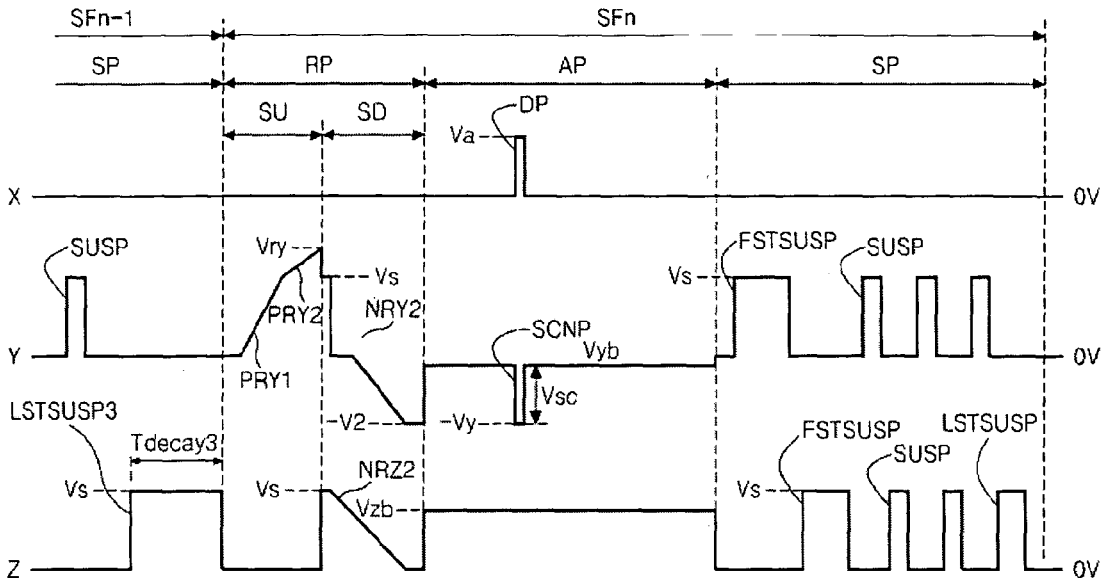
FIG. 20 is a view illustrating a driving wave form of sub-field periods other than a first sub-field period in a driving method for a plasma display apparatus according to a fourth embodiment of the present invention.

FIG. 19 illustrates a driving wave form of a first sub-field period in a driving method for a plasma display apparatus according to a fourth embodiment of the present invention, and FIG. 20 illustrates a driving wave form of sub-field periods other than the first sub-field period in the driving method for the plasma display apparatus according to a fourth embodiment of the present invention. Here, "n" denotes a positive integer of 2 or more.

Referring to FIGS. 19 and 20, in the inventive driving method for the plasma display apparatus, a voltage falling from 0V or a ground voltage (GND) is applied to scan electrodes (Y) during a set-down period (SD) at each sub-field to regularize a wall charge distribution of whole discharge cells initialized at a set-up period (SU).

A first sub-field includes a pre-reset period (PRERP), a reset period (RP), an address period (AP) and a sustain period (SP) as shown in FIG. 19. Other sub-fields (SFn) include a reset period (RP), an address period (AP) and a sustain period (SP) as shown in FIG. 20.

In order to change spatial charges into wall charges to thereby erase the spatial charges and also form a wall charge distribution of FIG. 12A in each of the discharge cells during the pre-reset period (PRERP) of the first sub-field, a first Y negative ramp wave form (NRY1), which drops from 0V or a ground voltage (GND) to a negative voltage (−V1), is applied to all scan electrodes (Y) from when a predetermined time (Td2) lapses after the applying of a positive sustain voltage (Vs) to all of sustain electrodes (Z).

The last sustain pulse (LSTSUSP3), which is applied to the sustain electrodes (Z) before the reset period (RP) of the $n^{th}$ sub-field excepting the first sub-field, sustains the positive sustain voltage (Vs) during a spatial charge decay period (Tdecay3) of about 200 μs to 500 μs. During the spatial charge decay period (Tdecay3), the spatial charges are changed into the wall charges and erased. At the set-down period (SD) of the reset period (RP) of each of the sub-fields (SFn−1 and SFn), a second Y negative ramp wave form (NRY2) is applied to the scan electrodes and at the same time, a second Z negative ramp wave form (NRZ2) is applied to the sustain electrodes (Z). The second Y negative ramp wave form (NRY2) drops from 0V or the ground voltage (GND) to a negative voltage (−V2) unlike the above embodiments. The second Z negative ramp wave form (NRZ2) drops from a positive sustain voltage (Vs) to 0V or the ground voltage. During the set-down period (SD), voltages of the scan electrodes (Y) and the sustain electrodes (Z) concurrently drop. Therefore, a discharge is not generated between the scan electrodes (Y) and the sustain electrodes (Z) whereas a dark discharge is generated between the scan electrodes (Y) and the address electrodes (X). By the dark discharge, excessive negative wall charges are erased from the scan electrodes (Y) and excessive positive wall charges are erased from the address electrodes (X). Meanwhile, the second Z negative ramp wave form (NRZ2) can be also omitted.

If the second Y negative ramp wave form (NRY2) drops from 0V or the ground voltage, the set-down period (SD) is shortened in comparison to the above embodiments. Further, even though the second Y negative ramp wave form (NRY2) drops from 0V or the ground voltage, a voltage difference between the scan electrodes (Y) and the sustain electrodes (Z) is less. Therefore, the inventive plasma display apparatus can more effectively suppress the discharge between the scan electrodes (Y) and the sustain electrodes (Z) while more stably performing an initialization. Accordingly, in this embodiment, due to the reduction of the set-down period (SD), a driving time can be more secured and an initialization operation of the set-down period (SD) is performed more stably.

In order to reduce an amount of the spatial charges generated in the sustain discharge, each of the sustain pulses (FIRSTSUSP, SUSP, LSTSUSP) is comparatively lengthened to have a rising period and a falling period of approximately 340 ns±20 ns.

Figure 21:
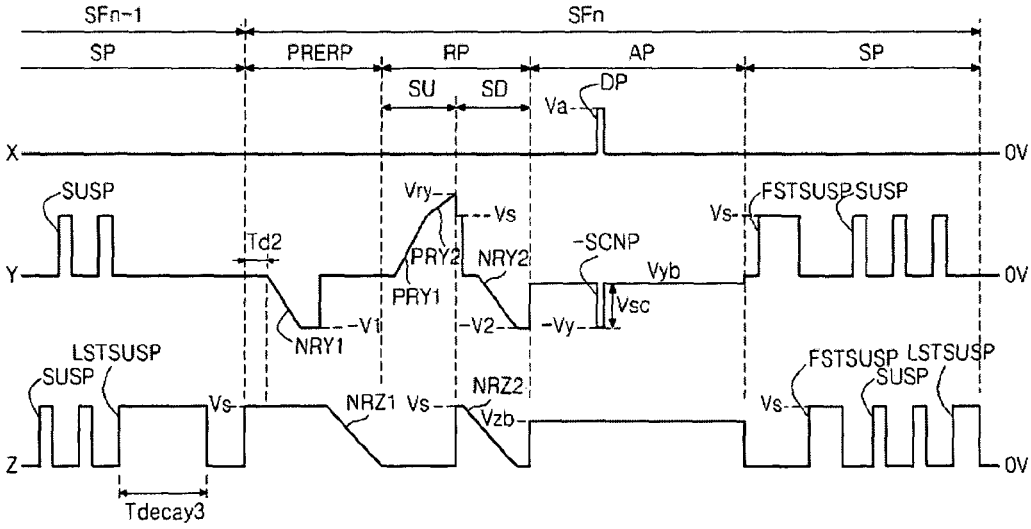
FIG. 21 is a wave form view illustrating a driving method for a plasma display apparatus according to a fifth embodiment of the present invention.

FIG. 21 is a driving wave form view illustrating a driving method for a plasma display apparatus according to a fifth embodiment of the present invention. The driving wave form is applied to a high-temperature environment.

Referring to FIG. 21, in the inventive driving method for the plasma display apparatus, during the latter period of $(n-1)^{th}$ sub-field (SFn−1), the last sustain pulse (LSTSUSP), which sustains a positive sustain voltage during a spatial charge decay period (Tdecay3) of about 200 μs to 500 μs, is applied to sustain electrodes (Z). After that, 0V or a ground voltage (GND) is applied to sustain electrodes (Z).

In the inventive driving method for the plasma display apparatus, a positive sustain voltage (Vs) is applied to all of the sustain electrodes (Z). After that, a first Y negative ramp wave form (NRY1), which drops from 0V or the ground voltage (GND) to a negative voltage (−V1), is applied to all scan electrodes (Y) from when a predetermined time (Td2) lapses. Accordingly, when the sustain electrodes (Z) is sustained to a sustain voltage (Vs), a first Y negative ramp wave form (NRY1) is applied to the scan electrodes (Y). After that, in the inventive driving method for the plasma display apparatus, 0V or the ground voltage (GND) is applied to the scan electrodes (Y). After that, a first Z negative ramp wave form (NRZ1), which gradually drops from the sustain voltage (Vs) to 0V or the ground voltage (GND), is applied to the sustain electrodes.

In order to reduce an amount of the spatial charges generated in the sustain discharge, each of the sustain pulses (FIRSTSUSP, SUSP, LSTSUSP) is comparatively lengthened to have a rising period and a falling period of approximately 340 ns±20 ns.

The spatial charges, which are generated in the high-temperature environment by a series of driving wave forms, are almost erased or changed into the wall charges before the $n^{th}$ sub-field (SFn). Each of the discharge cells is initialized due to a wall charge distribution of FIG. 12A.

Figure 22:
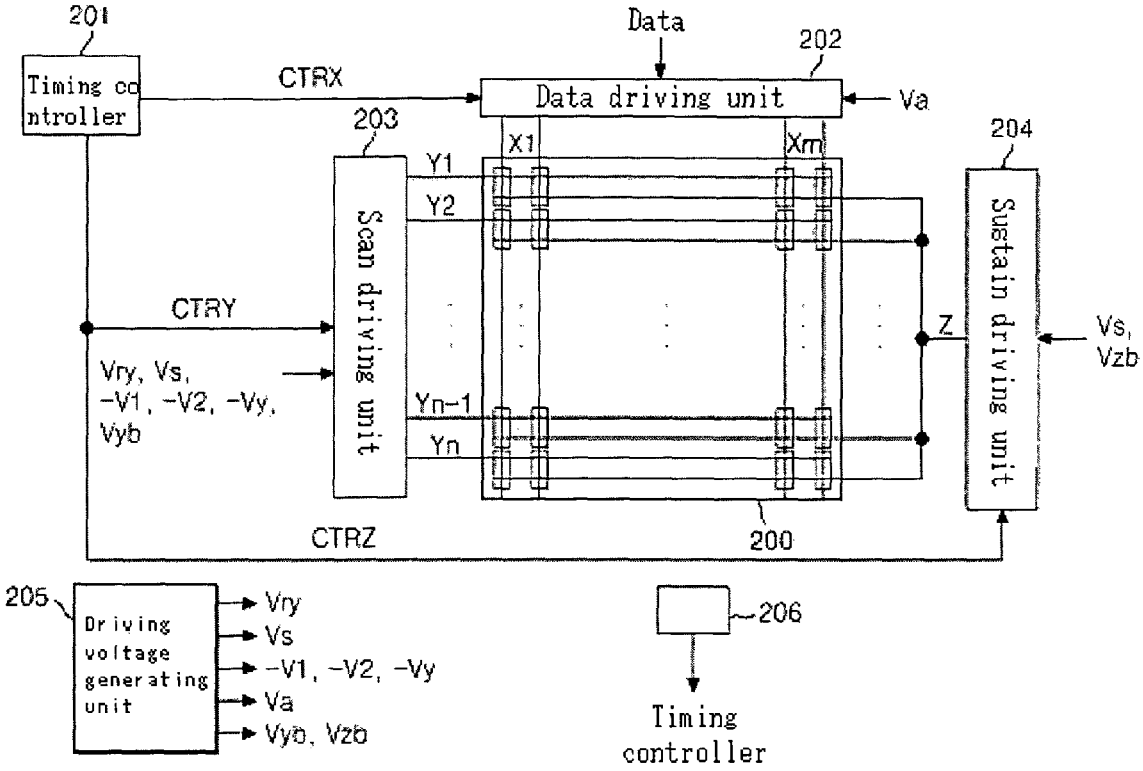
FIG. 22 is a block diagram illustrating a plasma display apparatus according to an embodiment of the present invention.

FIG. 22 is a block diagram illustrating the plasma display apparatus according to an embodiment of the present invention.

Referring to FIG. 22, the inventive plasma display apparatus includes a plasma display panel (PDP) 200; a temperature sensor 206 for sensing a temperature of the PDP 200; a data driving unit 202 for supplying data to address electrodes (X1 to Xm) of the PDP 200; a scan driving unit 203 for driving scan electrodes (Y1 to Yn) of the PDP 200; a sustain driving unit 204 for driving the sustain electrodes (Z) of the PDP 200; a timing controller 201 for controlling each of the driving units 202, 203 and 204 depending on the temperature of the PDP 200; and a driving voltage generating unit 205 for generating a driving voltage necessary for each of the driving units 202, 203 and 204.

The temperature sensor 206 senses the temperature of the PDP to generate a sense voltage, and converts the sense voltage into a digital signal to supply the digital signal to the timing controller 201.

After data is inverse gamma corrected and erroneous diffused through an inverse gamma correction circuit (not shown) and an error diffusion circuit (not shown), the data is mapped to a predetermined sub-field pattern by a sub-field mapping circuit and supplied to the data driving unit 202. As shown in FIGS. 9, 10, 11, 13, 19, 20 and 21, the data driving unit 202 applies 0V or the ground voltage to the address electrodes (X1 to Xm) at the pre-reset period (PRERP), the reset period (RP) and the sustain period (SP). After the data driving unit 202 samples and latches the data during the address period (AP) of each sub-field under the control of the timing controller 201, it supplies the data to the address electrodes (X1 to Xm).

As shown in FIGS. 7, 8, 9, 11, 17, 18 and 19, the scan driving unit 203 supplies the ramp wave forms (NRY1, PRY1, PRY2, NRY2) to the scan electrodes (Y1 to Yn) so as to initialize the whole discharge cells at the pre-reset period (PRERP) and the reset period (RP) under the control of the timing controller 201. After that, the scan driving unit 203 sequentially supplies the scan pulse (SCNP) to the scan electrodes (Y1 to Yn) so as to select the scan line to which the data is supplied during the address period (AP). When the PDP has a high temperature, the scan driving unit 203 supplies the sustain pulses (FSTSUSP and SUSP) having the rising period and the falling period of about 340 ns±20 ns to the scan electrodes (Y1 to Yn), so as to generate the sustain discharge in the selected on-cells in the sustain period (SP).

As shown in FIGS. 8, 10, 16 to 22, the sustain driving unit 204 supplies the ramp wave forms (NRZ1 and NRZ2) to the sustain electrodes (Z) so as to initialize the whole discharge cells at the pre-reset period (PRERP) and the reset period (RP) under the control of the timing controller 201. After that, the sustain driving unit 204 supplies the Z bias voltage (Vzb) to the sustain electrodes (Z) in the address period (AP). The sustain driving unit 204 is operated alternately with the scan driving unit 203 in the sustain period (SP) to supply the sustain pulses (FSTSUSP, SUSP, LSTSUSP) to the sustain electrodes (Z). When the PDP has the high temperature, the last sustain pulse (LSTSUSP) generated at the sustain driving unit 204 is lengthened to have the pulse width of 200 μs to 500 μs. Each of the sustain pulses (FSTSUSP, SUSP, LSTSUSP) has the rising period and the falling period of approximately 340 ns±20 ns.

The timing controller 201 receives vertical/horizontal synchronous signals and a clock signal to generate timing control signals (CTRX, CTRY, CTRZ) necessary for each of the driving units 202, 203 and 204. The timing controller 201 supplies the timing control signals (CTRX, CTRY, CTRZ) to the corresponding driving units 202, 203 and 204 to control each of the driving units 202, 203 and 204. The timing control signal (CTRX) supplied to the data driving unit 202 includes a sampling clock for sampling data, a latch control signal, and a switch control signal for controlling an on/off time of an energy recovery circuit and a driving switch element. The timing control signal (CTRY) applied to the scan driving unit 203 includes a switching control signal for controlling an on/off time of an energy recovery circuit and a driving switch element of the scan driving unit 203. The timing control signal (CTRZ) applied to the sustain driving unit 204 includes a switch control signal for controlling an on/off time of an energy recovery circuit and a driving switch element of the sustain driving unit 204.

When the PDP 200 has the high temperature, the timing controller 201 receives an output voltage from the temperature sensor 206 to control the scan driving unit 203 and the sustain driving unit 204, thereby lengthening the pulse width of the last sustain pulse (LSTSUSP) to a degree of 200 μs to 500 μs, and control the scan driving unit 203 and the sustain driving unit 204 to allow each of the sustain pulses (FSTSUSP, SUSP, LSTSUSP) to have the rising period and the falling period of approximately 340 ns±20 ns. Further, the timing controller 201 controls the scan driving unit 203 and the sustain driving unit 204 to supply the positive sustain voltage (Vs) to the sustain electrodes (Z) prior to the first Y negative ramp wave form (NRY1).

The driving voltage generating unit 205 generates the driving voltages, that is, the voltages (Vry, Vs, −V1, −V2, −Vy, Va, Vyb, Vzb) supplied to the PDP 200 as shown in FIGS. 8, 10 and 16 to 22. The driving voltages can be varied depending on a discharge feature or a discharge gas composition, which are different depending on a resolution and a model of the PDP 200.

In the above, the plasma display apparatus and its driving method have been in detail described for the object for stabilizing the discharge in the high-temperature environment according to the present invention.

Hereinafter, the plasma display apparatus and its driving method will be in detail described for another advantage of reducing an influence of the lower substrate wall charges in the sustain discharge.

Figure 23:
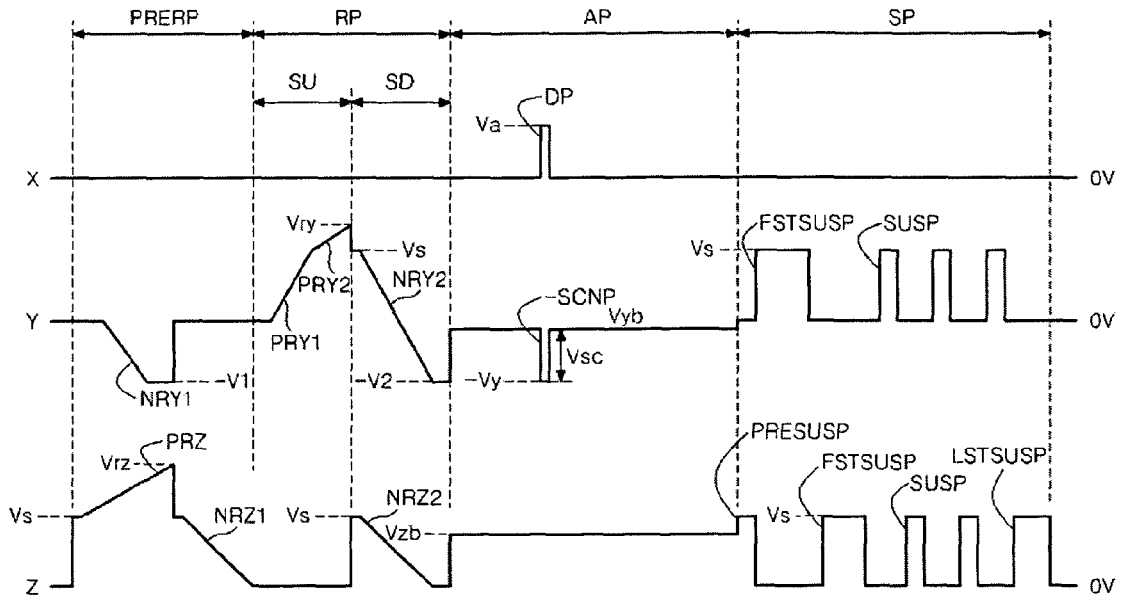
FIG. 23 is a view illustrating a driving wave form of a first sub-field period in a driving method for a plasma display apparatus according to a sixth embodiment of the present invention.
Figure 24:
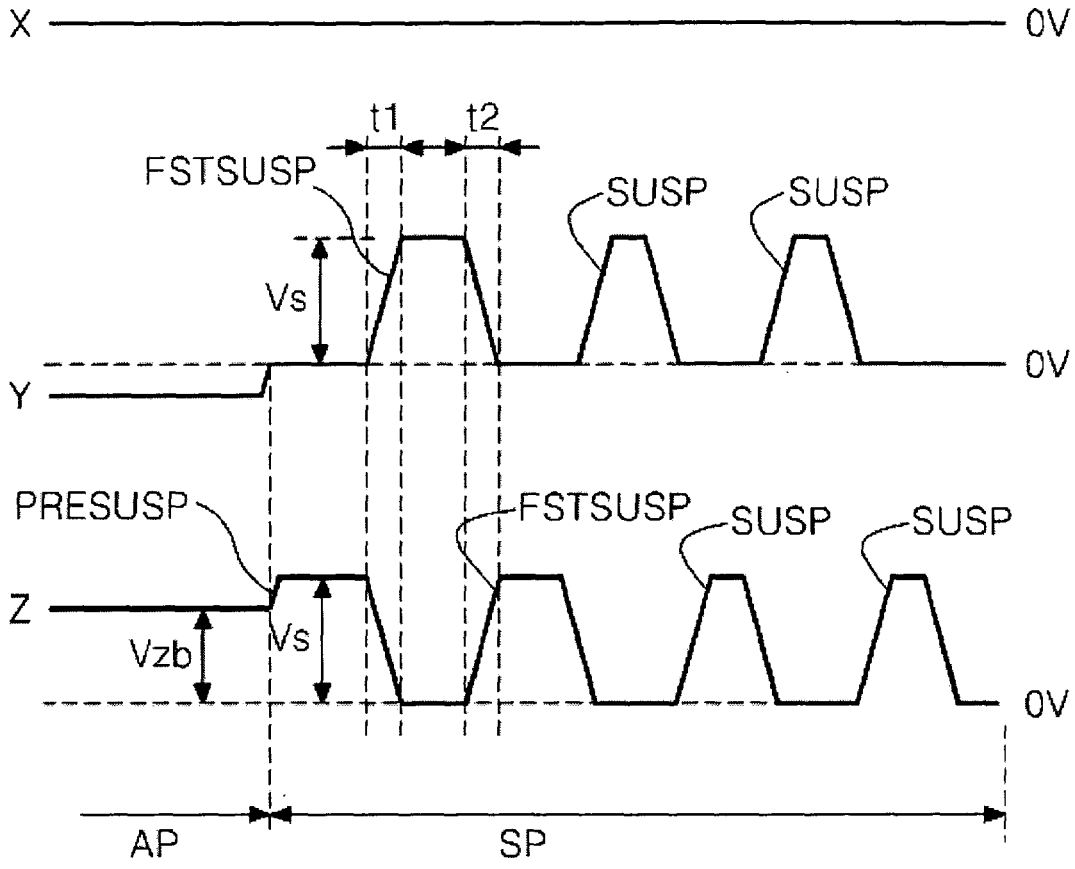
FIG. 24 is an enlarged view illustrating a driving wave form of FIG. 23, which is applied to each of electrodes during a boundary period between an address period and a sustain period.

FIGS. 23 and 24 illustrate driving wave forms supplied to the PDP of FIG. 2 during a first sub-field period in a driving method for a plasma display apparatus according to a sixth embodiment of the present invention. The driving wave forms of FIGS. 23 and 24 are described with reference to a wall charge distribution of FIGS. 25A to 25F.

Referring to FIGS. 23 and 24, in the inventive driving method for the plasma display apparatus, the first sub-field includes a pre-reset period (PRERP), a reset period (RP), an address period (AP), and a sustain period (SP). During the pre-reset period (PRERP), positive wall charges are formed on scan electrodes (Y) and negative wall charges are formed on sustain electrodes (Z). During the reset period (RP), discharge cells of a whole image are initialized using the wall charge distribution, which is formed during the pre-reset period (PRERP). During the address period (AP), the discharge cells are selected. During the sustain period (SP), the discharge of the selected discharge cells is sustained.

Figure 25A:
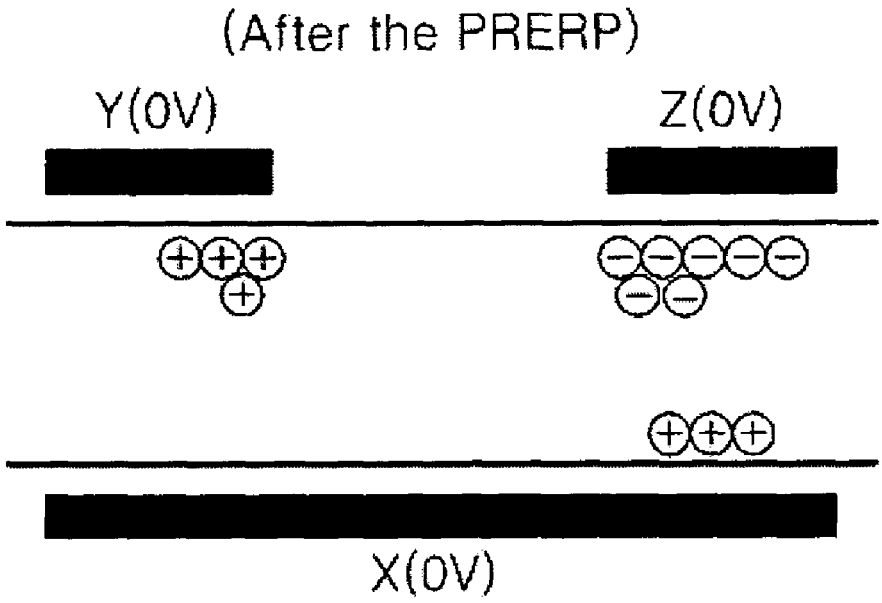
FIGS. 25A to 25F are stepwise views illustrating a wall charge distribution varied by a driving wave form of FIG. 23 in a discharge cell.

At the pre-reset period (PRERP), a Z positive ramp wave form (PRZ) rising from a positive sustain voltage (Vs) to a positive Z reset voltage (Vrz) is applied to all of sustain electrodes (Z), and a first Y negative ramp wave form (NRY1) falling from 0V or a ground voltage (GND) to a negative voltage (−V1) is applied to all of scan electrodes (Y). While a voltage of the sustain electrodes (Z) rises by the positive ramp wave form (PRZ), a voltage of the scan electrodes (Y) rises by the first Y negative ramp wave form (NRY1) and then, a voltage (V1) is sustained for a predetermined time. During the pre-reset period (PRERP), 0V is applied to the address electrodes (X). The Z positive ramp wave form (PRZ) and the first Y negative ramp wave form (NRY1) generate a dark discharge between the scan electrodes (Y) and the sustain electrodes (Z) and between the sustain electrodes (Z) and the address electrodes (X) in whole discharge cells. As a result of the discharge, soon after the pre-reset period (PRERP), as shown in FIG. 25A, the positive wall charges are accumulated on the scan electrodes (Y) and a large amount of the negative wall charges are accumulated on the sustain electrodes (Z) in the whole discharge cells. Additionally, the positive wall charges are accumulated on the address electrodes (X). By the wall charge distribution of FIG. 25A, a sufficiently large positive gap voltage is formed between the scan electrodes (Y) and the sustain electrodes (Z) in an internal discharge gas space of the whole discharge cells, and an electric field is formed from the scan electrodes (Y) toward the sustain electrodes (Z) in each of the discharge cell.

Figure 25B:
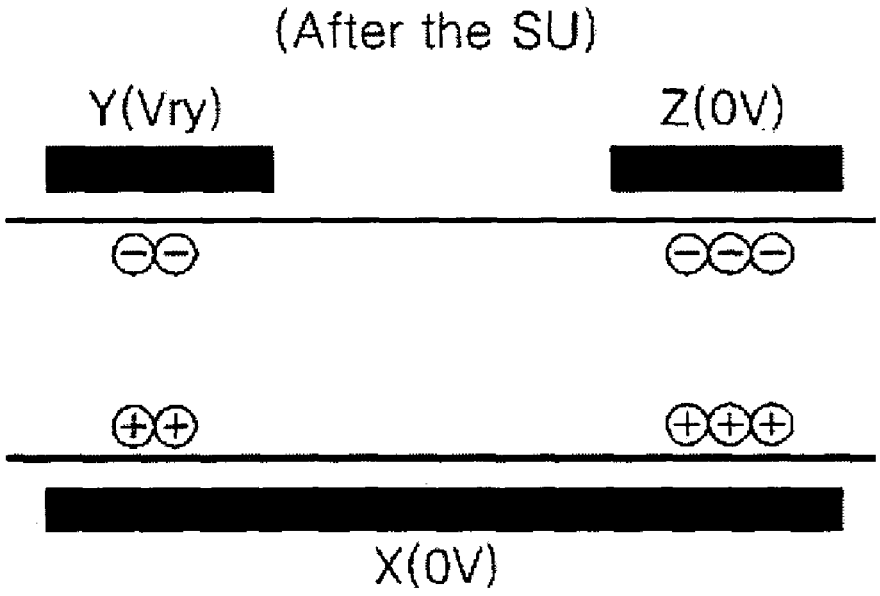

At a set-up period (SU) of the reset period (RP), a first Y positive ramp wave form (PRY1) and a second Y positive ramp wave form (PRY2) are continuously applied to all of the scan electrodes (Y), and 0V is applied to the sustain electrodes (Z) and the address electrodes (X). The first Y positive ramp wave form (PRY1) rises from 0V to a positive sustain voltage (Vs), and the second Y positive ramp wave form (PRY2) rises from the positive sustain voltage (Vs) to a positive Y reset voltage (Vry) higher than the positive sustain voltage (Vs). The positive Y reset voltage (Vry) is less than the positive Z reset voltage (Vrz). The positive Y reset voltage (Vry) is determined as a voltage between the positive Z reset voltage (Vrz) and the positive sustain voltage (Vs). The second Y positive ramp wave form (PRY2) has a lower slope than the first Y positive ramp wave form (PRY1). The first Y positive ramp wave form (PRY1) and the second Y positive ramp wave form (PRY2) can be also set to have the same slope. While the first Y positive ramp wave form (PRY1) is summed with a voltage of the electric field formed between the scan electrodes (Y) and the sustain electrodes (Z) in the discharge cell, the dark discharge is generated between the scan electrodes (Y) and the sustain electrodes (Z) and between the scan electrodes (Y) and the address electrodes (X) in the whole discharge cells. As a result of the discharge, in the whole discharge cells soon after the set-up period (SU), as shown in FIG. 25B, the negative wall charges are accumulated on the scan electrodes (Y) to negatively invert the scan electrodes (Y) in polarity, and the positive wall charges are more accumulated on the address electrodes (X). Additionally, the negative wall charges accumulated on the sustain electrodes (Z) are directed toward the scan electrodes (Y) and are a little reduced in amount, but their negative polarities are sustained.

Meanwhile, before the dark discharge is generated at the set-down period (SU) by the wall charge distribution soon after the pre-reset period (PRERP), a positive gap voltage is sufficiently large in the whole discharge cells. Therefore, the Y reset-voltage (Vr) can be lower than a related art reset voltage (Vr) of FIG. 3. In an experiment result where all discharge cells is initialized using the wall charge distribution as in FIG. 25A just before the set-up discharge, it was confirmed that the set-up discharge is generated at the sustain voltage (Vs) or less in all the discharge cells. Therefore, the second Y positive wave form (PRY2) may be unnecessary in the driving wave forms of FIGS. 23 and 24. Even though the voltage applied to the scan electrodes (Y) rises only to the sustain voltage (Vs) by the first Y positive ramp wave form (PRY1) at the set-up period (SU), the set-up discharge can be stably generated in all of the discharge cells.

During the pre-reset period (PRERP) and the set-up period (SU), the positive wall charges are sufficiently accumulated on the address electrodes (X). Therefore, an absolute value of an external applied voltage necessary for the address discharge, that is, absolute values of a data voltage and a scan voltage can be lowered.

Figure 25C:
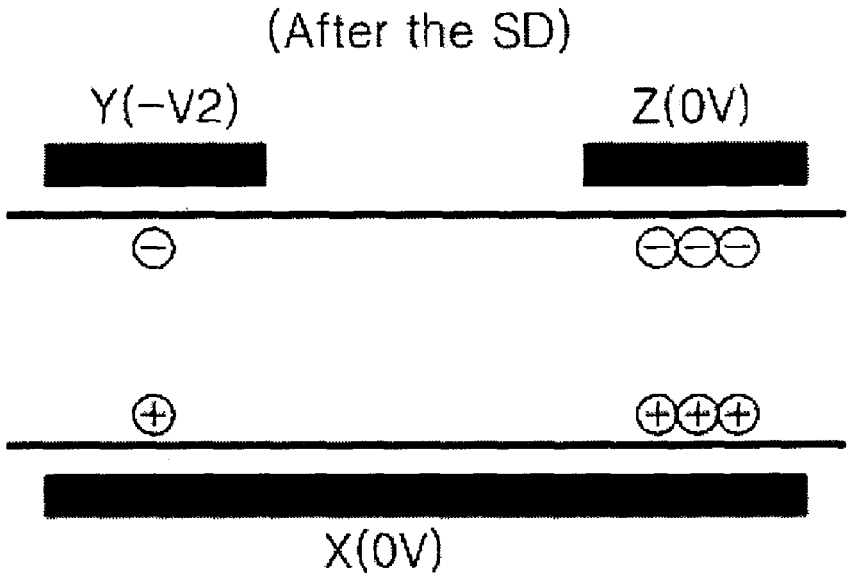

At the set-down period (SD) of the reset period (RP) following the set-up period (SU), the second Y positive ramp wave form (NRY2) is applied to the scan electrodes (Y) and at the same time, the second Z negative ramp wave form (NRZ2) is applied to the sustain electrodes (Z). The second Y negative ramp wave form (NRY2) drops from the positive sustain voltage (Vs) to a negative voltage (−V2). The second Z negative ramp wave form (NRZ2) drops from the sustain voltage (Vs) to 0V or the ground voltage. The voltage (−V2) can be set to be the same as or different from the voltage (−V1). During the set-down period (SD), the voltages of the scan electrodes (Y) and the sustain electrodes (Z) concurrently drop. Therefore, the discharge is not generated between the scan electrodes (Y) and the sustain electrodes (Z) whereas the dark discharge is generated between the scan electrodes (Y) and the address electrodes (X). By the dark discharge,-excessive negative wall charges are erased from the scan electrodes (Y), and excessive positive wall charges are erased from the address electrodes (X). As a result, the whole discharge cells have a uniform wall charge distribution as shown in FIG. 25C. In the wall discharge distribution of FIG. 25C, the negative wall charges are sufficiently accumulated on the scan electrodes (Y) and the positive wall charges are sufficiently accumulated on the address electrodes (X). Therefore, the gap voltage between the scan addresses (Y) and the address electrodes (X) rises closely to the firing voltage (Vf). Accordingly, the wall charge distribution of the whole discharge cells is adjusted to an optimal address condition soon after the set-down period (SD).

Figure 25D:
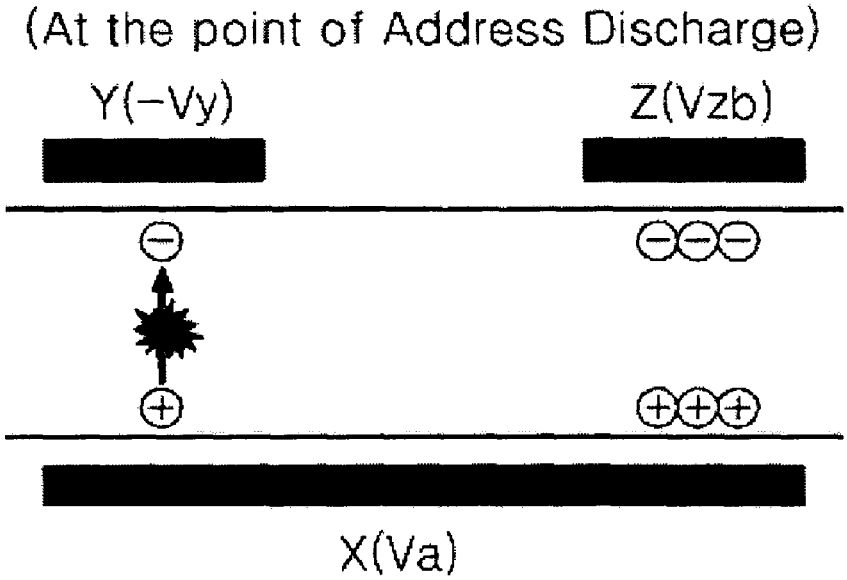
Figure 25E:
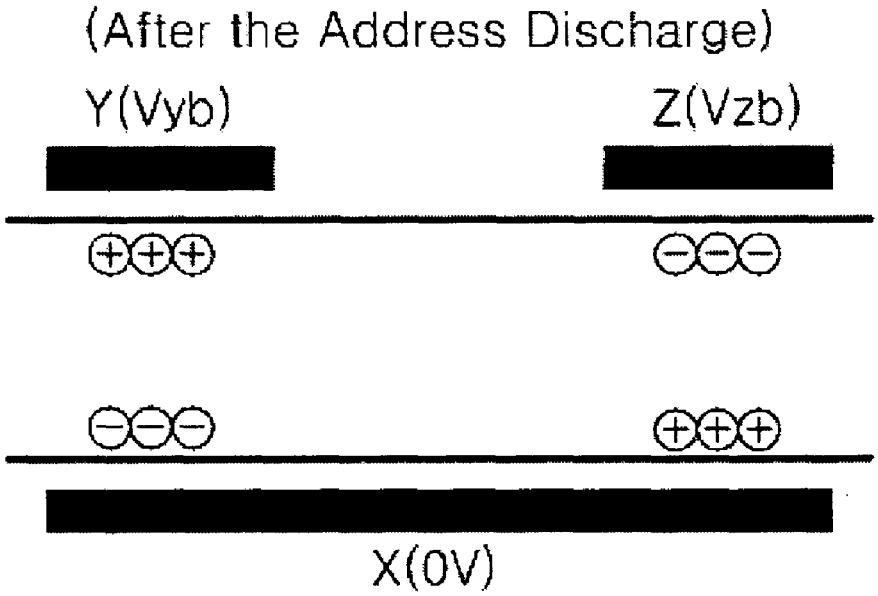

In the address period (AP), a negative scan pulse (−SCNP) is sequentially applied to the scan electrodes (Y) and at the same time, a positive data pulse (DP) is applied to the address electrodes (X) in synchronization with the scan pulse (−SCNP). A voltage of the scan pulse (−SCNP) is a scan voltage (Vsc) falling from 0V or a negative scan bias voltage (Vyb) close thereto to a negative scan voltage (−Vy). A voltage of the data pulse (DP) is a positive data voltage (Va). During the address period (AP), the positive Z bias voltage (Vzb) lower than the positive sustain voltage (Vs) is supplied to the sustain electrodes (Z). In a state where the gap voltage is adjusted to the optimal address condition in the whole discharge cells soon after the reset period (RP), the gap voltage between the scan electrode (Y) and the address electrode (X) exceeds the firing voltage (Vf) in the on-cells having the scan voltage (Vsc) and the data voltage (Va) applied thereto. If so, the address discharge is generated only between the electrodes (Y and X). The wall charge distribution of the on-cells where the address discharge is generated is shown in FIG. 25D. Soon after the address discharge is generated, the wall charge distribution of the on-cells is changed as in FIG. 25E as the address discharge causes the positive wall charges to be accumulated on the scan electrodes (Y) and the negative wall charges to be accumulated on the address electrodes (X).

The address discharge is generated only between the scan electrode (Y) and the address electrode (X) as shown in FIG. 25D and therefore, a time necessary for the address discharge is greatly reduced.

In the off-cells where 0V or the ground voltage is applied to the address electrodes (X) or where 0V or the scan bias voltage (Vyb) is applied to the scan electrodes (Y), the gap voltage is less than the firing voltage. Accordingly, in the off-cells not generating the address discharge, the wall charge distribution is substantially sustained to a state of FIG. 25C.

At an initiation time point of the sustain period (SP), the ground voltage (GND) or 0V is applied to the scan electrodes (Y). At the same time, the pre sustain pulse (PRESUSP) of the positive sustain voltage (Vs) is applied to the sustain electrodes (Z), and the ground voltage (GND) or 0V is supplied to the address electrodes (X). In other words, at the initiation time point of the sustain period (SP), the voltage of the scan electrodes (Y) rises from the negative scan bias voltage (Vyb) to the ground voltage (GND) or 0V. At the same time, the voltage of the sustain electrodes (Z) rises from the positive Z bias voltage (Vzb) to the positive sustain voltage (Vs). When the pre sustain pulse (PRESUSP) is supplied to the sustain electrodes (Z), the gap voltage between the scan electrodes (Y) and the sustain electrodes (Z) is less than the firing voltage by the wall discharge distribution in the discharge cell. Accordingly, when the pre sustain pulse (PRESUSP) is supplied to the sustain electrodes (Z), the discharge is not generated in the on-cells.

Figure 25F:
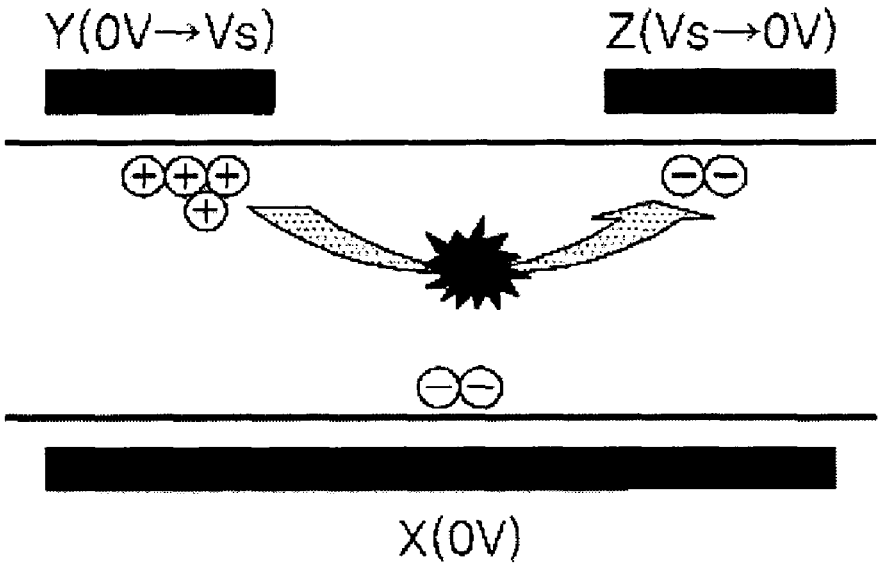

Next to the pre sustain pulse (PRESUSP), a first sustain pulse (FST SUSP) is supplied to the scan electrodes and at the same time, the ground voltage (GND) or 0V is supplied to the sustain electrodes (Z). In other words, during a first period (t1) at which the voltage of the scan electrodes (Y) varies from the ground voltage (GND) or 0V to the positive sustain voltage (Vs), the voltage of the sustain electrodes (Z) is varied from the positive sustain voltage (Vs) to the ground voltage (GND) or 0V. Accordingly, in comparison to the related art where the positive sustain voltage (Vs) is supplied to the scan electrodes (Y) in a state where the voltage of the sustain electrodes (Z) is sustained to 0V, the present invention can raise the voltage of the scan electrodes (Y) to the positive sustain voltage (Vs) and at the same time, drops the voltage of the sustain electrodes (Z) to the ground voltage (GND) or 0V, thereby more increasing the gap voltage between the scan electrodes (Y) and the sustain electrodes (Z). Accordingly, when the sustain discharge is generated in the on-cells by the first sustain pulse (FSTSUSP), the sustain discharge is mainly generated as shown in FIG. 25F owing to the wall charge distribution of FIG. 10E, between the scan electrodes (Y) and the sustain electrodes (Z) in the selected on-cells without almost any influence of the wall charges of the lower substrate. During a period (t2) at which the first sustain pulse (FSTSUSP) drops to the ground voltage (GND) or 0V, the voltage of the sustain electrodes (Z) rises from the ground voltage (GND) or 0V to the positive sustain voltage (Vs) by the first sustain pulse (FSTSUSP). Next to the first sustain pulse (FSTSUSP), the sustain pulses (SUSP, LSTSUSP) supplied alternately to the scan electrodes (Y) and the sustain electrodes (Z) are not superposed with each other.

During the sustain period (SP), 0V or the ground voltage is supplied to the address electrodes (X). The sustain pulse (FSTSUSP) first applied to each of the scan electrodes (Y) and the sustain electrodes (Z) is set to have a larger pulse width than a normal sustain pulse (SUSP), thereby stably initiating the sustain discharge. The last sustain pulse (LSTSUSP) is applied to the sustain electrodes (Z). At an initial state of the set-up period (SU), the last sustain pulse (LSTSUSP) is set to have a larger pulse width than the normal sustain pulse (SUSP) to sufficiently accumulate the negative wall charges on the sustain electrodes (Z). In the on-cells, the discharge is performed between the scan electrodes (Y) and the sustain electrodes (Z) at each of the sustain pulses (FSTSUSP, SUSP, LSTSUSP). In contrast, in the off-cells, an initial wall charge distribution of the sustain period (SP) is the same as that of FIG. 25C. Therefore, even though the sustain pulses (FIRSTSUSP, SUSP, LSTSUSP) are applied, the gap voltage is sustained to a low voltage less than the firing voltage (Vf), thereby not generating the discharge.

The driving wave forms of FIGS. 23 and 24 are not limited only to the first sub-field, but is applicable to several initial sub-fields including the first sub-field and is also applicable to whole sub-fields included in one frame period.

Figure 26:
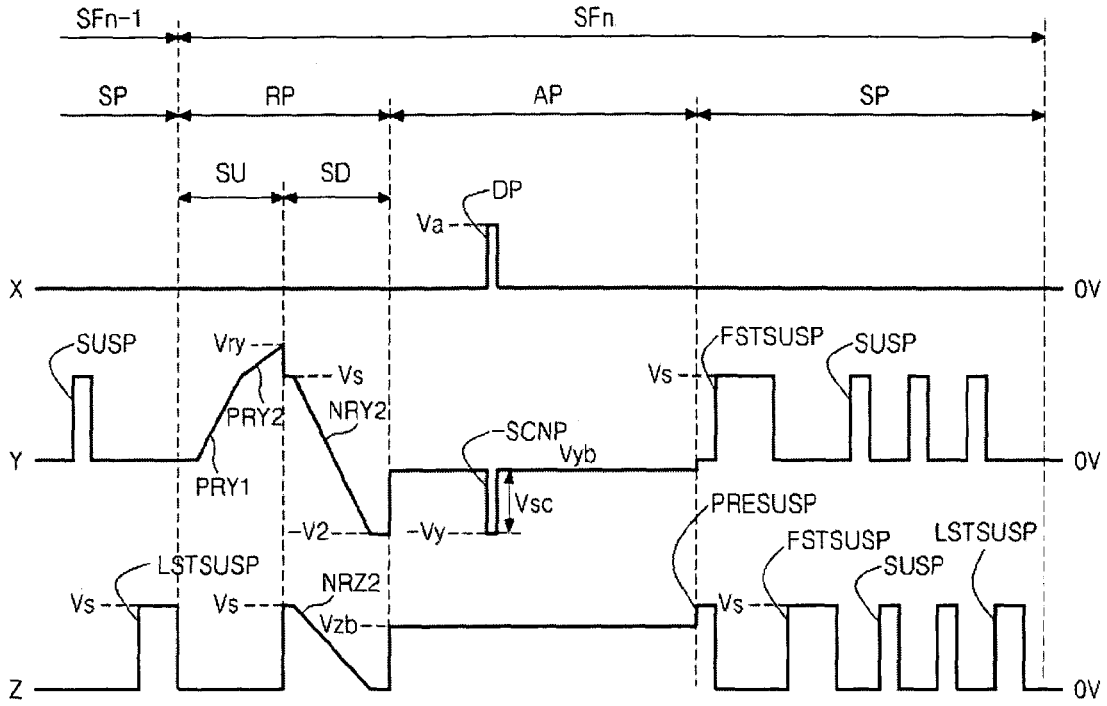
FIG. 26 is a view illustrating a driving wave form of sub-field periods other than a first sub-field period in a driving method for a plasma display apparatus according to a sixth embodiment of the present invention.

FIG. 26 illustrates a driving wave form, which is supplied to the PDP of FIG. 2 during a sustain period (SP) of $(n-1)^{th}$ sub-field (SFn−1) and $n^{th}$ sub-field (SFn) in a driving method for a plasma display apparatus according to a sixth embodiment of the present invention. Here, "n" denotes a positive integer of 2 or more. The driving wave form of FIG. 26 will be described with reference to the wall charge distribution of FIG. 27.

Referring to FIG. 26, whole discharge cells of the PDP are initialized at the $n^{th}$ sub-field (SFn) by using the wall charge distribution, which is formed soon after the sustain period at the $(n-1)^{th}$ sub-field (SFn−1).

Each of the $(n-1)^{th}$ sub-field (SFn−1) and the $n^{th}$ sub-field (SFn) includes a reset period (RP) for initializing the whole cells owing to the wall charge distribution where negative wall charges are sufficiently accumulated on the sustain electrodes (Z), an address period (AP) for selecting the cell and a sustain period (SP) for sustaining the discharge of the selected cells.

Figure 27:
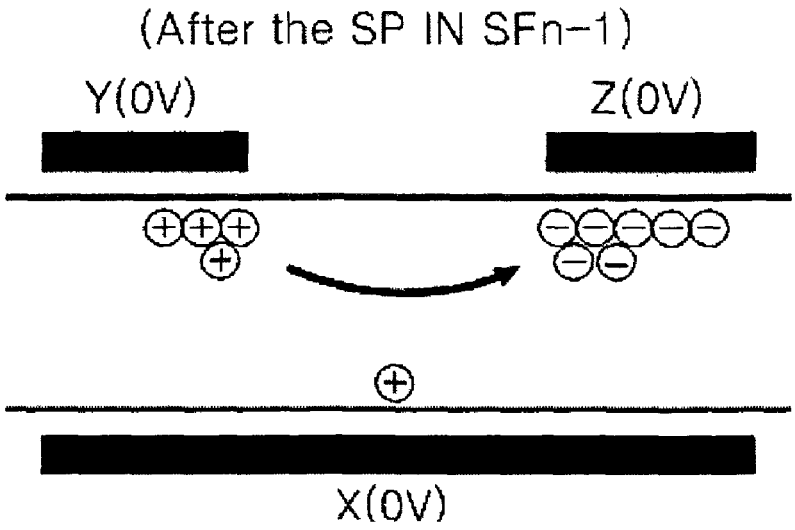
FIG. 27 is a view illustrating a wall charge distribution formed by a driving wave form of FIG. 26 in a discharge cell soon after a sustain period.

In the sustain period of the $(n-1)^{th}$ sub-field (SFn−1), the last sustain pulse (LSTSUSP3) is applied to the sustain electrodes (Z). At this time, 0V or a ground voltage is applied to the scan electrodes (Y) and the address electrodes (X). The last sustain pulse (LSTSUSP) generates the last sustain discharge between the scan electrodes (Y) and the sustain electrodes (Z) in the discharge cells. As shown in FIG. 27, positive wall charges are sufficiently accumulated on the scan electrodes (Y) and negative wall charges are accumulated on the sustain electrodes (Z).

At a setup period (SU) of the $n^{th}$ sub-field (SFn), the wall charge distribution of FIG. 27 is used to generate a dark discharge in the whole discharge cells, thereby initializing the wall charge distribution of the whole discharge cells. A set-up period (SU) operation, and its subsequent set-down initialization, address and sustain operations are substantially the same as those of the first sub-field of FIG. 23.

As described above, in the inventive plasma display apparatus and its driving method, a set-up period of a next sub-field just follows the last sustain discharge of a previous sub-field, without an erasure period for erasing the wall charges between a sustain period of the previous sub-field and a reset period of the next sub-field. The sustain discharge is a strong glow discharge. Therefore, the sustain discharge can sufficiently accumulate many wall charges on the scan electrodes (Y) and the sustain electrodes (Z) and can stably sustain polarities of the positive wall charges on the scan electrodes (Y) and the negative wall charges on the sustain electrodes (Z).

Figure 28:
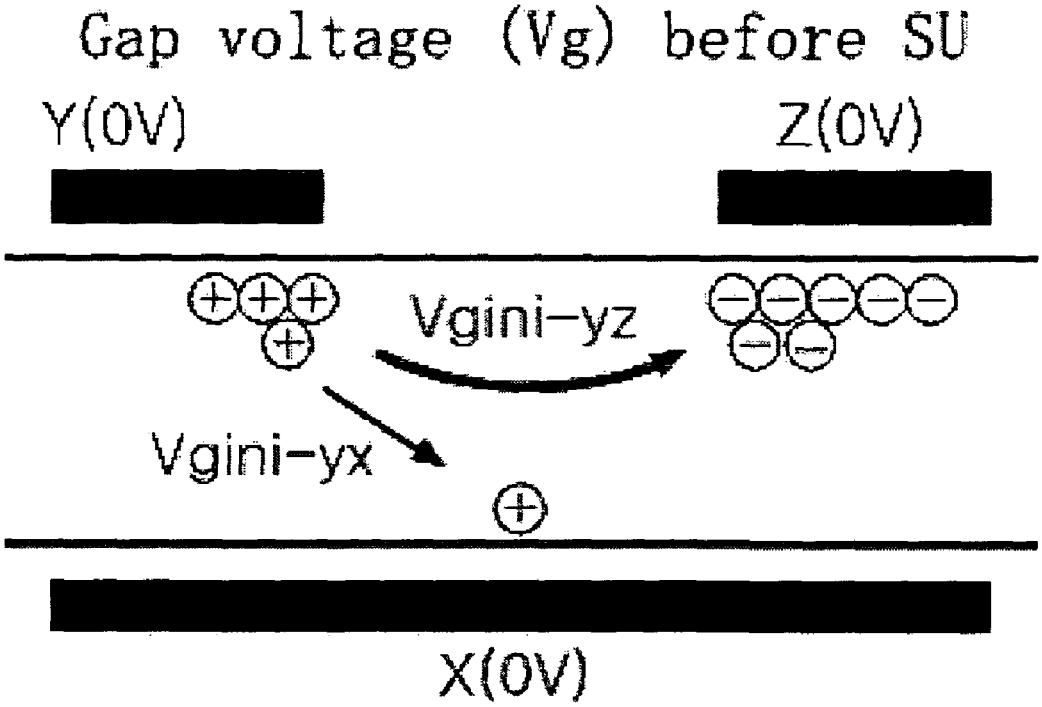
FIG. 28 is a view illustrating a wall charge distribution and a gap voltage in a discharge cell, which are formed by driving wave forms of FIGS. 23 and 26 before a set-up period.

FIG. 28 illustrates a cell gap voltage state, which is formed by the last sustain discharge or the discharge of the pre-reset period (PRERP).

Referring to FIG. 28, the discharge is generated between the scan electrode (Y) and the sustain electrode (Z) by wave forms (NRY1, PRZ and NRZ1) of the last sustain pulse (LST-SUSP) or the pre-reset period (PRERP). Accordingly, just before the set-up period (SU), in the cell, an inter-Y-Z initial gap voltage (Vgini-yz) is formed by an electric field directing from the scan electrode (Y) to the sustain electrode (Z), and an inter-Y-X initial gap voltage (Vgini-yx) is formed by an electric field directing from the scan electrode (Y) to the address electrode (X).

As in FIG. 16, the inter-Y-Z initial gap voltage (Vgini-yz) is already formed in the discharge cell by the wall charge distribution of FIG. 28 before the set-up period (SU). Therefore, if an external voltage is applied by a difference between the firing voltage (Vf) and the inter-Y-Z initial gap voltage (Vgini-yz), the dark discharge is generated in the discharge cells during the set-up period (SU). This is expressed in the above Equation 5. Accordingly, a duplicate description is omitted.

As known in Equation 5 and FIG. 16, if the inter-Y-Z external voltage (Vyz) is sufficiently increased during the set-up period (SU) to be more than the difference between the firing voltage (Vf) and the inter-Y-Z initial gap voltage (Vgini-yz), the dark discharge can be stably generated in the discharge cells due to a wide driving margin.

In the plasma display apparatus according to the embodiment of the present invention, an amount of light emission generated during the reset period at each of the sub-fields is very small in comparison to a conventional art. This is because the number of discharge times, specifically, the number of surface discharge times, which is performed in the cell during the reset period of each of the sub-fields, are less than in the related art.

In the above Table 2, arranged are the discharge types and the number of discharge times, which are performed at the pre-reset period (PRERP) and the reset period (RP) of the first sub-field described in the embodiment of FIG. 23. In the above Table 3, arranged are the discharge types and the number of discharge times, which are performed in the reset period (RP) of each of remaining sub-fields not having the pre-reset period (PRERP) described in the embodiment of FIG. 26. Accordingly, a duplicate description is omitted.

As shown in Table 2, at the first sub-field of FIG. 23, three times of opposite discharge and two times of surface discharge are performed to the maximum during the pre-reset period (PRERP) and the reset period (RP). At its subsequent sub-fields, as shown in Table 3, one time of opposite discharge and two times of surface discharge to the maximum are performed during the reset period (RP), and only one time of opposite discharge is performed in the off-cell turned off at the previous sub-field. In the inventive plasma display apparatus, when one frame period is divided into twelve sub-fields, a black image luminance is decreased to one third or less due to the differences of the number of discharge times and the discharge types in comparison to a conventional plasma display apparatus. Accordingly, the inventive plasma display apparatus can display the black image with a lower darkroom contrast value than in the related art and therefore, can display an image with more definition.

In case where the number of discharge times is less in the reset period (RP), it is meant that the wall charge variance or the polarity variance is less in the discharge cell.

For example, as shown in FIG. 17, in the related art plasma display apparatus, the wall charges of the sustain electrodes (Z) are changed in polarity, from soon after the last sustain discharge of the $(n-1)^{th}$ sub-field (SFn−1) to soon after the dark discharge of the set-down period (SD) of the $n^{th}$ sub-field (SFn), in a sequence of positive polarity, erasure (FIG. 4A), positive polarity (FIG. 4B), and negative polarity (FIG. 4C). Compared to this, as shown in FIG. 18, in the inventive plasma display apparatus, the wall charges of the sustain electrodes (Z) are sustained to have a negative polarity from soon after the last sustain discharge of the $(n-1)^{th}$ sub-field (SFn−1) to soon after the dark discharge of the set-down period (SD) of the $n^{th}$ sub-field (SFn). In other words, in the inventive plasma display apparatus, as the wall charges of the sustain electrodes (X) are constantly sustained in an initialization process as shown in FIGS. 25A, 25B and 25C, the address period (AP) begins.

Figure 29:
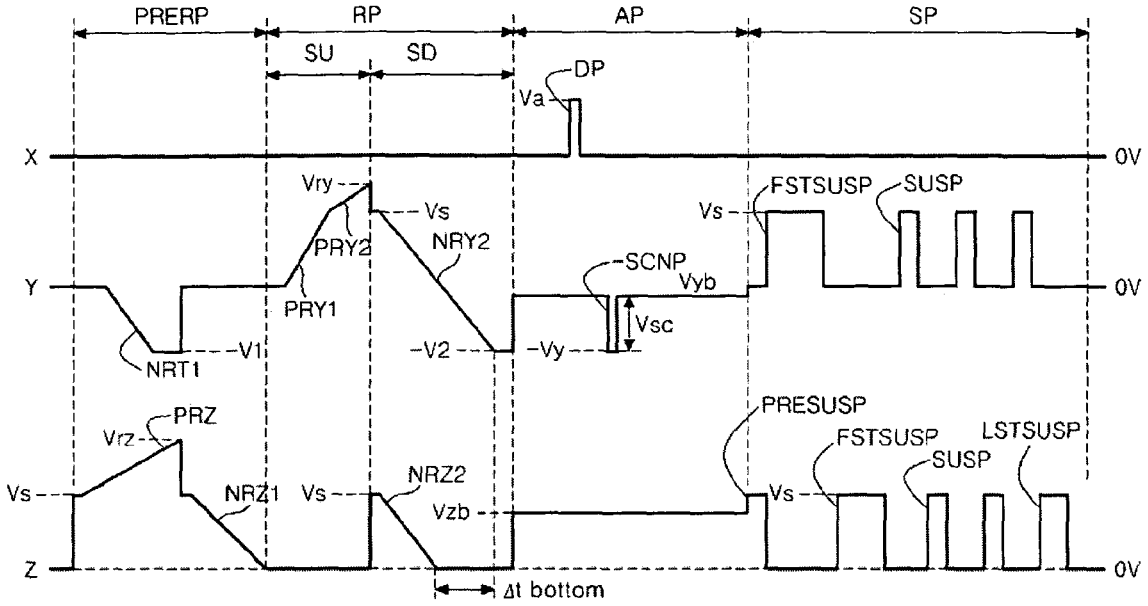
FIG. 29 is a wave form view illustrating a driving method for a plasma display apparatus according to a seventh embodiment of the present invention.

FIG. 29 is a wave form view illustrating a driving method for a plasma display apparatus according to a seventh embodiment of the present invention.

Referring to FIG. 29, in the inventive driving method for the plasma display apparatus, a second Z negative ramp wave form reaches a ground voltage (GND) faster than a second Y negative ramp wave form (NRY2) does.

In this embodiment, a pre-reset period (PRERP), a set-up period (SU) of a reset period (RP), an address period (AP) and a sustain period (SP) are the same as those of the above embodiments and accordingly, a detailed description thereof is omitted.

During the set-down period (SD) of the reset period (RP), a second Y negative ramp wave form (NRY2) is applied to scan electrodes (Y) and at the same time, a second Z negative ramp form (NRZ2) is applied to sustain electrodes (Z). The second Y negative ramp wave form (NRY2) drops from a positive sustain voltage (Vs) to a negative voltage (−V2). The second Z negative ramp wave form (NRZ2) drops from a positive Z bias voltage (Vzb) to 0V or the ground voltage (GND). After the second Z negative ramp wave form (NRZ2) reaches the ground voltage (GND) and a predetermined time difference (Δtbottom) lapses, the second Y negative ramp wave form (NRZ2) reaches the ground voltage (GND). In the sustaining of the second Z negative ramp wave form (NRZ2) to the ground voltage (GND), if the second Y negative ramp wave form (NRY2) reaches the ground voltage (GND), a voltage variance of the scan electrode (Y) can be prevented due to the coupling of the scan electrode (Y) and the sustain electrode (Z) to constantly sustain a negative voltage (−V2).

Therefore, there is an advantage in that a driving margin can be stably secured. During the set-down period (SD), the dark discharge is generated between the scan electrodes (Y) and the address electrodes (X). By the dark discharge, excessive negative wall charges are erased from the scan electrodes (Y), and excessive positive wall charges are erased from the address electrodes (Y). As a result, the whole discharge cells have a uniform wall charge distribution in an optimal address condition.

Figure 30:
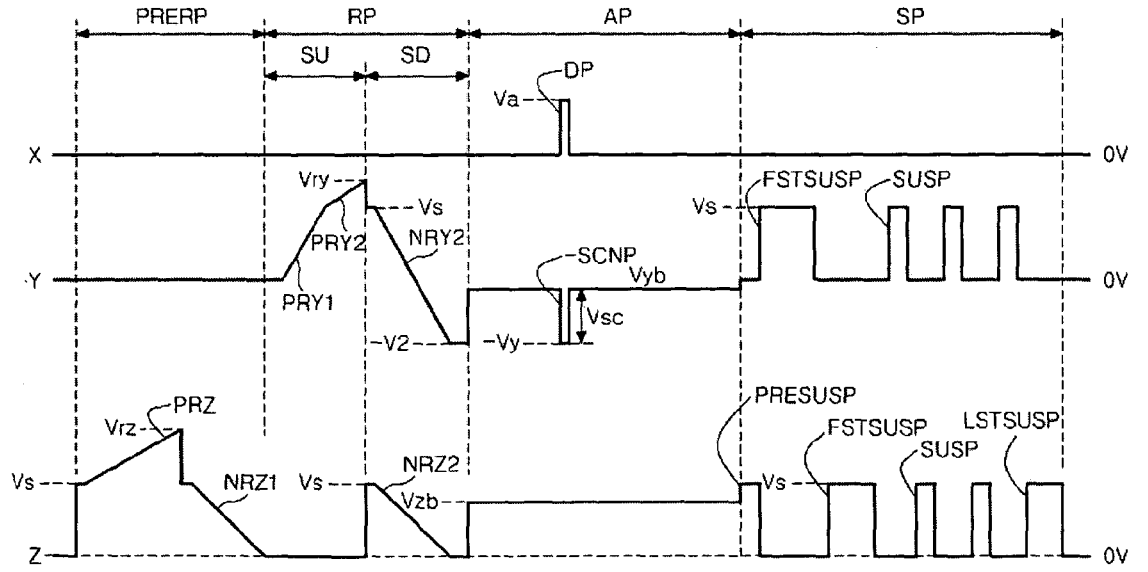
FIG. 30 is a wave form view illustrating a driving method for a plasma display apparatus according to an eighth embodiment of the present invention.

FIG. 30 is a wave form view illustrating a driving method for a plasma display apparatus according to an eighth embodiment of the present invention.

Referring to FIG. 30, in the inventive driving method for the plasma display apparatus, a ramp wave form is applied only to sustain electrodes (Z) during the pre-reset period (PRERP).

In this embodiment, a reset period (RP), an address period (AP) and a sustain period (SP) are substantially the same as those of the seventh embodiment and accordingly, a detailed description thereof is omitted.

At the pre-reset period (PRERP), a Z positive ramp wave (PRZ) rising from a positive sustain voltage (Vs) to a positive Z reset voltage (Vrz) is applied to all the sustain electrodes (Z). During the pre-reset period (PRERP), 0V or a ground voltage (GND) is applied to scan electrodes (Y) and address electrodes (X). The Z positive ramp wave form (PRZ) generates the dark discharge between the scan electrodes (Y) and the sustain electrodes (Z) and between the sustain electrodes (Z) and the address electrodes (X) in whole discharge cells. As a result of the discharge, soon after the pre-reset period (PRERP), positive wall charges are accumulated on the scan electrodes (Y) and a large amount of negative wall charges are accumulated on the sustain electrodes (Z) in the whole discharge cells. The positive wall charges are accumulated on the address electrodes (X). The discharge at the pre-reset period (PRERP) and its effect are similar with those of the above sixth embodiment. Accordingly, in comparison to the seventh embodiment, this embodiment has an advantage in that the discharge effect of the pre-reset period (PRERP) is not only provided, but also a scan electrode driving circuit is more easily controlled since the ramp wave form is applied only to the sustain electrodes (Z).

Figure 31:
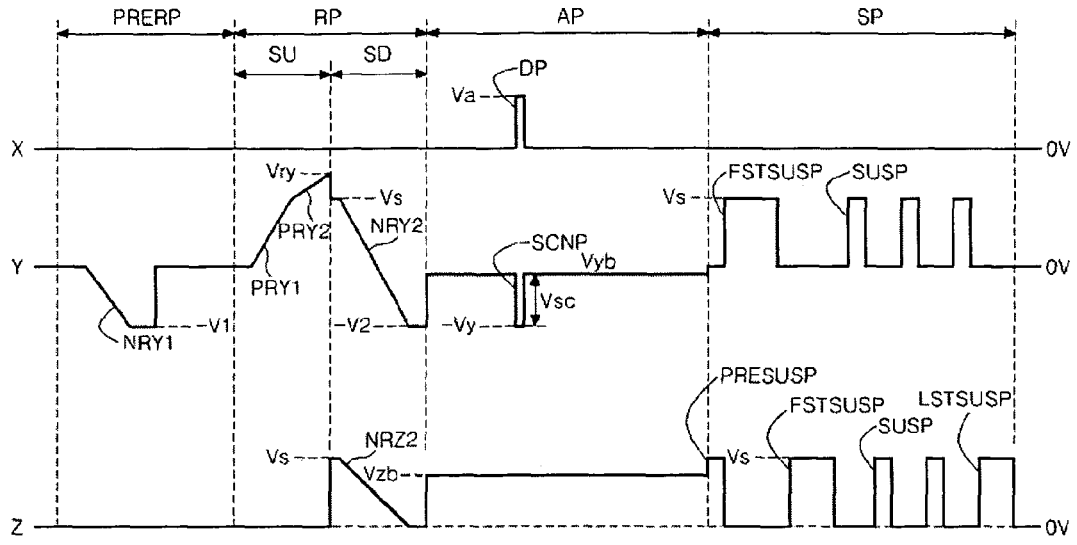
FIG. 31 is a wave form view illustrating a driving method for a plasma display apparatus according to a ninth embodiment of the present invention.

FIG. 31 is a wave form view illustrating a driving method for a plasma display apparatus according to a ninth embodiment of the present invention.

Referring to FIG. 31, in the inventive driving method for the plasma display apparatus, a ramp wave form is applied only to scan electrodes (Y) during the pre-reset period (PRERP).

In this embodiment, a reset period (RP), an address period (AP) and a sustain period (SP) are substantially the same as those of the embodiment of FIG. 23 and accordingly, a detailed description thereof is omitted.

At the pre-reset period (PRERP), a Y negative ramp wave (NRY1) falling from 0V or a ground voltage (GND) to a negative voltage (−V1) is applied to all the scan electrodes (Y). During the pre-reset period (PRERP), 0V or the ground voltage (GND) is applied to sustain electrodes (Z) and address electrodes (X). The Y negative ramp wave form (NRY1) generates the dark discharge between the scan electrodes (Y) and the sustain electrodes (Z) and between the sustain electrodes (Z) and the address electrodes (X) in whole discharge cells. As a result of the discharge, soon after the pre-reset period (PRERP), positive wall charges are accumulated on the scan electrodes (Y) and negative wall charges are accumulated on the sustain electrodes (Z) in the whole discharge cells. The positive wall charges are accumulated on the address electrodes (X). The discharge at the pre-reset period (PRERP) and its effect are similar with those of the above embodiment of FIG. 23. Accordingly, in comparison to the embodiment of FIG. 23, this embodiment has an advantage in that the discharge effect of the pre-reset period (PRERP) is not only provided, but also a sustain electrode driving circuit is more easily controlled since the ramp wave form is applied only to the scan electrodes (Y).

In the same manner as the embodiment of FIG. 23, the driving wave forms of FIGS. 30 and 31 are not limited only to the first sub-field, but is applicable to several initial sub-fields including the first sub-field, and is also applicable to whole sub-fields included in one frame period.

Figure 32:
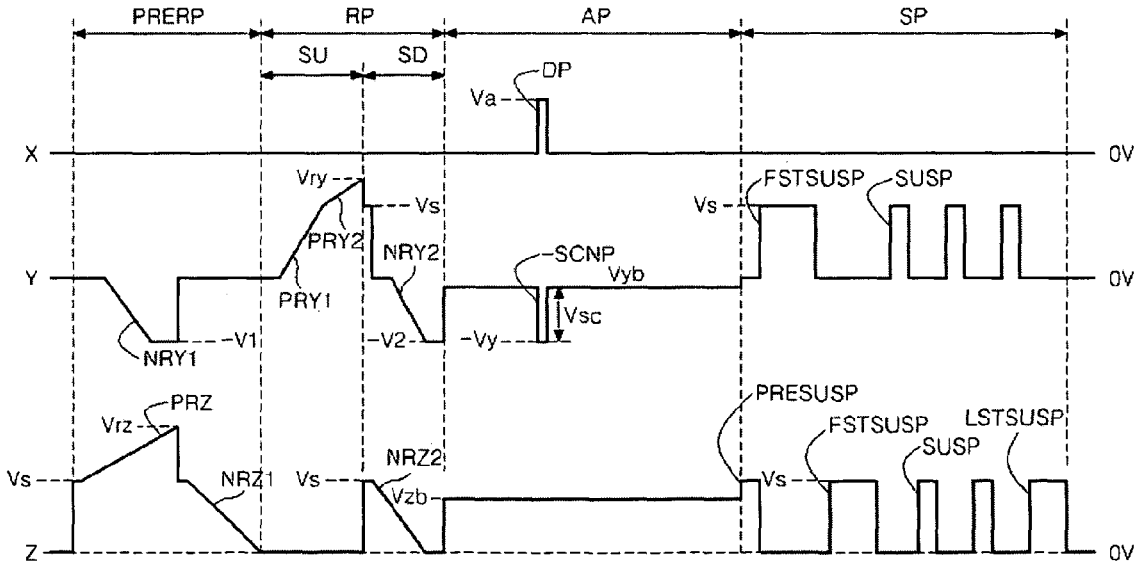
FIG. 32 is a view illustrating a driving wave form of a first sub-field period in a driving method for a plasma display apparatus according to a tenth embodiment of the present invention.
Figure 33:
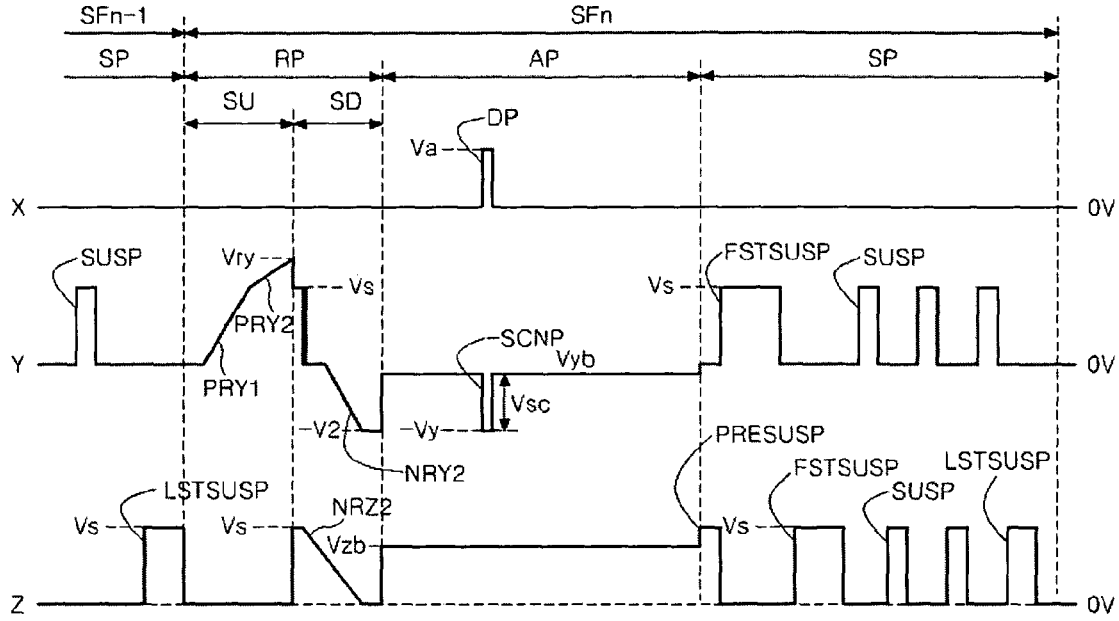
FIG. 33 is a view illustrating a driving wave form of sub-field periods other than a first sub-field period in a driving method for a plasma display apparatus according to a tenth embodiment of the present invention.

FIG. 32 illustrates a driving wave form of a first sub-field period in a driving method for a plasma display apparatus according to a tenth embodiment of the present invention. FIG. 33 illustrates a driving wave form during a sustain period (SP) of $(n-1)^{th}$ sub-field (SFn−1) and $n^{th}$ sub-field (SFn), in the driving method for the plasma display apparatus according to the tenth embodiment of the present invention.

Referring to FIGS. 32 and 33, in the inventive driving method for the plasma display apparatus, a voltage falling from 0V or a ground voltage (GND) is applied to scan electrodes (Y) during a set-down period (SD) at each sub-field to regularize a wall charge distribution of whole discharge cells initialized at a set-up period (SU).

A first sub-field includes a pre-reset period (PRERP), a reset period (RP), an address period (AP) and a sustain period (SP) as shown in FIG. 32. Other sub-fields (SFn) include a reset period (RP), an address period (AP) and a sustain period (SP) as shown in FIG. 33.

Operations of the pre-reset period (PRERP), the set-up period (SU), the address period (AP) and the sustain period (SP) are substantially the same as those of the above embodiments.

At the set-down period (SD) of the reset period (RP) of each of the sub-fields (SFn−1 and SFn), a second Y negative ramp wave form (NRY2) is applied to the scan electrodes (Y) and at the same time, a second Z negative ramp wave form (NRZ2) is applied to the sustain electrodes (Z). The second Y negative ramp wave form (NRY2) drops from 0V or the ground voltage (GND) to a negative voltage (−V2) unlike the above embodiments. The second Z negative ramp wave form (NRZ2) drops from a positive sustain voltage (Vs) to 0V or the ground voltage. During the set-down period (SD), voltages of the scan electrodes (Y) and the sustain electrodes (Z) concurrently drop. Therefore, a discharge is not generated between the scan electrodes (Y) and the sustain electrodes (Z) whereas a dark discharge is generated between the scan electrodes (Y) and the address electrodes (X). By the dark discharge, excessive negative wall charges are erased from the scan electrodes (Y) and excessive positive wall charges are erased from the address electrodes (X).

If the second Y negative ramp wave form (NRY2) drops from 0V or the ground voltage, the set-down period (SD) is shortened in comparison to the above-described embodiments. Further, even though the second Y negative ramp wave form (NRY2) drops from 0V or the ground voltage, a voltage difference between the scan electrodes (Y) and the sustain electrodes (Z) is less. Therefore, the inventive plasma display apparatus can more effectively suppress the discharge between the scan electrodes (Y) and the sustain electrodes (Z) while more stably performing an initialization. Accordingly, in this embodiment, a driving time can be more secured due to the reduction of the set-down period (SD) and an initialization operation of the set-down period (SD) is performed more stably.

Figure 34:
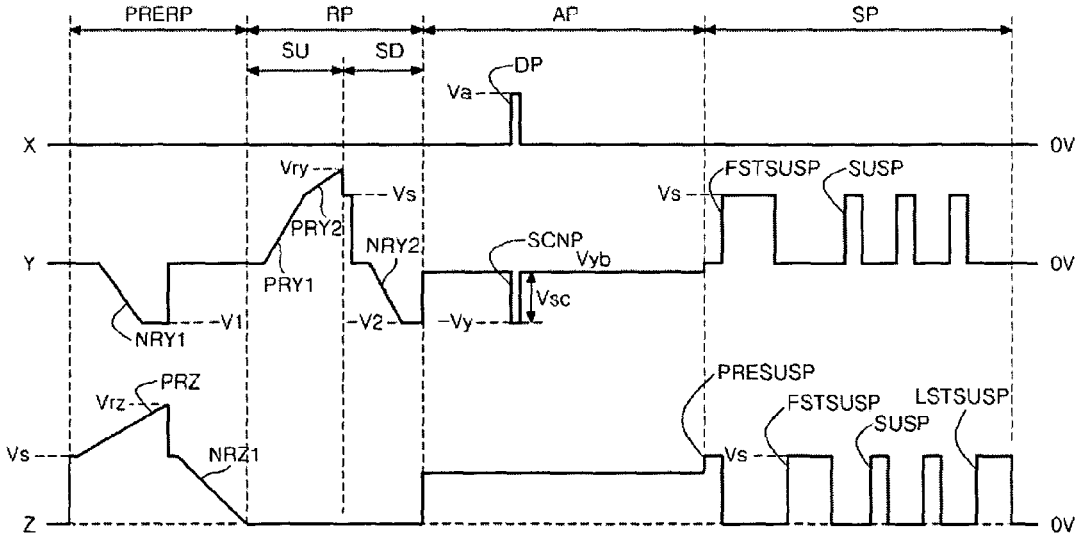
FIG. 34 is a view illustrating a driving wave form of a first sub-field period in a driving method for a plasma display apparatus according to an eleventh embodiment of the present invention.
Figure 35:
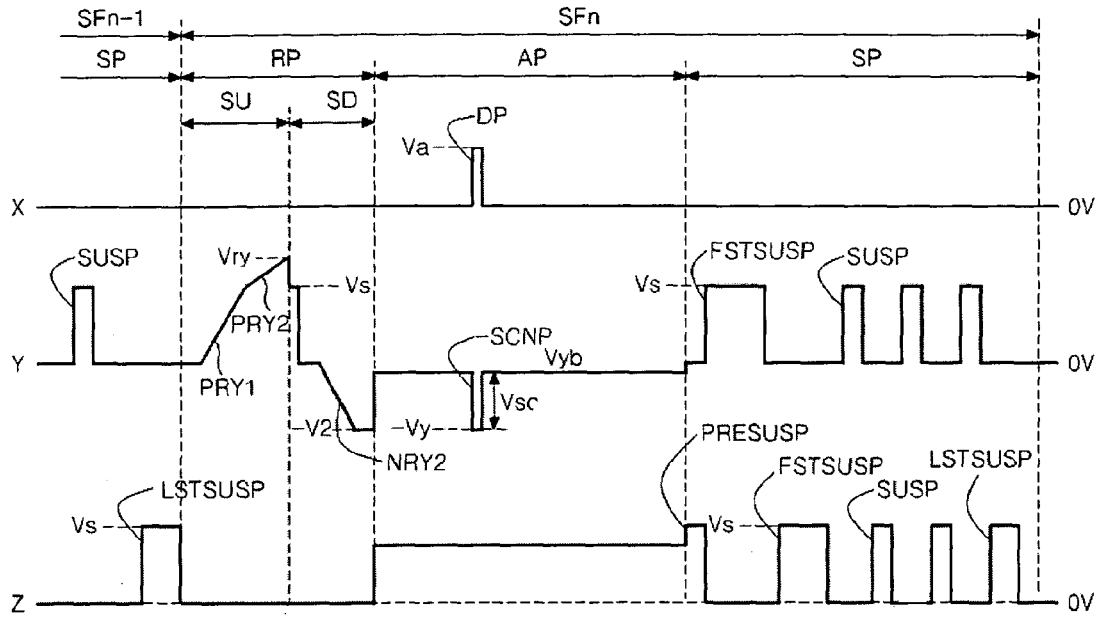
FIG. 35 is a view illustrating a driving wave form of sub-field periods other than a first sub-field period in a driving method for a plasma display apparatus according to an eleventh embodiment of the present invention.

FIG. 34 illustrates a driving wave form of a first sub-field period in a driving method for a plasma display apparatus according to an eleventh embodiment of the present invention. FIG. 35 illustrates a driving wave form during a sustain period (SP) of $(n-1)^{th}$ sub-field (SFn−1) and $n^{th}$ sub-field (SFn) in the driving method for the plasma display apparatus according to the eleventh embodiment of the present invention.

Referring to FIGS. 34 and 35, in the inventive driving method for the plasma display apparatus, a voltage falling from 0V or a ground voltage (GND) is applied to scan electrodes (Y), and a voltage of the sustain electrodes (Z) is sustained to 0V or the ground voltage (GND) during a set-down period (SD) at each sub-field to regularize a wall charge distribution of whole discharge cells initialized at a set-up period (SU).

A first sub-field includes a pre-reset period (PRERP), a reset period (RP), an address period (AP) and a sustain period (SP) as shown in FIG. 34. Other sub-fields (SFn) include a reset period (RP), an address period (AP) and a sustain period (SP) as shown in FIG. 23.

Operations of the pre-reset period (PRERP), the set-up period (SU), the address period (AP) and the sustain period (SP) are substantially the same as those of the embodiments of FIGS. 32 and 33.

At the set-down period (SD) of the reset period (RP) of each of the sub-fields (SFn−1 and SFn), a second Y negative ramp wave form (NRY2) is applied to the scan electrodes (Y). During the set-down period (SD), 0V or the ground voltage (GND) is applied to the sustain electrodes (Z) and the address electrodes (X). A second Y negative ramp wave form (NRY2) drops from 0V or the ground voltage (GND) to a negative voltage (−V2). During the set-down period (SD), voltages of the scan electrodes (Y) and the sustain electrodes (Z) concurrently drop. Therefore, a discharge is not generated between the scan electrodes (Y) and the sustain electrodes (Z) whereas a dark discharge is generated between the scan electrodes (Y) and the address electrodes (X). By the dark discharge, excessive negative wall charges are erased from the scan electrodes (Y) and excessive positive wall charges are erased from the address electrodes (X).

If the second Y negative ramp wave form (NRY2) drops from 0V or the ground voltage, the set-down period (SD) is shortened in comparison to the above-described embodiments. Further, even though the second Y negative ramp wave form (NRY2) drops from 0V or the ground voltage, a voltage difference between the scan electrodes (Y) and the sustain electrodes (Z) is less. Therefore, the inventive plasma display apparatus can more effectively suppress the discharge between the scan electrodes (Y) and the sustain electrodes (Z) while more stably performing an initialization. Further, in comparison to the embodiments of FIGS. 32 and 33, this embodiment has an advantage in that a sustain electrode driving circuit is more easily controlled since the ramp wave form is applied only to the scan electrodes (Y) during the set-down period (SD). Accordingly, in this embodiment, a driving time can be more secured due to the reduction of the set-down period (SD), and the sustain electrode driving circuit is more easily controlled.

Figure 36:
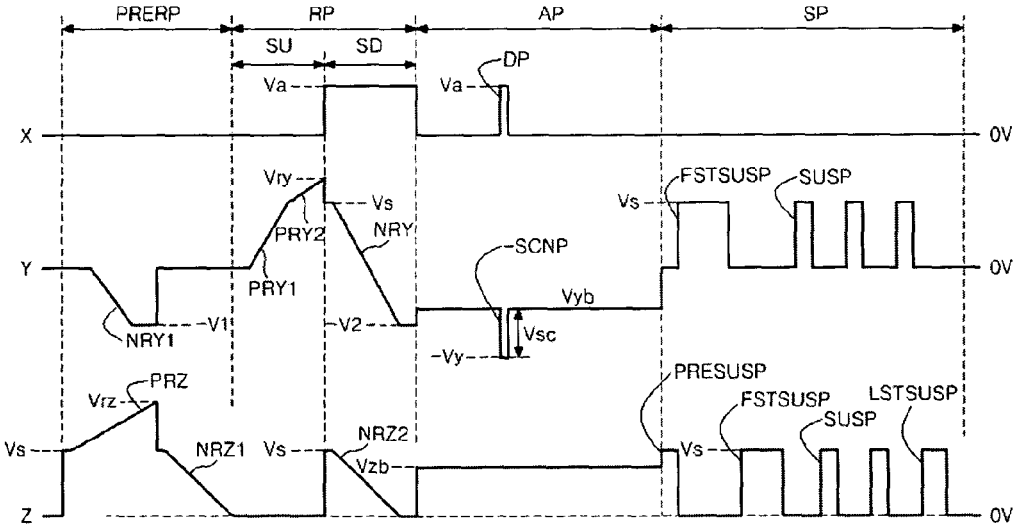
FIG. 36 is a view illustrating a driving wave form of a first sub-field period in a driving method for a plasma display apparatus according to a twelfth embodiment of the present invention.
Figure 37:
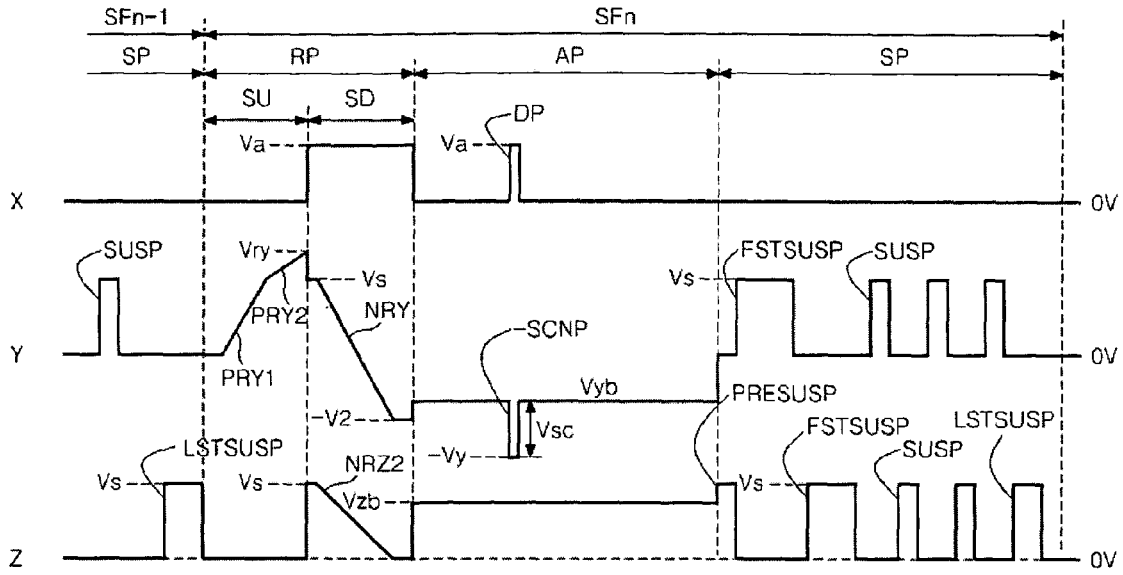
FIG. 37 is a view illustrating a driving wave form of sub-field periods other than a first sub-field period in a driving method for a plasma display apparatus according to a twelfth embodiment of the present invention.

FIG. 36 illustrates a driving wave form of a first sub-field period in a driving method for a plasma display apparatus according to a twelfth embodiment of the present invention. FIG. 37 illustrates a driving wave form during a sustain period (SP) of $(n-1)^{th}$ sub-field (SFn−1) and $n^{th}$ sub-field (SFn), in the driving method for the plasma display apparatus according to the twelfth embodiment of the present invention.

Referring to FIGS. 36 and 37, in the inventive driving method for the plasma display apparatus, a positive bias voltage is applied to address electrodes (X) during a set-down period (SD) at each sub-field.

A first sub-field includes a pre-reset period (PRERP), a reset period (RP), an address period (AP) and a sustain period (SP) as shown in FIG. 36. Other sub-fields (SFn) include a reset period (RP), an address period (AP) and a sustain period (SP) as shown in FIG. 37.

Operations of the pre-reset period (PRERP), the set-up period (SU), the address period (AP) and the sustain period (SP) are substantially the same as those of the embodiment of FIG. 23.

At the set-down period (SD) of the reset period (RP) of each of the sub-fields (SFn−1 and SFn), a second Y negative ramp wave form (NRY2) is applied to the scan electrodes (Y) and at the same time, a second Z negative ramp wave form (NRZ2) is applied to the sustain electrodes (Z). The second Y negative ramp wave form (NRY2) drops from a positive sustain voltage (Vs) to a negative voltage (−V2). The second Y negative ramp wave form (NRY2) can also drop from 0V or the ground voltage as in the embodiments of FIGS. 32 to 35. The second Z negative ramp wave form (NRZ2) drops from the positive sustain voltage (Vs) to 0V or the ground voltage. During the set-down period (SD), the positive bias voltage is supplied to the address electrodes (X). For example, the same voltage as a data voltage (Va) can be supplied to the address electrodes (X) as the positive bias voltage. Voltages of the scan electrodes (Y) and the sustain electrodes (Z) concurrently drop. Therefore, a discharge is not generated between the scan electrodes (Y) and the sustain electrodes (Z) whereas a dark discharge is generated between the scan electrodes (Y) and the address electrodes (X). The positive bias voltage of the address electrodes (X) increases a voltage difference between the address electrodes (X) and the scan electrodes (Y) to more quickly generate the dark discharge during an erasure period (EP) and lengthen a time of the dark discharge. Accordingly, even when a discharge characteristic deviation is heavily caused in each of the discharge cells, the dark discharge is performed by one time in the whole discharge cells, thereby more enhancing a uniformity of the wall charge distribution in the whole discharge cells.

The driving wave forms of FIGS. 32, 34 and 36 are not limited only to the first sub-field, but are applicable to several initial sub-fields including the first sub-field and are also applicable to the whole sub-fields included in one frame period.

Figure 38:
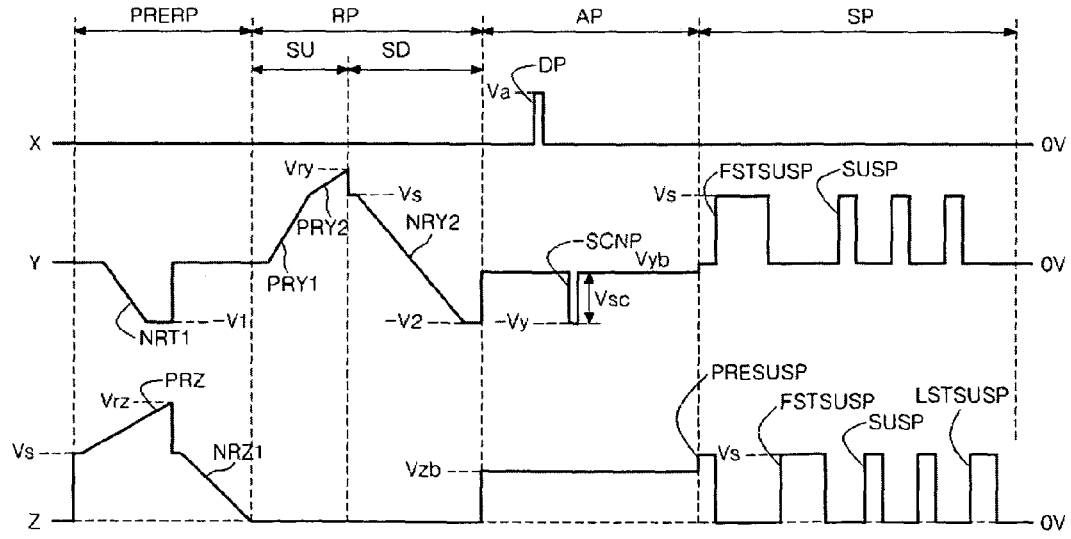
FIG. 38 is a wave form view illustrating a driving method for a plasma display apparatus according to a thirteenth embodiment of the present invention.

FIG. 38 is a wave form view illustrating a driving method for a plasma display apparatus according to a thirteenth embodiment of the present invention.

Referring to FIG. 38, in the inventive driving method for the plasma display apparatus, a voltage of sustain electrodes (Z) is sustained to a ground voltage during the reset period (RP).

In this embodiment, a pre-reset period (PRERP), a set-up period (SU) of the reset period (RP), an address period (AP) and a sustain period (SP) are substantially the same as those of the above embodiment and accordingly, a detailed description thereof is omitted.

During a set-down period (SD) of the reset period (RP), a second Y negative ramp wave form (NRY2) is applied to scan electrodes (Y) and the ground voltage (GND) is applied to the sustain electrodes (Z). During the set-down period (SD), the dark discharge is generated between the scan electrodes (Y) and address electrodes (X). By the dark discharge, excessive negative wall charges are erased from the scan electrodes (Y) and excessive positive wall charges are erased from the address electrodes (X). As a result, whole discharge cells have a uniform wall charge distribution in an optimal address condition.

In this embodiment, the dark discharge generated during the set-down period (SD) is induced only at the scan electrode (Y) and the address electrode (X). As a result, the address discharge is generated only between the scan electrode (Y) and the address electrode (X) by the wall charge distribution in the discharge cell formed by the discharge of the set-down period (SD). Therefore, a time necessary for address is reduced.

Figure 39:
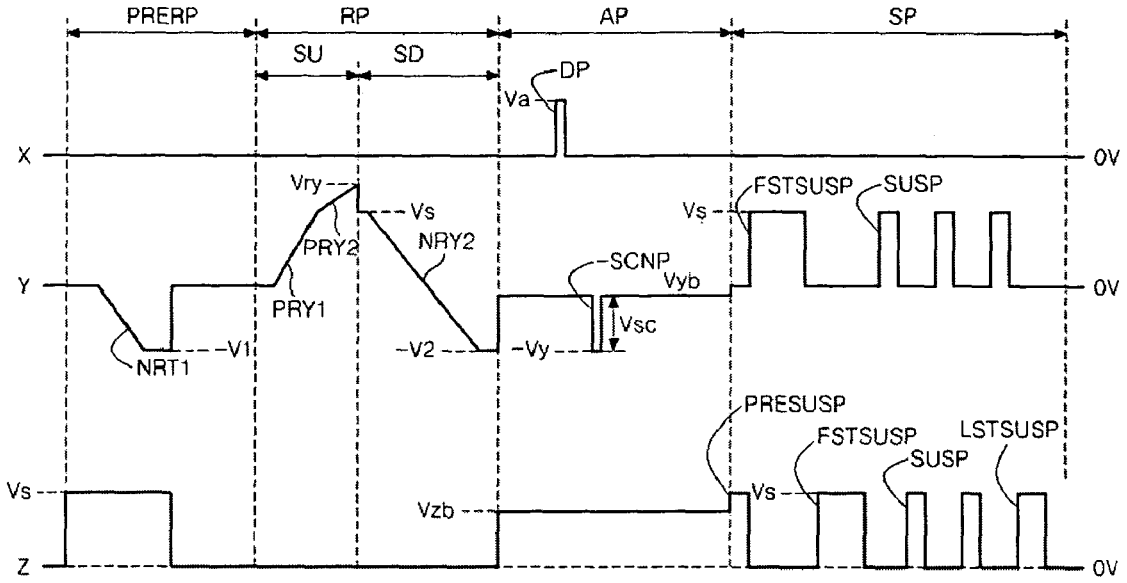
FIG. 39 is a wave form view illustrating a driving method for a plasma display apparatus according to a fourteenth embodiment of the present invention.

At the pre-reset period (PRERP), only sustain voltage (Vs) can be also supplied to the sustain electrode (Z) as in FIG. 39 without a Z positive ramp wave form (PRZ).

FIG. 39 is a wave form view illustrating a driving method for a plasma display apparatus according to a fourteenth embodiment of the present invention. FIG. 39 are already described in detail and accordingly, a duplicate description is omitted.

In FIGS. 23, 26 and 29 to 39, the positive Z bias voltage (Vzb) supplied to the sustain electrodes (Z) is lower than the sustain voltage (Vs) and the scan voltage (Vsc) during the address period (AP) to generate the address discharge only between the scan electrode (Y) and the sustain electrode (Z).

Figure 40:
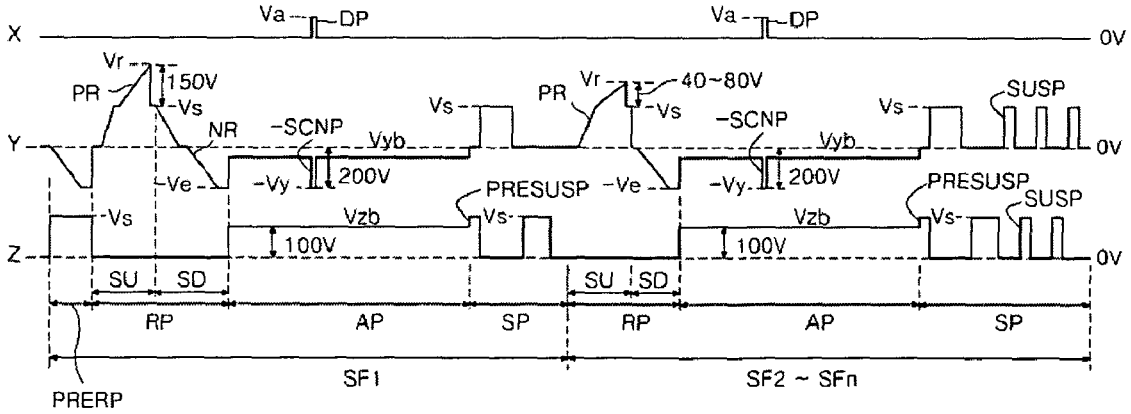
FIG. 40 is a view illustrating a driving wave form, which is applied to sub-fields of one frame period in a plasma display apparatus according to a fifteenth embodiment of the present invention.

FIG. 40 illustrates a portion of a driving wave form, which is applied to sub-fields other than a first sub-field, in a plasma display apparatus according to a fifteenth embodiment of the present invention.

Referring to FIG. 40, the plasma display apparatus is driven at the first sub-field using the driving wave form of FIG. 39 and is driven at other sub-fields using the driving wave form of FIG. 32.

This embodiment does not have an erasure discharge between a sustain period (SP) and a reset period (RP). At each sub-field, a set-down discharge and an address discharge are generated using positive wall charges, which are accumulated on an address electrode using a sustain discharge generated at a previous sub-field. In the inventive driving method for the plasma display apparatus, during the set-down period (SD), the sustain electrode (Z) is sustained to have a ground voltage (GND) or 0V, and the wall charges accumulated on the address electrode (X) at the previous sub-field are used to generate the set-down discharge and the address discharge only between the scan electrode (Y) and the address electrode (X).

In the inventive plasmas display apparatus, the wall charges are sufficiently accumulated in each discharge cell before the set-up period (SD). Therefore, a reset voltage (Vry) can drop at sub-fields (SF2 to SFn) other than an initial sub-field (SF1). At the sub-fields (SF2 to SFn) other than the initial sub-field (SF1), the set-up discharge can be generated in all discharge cells using only the sustain voltage (Vs) without rising to the reset voltage (Vry).

In a first sustain pulse (FSTSUSP), a period for varying a voltage of the scan electrodes (Y) is superposed with a period for varying a voltage of the sustain electrodes (Z) to reinforce the discharge between the scan electrodes (Y) and the sustain electrodes (Z) without almost any influence caused by the wall charges formed on the lower substrate.

Figure 41:
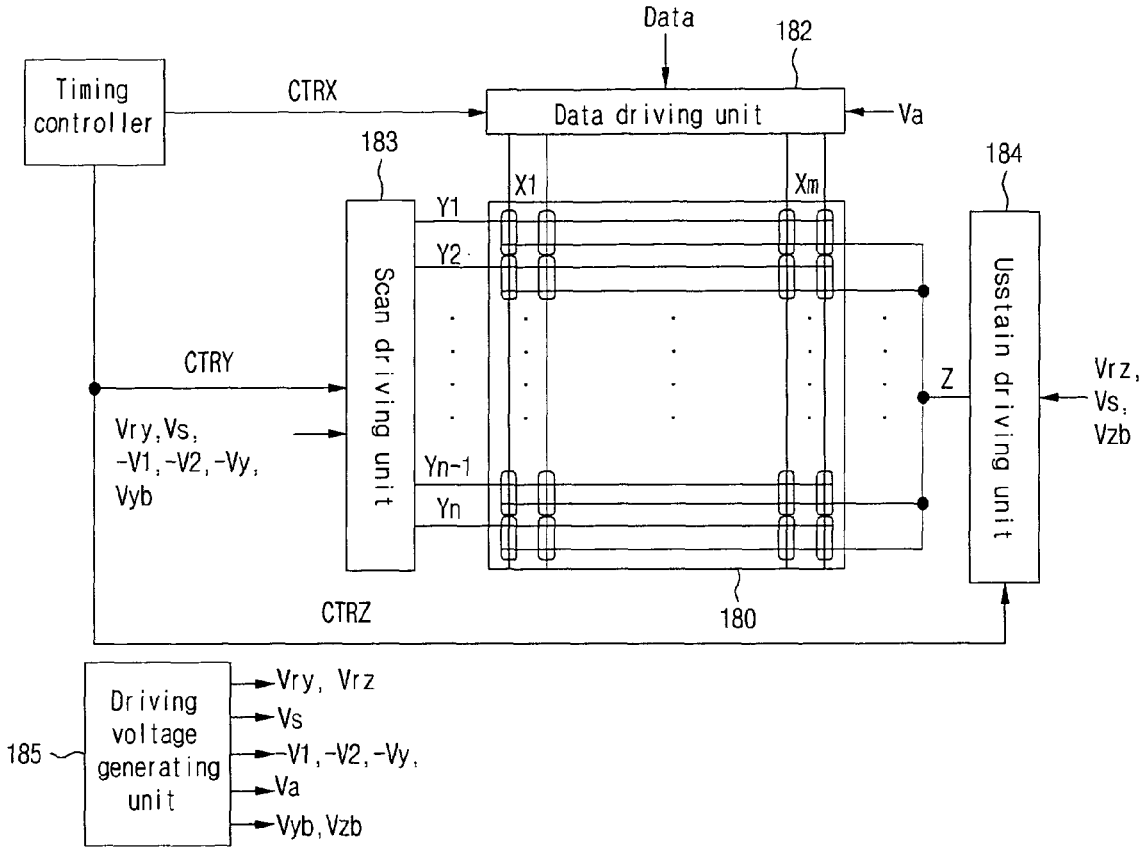
FIG. 41 is a block diagram illustrating a plasma display apparatus according to another embodiment of the present invention.

FIG. 41 is a block diagram illustrating a plasma display apparatus according to another embodiment of the present invention.

Referring to FIG. 41, the inventive plasma display apparatus includes a plasma display panel (PDP) 1800, a data driving unit 1820 for supplying data to address electrodes (X1 to Xm) of the PDP 1800, a scan driving unit 1830 for driving scan electrodes (Y1 to Yn) of the PDP 1800, a sustain driving unit 1840 for driving sustain electrodes (Z) of the PDP 1800, a timing controller 1810 for controlling each of the driving units 1820, 1830 and 1840, and a driving voltage generating unit 1850 for generating a driving voltage necessary for each of the driving units 1820, 1830 and 1840.

After data is inverse gamma corrected and erroneous diffused through an inverse gamma correction circuit (not shown) and an error diffusion circuit (not shown), the data is mapped to a predetermined sub-field pattern by a sub-field mapping circuit and supplied to the data driving unit 1820. As shown in FIGS. 23, 26, 29 to 35, 38 to 40, the data driving unit 1820 applies 0V or a ground voltage to the address electrodes (X1 to Xm) in the pre-reset period (PRERP), the reset period (RP) and the sustain period (SP). As shown in FIGS. 36 and 37, the data driving unit 1820 can also supply a positive bias voltage of the driving voltage generating unit 185, for example, a data voltage (Va) to the address electrodes (X1 to Xm) at a set-down period (SD) of the reset period (RP). After the data driving unit 1820 samples and latches the data under the control of the timing controller 1810, it supplies the data to the address electrodes (X1 to Xm) during the address period (AP).

As shown in FIGS. 23, 26, 29 to 40, the scan driving unit 1830 supplies the ramp wave forms (NRY1, PRY1, PRY2, NRY2) to the scan electrodes (Y1 to Yn) so as to initialize the whole discharge cells at the pre-reset period (PRERP) and the reset period (RP) under the control of the timing controller 1810. After that, the scan driving unit 1830 sequentially supplies the scan pulse (SCNP) to the scan electrodes (Y1 to Yn) so as to select the scan line to which the data is supplied during the address period (AP). The scan driving unit 1830 supplies the sustain pulses (FSTSUSP and SUSP) to the scan electrodes (Y1 to Yn), so as to generate the sustain discharge within the selected on-cells in the sustain period (SP).

As shown in FIGS. 23, 26, 29 to 40, the sustain driving unit 1840 supplies the ramp wave forms (PRZ, NRZ1 and NRZ2) to the sustain electrodes (Z) so as to initialize the whole discharge cells at the pre-reset period (PRERP) and the reset period (RP) under the control of the timing controller 201. After that, the sustain driving unit 1840 supplies the Z bias voltage (Vzb) to the sustain electrodes (Z) in the address period (AP). The sustain driving unit 1840 is operated alternately with the scan driving unit 1830 in the sustain period (SP) to supply the sustain pulses (FSTSUSP, SUSP, LSTSUSP) to the sustain electrodes (Z).

The timing controller 1810 receives vertical/horizontal synchronous signals and a clock signal to generate timing control signals (CTRX, CTRY, CTRZ) necessary for each of the driving units 1820, 1830 and 1840. The timing controller 1810 supplies the timing control signals (CTRX, CTRY, CTRZ) to the corresponding driving units 1820, 1830 and 1840 to control each of the driving units 1820, 1830 and 1840. The timing control signal (CTRX) supplied to the data driving unit 1820 includes a sampling clock for sampling data, a latch control signal, and a switch control signal for controlling an on/off time of an energy recovery circuit and a driving switch element. The timing control signal (CTRY) applied to the scan driving unit 1830 includes a switching control signal for controlling an on/off time of an energy recovery circuit and a driving switch element of the scan driving unit 1830. The timing control signal (CTRZ) applied to the sustain driving unit 1840 includes a switch control signal for controlling an on/off time of an energy recovery circuit and a driving switch element of the sustain driving unit 1840.

The driving voltage generating unit 1850 generates the driving voltages supplied to the PDP 1800, that is, the voltages (Vry, Vrz, Vs, −V1, −V2, −Vy, Va, Vyb, Vzb) of FIGS.

23, 26 and 29 to 40. The driving voltages can be varied depending on a discharge feature or a discharge gas composition, which are different depending on a resolution and a model of the PDP 1800.

As described above, in the inventive plasma display apparatus and its driving method, when the PDP has the high temperature, the last sustain pulse (LSTSUSP) is lengthened to have the pulse width of about 200 μs to 500 μs or is lengthened to have the rising period and the falling period of about 340 ns±20 ns, or the positive sustain voltage (Vs) is supplied to the sustain electrodes (Z) prior to the first Y negative ramp wave form (NRY1) to reduce the amount of spatial charges generated in the sustain discharge and decay the spatial charges, thereby stabilizing the discharge of the PDP.

In the inventive plasma display apparatus and its driving method, before the initialization of the discharge cell, the positive wall charges can be sufficiently accumulated on the scan electrode within the discharge cell to prevent the erroneous discharge, the misdischarge and the abnormal discharge. The number of discharge times performed in the initialization process is reduced to enhance the darkroom contrast and widen the operation margin. Furthermore, the negative ramp wave form generated at the set-down period can drop to 0V or the ground voltage to reduce the set-down period, thereby securing a driving time. At the set-down period, the positive bias voltage can be applied to the address electrode to lengthen the time of the dark discharge generated between the scan electrode and the address electrode, thereby regularizing the wall charge distribution in the whole discharge cells.

As described above, in the plasma display apparatus and its driving method according to another embodiment of the present invention, the pre sustain pulse (PRESUSP) rising from the sustain bias voltage (Vzb) can be applied to the second electrode in the sustain period, thereby minimizing the influence of the wall charges upon the lower substrate in the first sustain discharge.

In the inventive plasma display apparatus and its driving method, before the initialization of the discharge cell, the positive wall charges can be sufficiently accumulated on the scan electrode in the discharge cell to prevent the erroneous discharge, the misdischarge and the abnormal discharge. The number of discharge times performed in the initialization process is reduced to enhance the darkroom contrast and widen the operation margin. Furthermore, the negative ramp wave form generated at the set-down period can drop to 0V or the ground voltage to reduce the set-down period, thereby securing the driving time. At the set-down period, the positive bias voltage can be applied to the address electrode to lengthen the time of the dark discharge generated between the scan electrode and the address electrode, thereby regularizing the wall charge distribution in the whole discharge cells.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display apparatus comprising:

a plasma display panel including a scan electrode and a sustain electrode; and a drive unit for driving the plasma display panel such that a frame period is divided into N number of sub-fields to display an image and for supplying an erase signal to at least one of the scan electrode and the sustain electrode during a period of time, wherein the period of time is between the last sustain pulse generated during a sustain period of a sub-field and an initialization signal generated during a reset period of a next sub-field and is extended as a temperature increases, wherein the erase signal has a voltage that gradually rises, and the period of time corresponds to a decay period.

2. The apparatus according to claim 1, wherein the period of time applies to the sustain electrode.

3. The apparatus according to claim 1, wherein the period of time corresponds to the end of the sustain period in the sub-field.

4. The apparatus according to claim 1, wherein the period of time corresponds to the beginning of the reset period of the next sub-field.

5. The apparatus of claim 1, wherein the drive unit drives the plasma display panel such that the period of time between the last sustain pulse generated during the sustain period of the sub-field and the initialization signal generated during the reset period of the next sub-field is substantially 200 μs to 500 μs in duration.

6. A method of driving a plasma display panel including a scan electrode and a sustain electrode, said method comprising:

dividing each of a number of image frames into N number of sub-fields, where each of the N sub-fields at least includes a sustain period and a reset period;

extending, as a temperature increases, a period of time between a last sustain pulse generated during a sustain period of a sub-field and an initialization signal generated during a reset period of a next sub-field; and supplying an erase signal to at least one of the scan electrode and the sustain electrode during the period of time, wherein the erase signal has a voltage that gradually rises, and the period of time corresponds to a decay period.

7. The method according to claim 6, wherein the period of time corresponds to the end of the sustain period in the sub-field.

8. The method according to claim 6, wherein the period of time corresponds to the beginning of the reset period of the next sub-field.

9. The method according to claim 6, wherein adjusting the period of time comprises:

adjusting the period of time such that the duration of time between the last sustain pulse generated during the sustain period of the sub-field and the initialization signal generated during the reset period of the next sub-field is substantially 200 μs to 500 μs.

* * * * *